US008744863B2

(12) United States Patent
Neuendorf et al.

(10) Patent No.: US 8,744,863 B2
(45) Date of Patent: Jun. 3, 2014

(54) MULTI-MODE AUDIO ENCODER AND AUDIO DECODER WITH SPECTRAL SHAPING IN A LINEAR PREDICTION MODE AND IN A FREQUENCY-DOMAIN MODE

(75) Inventors: Max Neuendorf, Nuremberg (DE); Guillaume Fuchs, Nuremberg (DE); Nikolaus Rettelbach, Nuremberg (DE); Tom Baeckstroem, Nuremberg (DE); Jeremie Lecomte, Forth (DE); Juergen Herre, Buckenhof (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/441,469

(22) Filed: Apr. 6, 2012

(65) Prior Publication Data

US 2012/0245947 A1 Sep. 27, 2012

Related U.S. Application Data

(63) Continuation of application No. PCT/EP2010/064917, filed on Oct. 6, 2010.

(60) Provisional application No. 61/249,774, filed on Oct. 8, 2009.

(51) Int. Cl.
*G10L 19/00* (2013.01)

(52) U.S. Cl.
USPC ..... 704/501; 704/206; 704/219

(58) Field of Classification Search
USPC ..... 704/205, 206, 219, 500, 501
See application file for complete search history.

(56) References Cited

U.S. PATENT DOCUMENTS 6,424,939 B1 * 7/2002 Herre et al. ..... 704/219
8,352,258 B2 * 1/2013 Yamanashi et al. ..... 704/230

(Continued)

FOREIGN PATENT DOCUMENTS

| | | |
|---|---|---|
| CN | 1358301 | 7/2002 |
| EP | 2107556 | 7/2009 |
| WO | WO-2010003582 | 1/2010 |

OTHER PUBLICATIONS

Fuchs et al., "A Speech Coder Post-Processor Controlled by Side-Information", IEEE International Conference on Acoustics, Speech, and Signal Processing, ICASSP 2005, vol. 4, Mar. 18-23, 2005, pp. IV-433 to IV-436.*

(Continued)

*Primary Examiner* — Martin Lerner
(74) *Attorney, Agent, or Firm* — Michael A. Glenn; Perkins Coie LLP

(57) ABSTRACT

A multi-mode audio signal decoder has a spectral value determinator to obtain sets of decoded spectral coefficients for a plurality of portions of an audio content and a spectrum processor configured to apply a spectral shaping to a set of spectral coefficients in dependence on a set of linear-prediction-domain parameters for a portion of the audio content encoded in a linear-prediction mode, and in dependence on a set of scale factor parameters for a portion of the audio content encoded in a frequency-domain mode. The audio signal decoder has a frequency-domain-to-time-domain converter configured to obtain a time-domain audio representation on the basis of a spectrally-shaped set of decoded spectral coefficients for a portion of the audio content encoded in the linear-prediction mode and for a portion of the audio content encoded in the frequency domain mode. An audio signal encoder is also described.

27 Claims, 21 Drawing Sheets

(56) References Cited

U.S. PATENT DOCUMENTS

| | | | | |
|---|---|---|---|---|
| 2002/0173951 | A1 | 11/2002 | Ehara et al. | |
| 2006/0173675 | A1* | 8/2006 | Ojanpera | 704/203 |
| 2007/0016418 | A1* | 1/2007 | Mehrotra et al. | 704/240 |
| 2007/0147518 | A1* | 6/2007 | Bessette | 375/243 |
| 2007/0282603 | A1* | 12/2007 | Bessette | 704/219 |
| 2008/0221905 | A1 | 9/2008 | Schnell et al. | |
| 2009/0299757 | A1* | 12/2009 | Guo et al. | 704/500 |
| 2010/0121646 | A1* | 5/2010 | Ragot et al. | 704/500 |
| 2010/0169081 | A1* | 7/2010 | Yamanashi et al. | 704/203 |
| 2010/0198586 | A1* | 8/2010 | Edler et al. | 704/203 |
| 2010/0241433 | A1* | 9/2010 | Herre et al. | 704/500 |
| 2010/0256980 | A1* | 10/2010 | Oshikiri et al. | 704/500 |
| 2010/0262420 | A1* | 10/2010 | Herre et al. | 704/201 |
| 2010/0286991 | A1* | 11/2010 | Hedelin et al. | 704/500 |
| 2011/0106542 | A1* | 5/2011 | Bayer et al. | 704/500 |
| 2011/0153333 | A1* | 6/2011 | Bessette | 704/500 |
| 2011/0173009 | A1 | 7/2011 | Fuchs et al. | |
| 2011/0173010 | A1 | 7/2011 | Lecomte et al. | |
| 2011/0320196 | A1* | 12/2011 | Choo et al. | 704/229 |
| 2012/0271644 | A1* | 10/2012 | Bessette et al. | 704/500 |
| 2013/0332153 | A1* | 12/2013 | Markovic et al. | 704/219 |

OTHER PUBLICATIONS

"WD on ISO/IEC 14496-3, MPEG-4 Audio Fourth Edition", ITU Study Group 16—Video Coding Experts Group—ISO/IEC MPEG & ITU-TVCEG (ISO/IEC JTC1/SC29/WG11 and ITU-T SG16 Q6), XX, XX, No. N9239, Jul. 6, 2007, XP030015733, 368 pages.

"Generic Coding of Moving Pictures and Associated Audio: Advanced Audio Coding. International Standard 13818-7", ISO/IEC JTC1/SC29/WG11 Moving Pictures Expert Group 1997, 108 pages.

"Extended Adaptive Multi-Rate—Wideband (AMR-WB+) codec", 3GPP TS 26.290 V6.3.0, Jun. 2005, Technical Specification, 85 pages.

Iwakami, N. et al., "High-quality audio-coding at less than 64 kbits/s by using transform-domain weighted interleave vector quantization (Twin VQ)" IEEE ICASSP 1995, pp. 3095-3098.

Lecomte, et al., "Efficient Cross-Fade Windows for Transitions Between LPC-Based and Non-LPC Based Audio Coding", AES Convention 126; May 2009, AES, 60 East 42nd Street, Room 2520 New York 10165-2520, USA, May 1, 2009, XP040508994F, 18 pages.

Neuendorf, M. et al., "Unified speech and audio coding scheme for high quality at low bitrates", Acoustics, Speech and Signal Processing, 2009. ICASSP 2009. IEEE International Conference, IEEE Piscataway, NJ, USA, Apr. 19, 2009, XP031459151, ISBN: 978-1-4244-2353-, pp. 1-4.

Shin, Sang-Wook et al., "Designing a unified speech/audio codec by adopting a single channel harmonic source separation module", Acoustics, Speech and Signal Processing, 2008. ICASSP 2008. IEEE International Conference, IEEE, Piscataway, NJ, USA, Mar. 31, 2008, XP031, pp. 185-188.

* cited by examiner

AUDIO SIGNAL ENCODER

| FIG 1 | |
|---|---|
| FIG 1A | FIG 1B |

| FIG 1 | |
|---|---|
| FIG 1A | FIG 1B |

AUDIO SIGNAL ENCODER

```
Function lpc2mdct(input lpc_coeffs, lpc_order,
                  input sizeR,sizeM,sizeL,
                  output mdct_scaleFactors){
int sizeN=2*(sizeL/2+sizeM+sizeR/2);
float InRealData[sizeN];
float OutRealData[sizeN];
float InImagData[sizeN];
float OutImagData[mdct_size];

510  /*ODFT*/
     for(i=0; i<lpc_order; i++){
        InRealData[i]=lpcCoeffs[i]*cos(i*PI/(float)(sizeN));
        InImagData[i]=-lpcCoeffs[i]*sin(i*PI/(float)(sizeN));
        }
     for(;i<sizeN; i++){
        InRealData[i]=0.f;
        InImagData[i]=0.f;
        }

520  Complex_fft(InRealData,InImagData,OutRealData,OutImagData,sizeN);

     /*Get amplitude*/
     for(i=0; i<sizeN/2; i++){
        mdct_scaleFactors[i]=sqrt(1/(OutRealData[i]*OutRealData[i]+OutImagData[i]*OutImagData[i]));
        }
}
```

FIG 5

```
For(i=0;i<sizeL/2+sizeM+sizeR/2;i++){
    mdct[i]=mdct[i]/mdct_scaleFactors[i];
}
```

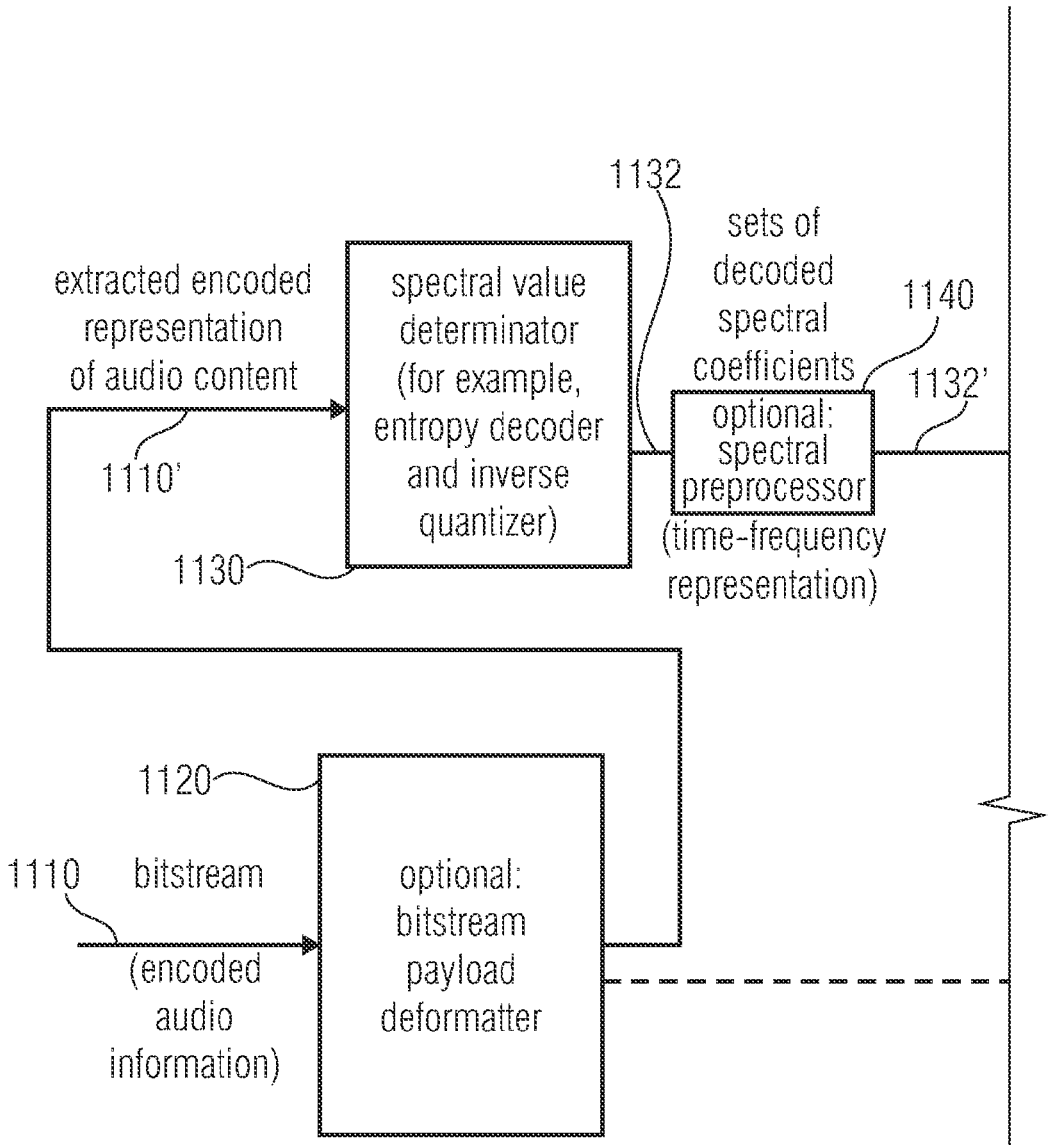
FIG 11A
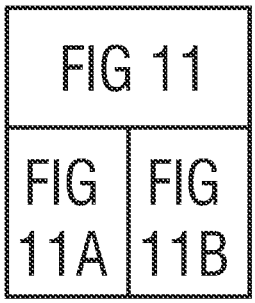

| FIG 11 | |
|---|---|
| FIG 11A | FIG 11B |

A UNIFIED VIEW OF A USAC DECODER WITH TCX-MDCT IN THE SIGNAL DOMAIN

| FIG 12 | |
|---|---|
| FIG 12A | FIG 12B |

A UNIFIED VIEW OF A USAC DECODER WITH TCX-MDCT IN THE SIGNAL DOMAIN

| FIG 12 | |
|---|---|
| FIG 12A | FIG 12B |

ac_spectral_data
(→arith_data)
(fd_channel_stream)
tcx_coding
(→arith_data)
(fpd_channel_stream)
1228
entropy decoding
(e.g. arithmetic decoder)
1330a
x_ac_quant
x_tcx_quant
inverse quantization
1330c
x_ac_invquant[g][win][sfb][bin]
x_tcx_invquant[win][bin]
(=quant[])
1330d
TCX
quant[]
FD
noise filling
1370
r[i]
1372
spectrum
de-shaping
1374
noise filling
(optional)
1340
x_ac_invquant
1342
scaling
1344
scale factor
parameters
1300

FIG
13

Number of Spectral Coefficients as a Function of mod[]

| value of mod[x] | number lg of spectral coefficients | ZL | L | M | R | ZR | number of time domain samples per subframe or frame (including overlap) |
|---|---|---|---|---|---|---|---|
| 1 | 256 | 0 | 256 | 0 | 256 | 0 | 512 (subframe) |
| 2 | 512 | 128 | 256 | 256 | 256 | 128 | 1024(subframe) |
| 3 | 1024 | 384 | 256 | 768 | 256 | 384 | 2048 (subframe) |

FIG 15 window sequences and transform windows

| value | window | #coeffs | window shape |
|---|---|---|---|
| 0 | ONLY_LONG_SEQUENCE =LONG_WINDOW | 1024/960 | |
| 1 | LONG_START_SEQUENCE =LONG_START_WINDOW | 1024/960 | |
| 2 | EIGHT_SHORT_SEQUENCE =8*SHORT_WINDOW | 8*(128/120) | |
| 3 | LONG_STOP_SEQUENCE =LONG_STOP_WINDOW | 1024/960 | |
| 1 | STOP_START_SEQUENCE =STOP_START_WINDOW | 1024/960 | |
| note | dashed lines indicate window shape when the adjacent window sequence is LPD_SEQUENCE | | |

FIG 16 allowed window transitions

| window sequence from↓ to→ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE |
|---|---|---|---|---|---|---|
| ONLY_LONG_SEQUENCE | ☑ | ☑ | | | | |
| LONG_START_SEQUENCE | | | ☑ | ☑ | ☑ | ☑ |
| EIGHT_SHORT_SEQUENCE | | | ☑ | ☑ | ☑ | ☑ |
| LONG_STOP_SEQUENCE | ☑ | ☑ | | | | |
| STOP_START_SEQUENCE | | | ☑ | ☑ | ☑ | ☑ |
| LPD_SEQUENCE | | | ☑ | ☑ | ☑ | ☑ |

FIG 17A allowed window transitions

| window sequence from↓ to→ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE | LPD_START_SEQUENCE |
|---|---|---|---|---|---|---|---|
| ONLY_LONG_SEQUENCE | ☑ | ☑ | | | | | ☑ |
| LONG_START_SEQUENCE | | | ☑ | ☑ | ☑ | ☑ | |
| EIGHT_SHORT_SEQUENCE | | | ☑ | ☑ | ☑ | ☑ | |
| LONG_STOP_SEQUENCE | ☑ | ☑ | | | | | ☑ |
| STOP_START_SEQUENCE | | | ☑ | ☑ | ☑ | ☑ | |
| LPD_SEQUENCE | | | ☑ | ☑ | ☑ | ☑ | |
| LPD_START_SEQUENCE | | | | | | ☑ | |

FIG 17B

MULTI-MODE AUDIO ENCODER AND AUDIO DECODER WITH SPECTRAL SHAPING IN A LINEAR PREDICTION MODE AND IN A FREQUENCY-DOMAIN MODE

CROSS-REFERENCE TO RELATED APPLICATIONS

This application is a continuation of copending International Application No. PCT/EP2010/064917, filed Oct. 6, 2010, which is incorporated herein by reference in its entirety, and additionally claims priority from U.S. Application No. 61/249,774 filed Oct. 8, 2009, which is incorporated herein by reference in its entirety.

BACKGROUND OF THE INVENTION

Embodiments according to the present invention are related to a multi-mode audio signal decoder for providing a decoded representation of an audio content on the basis of an encoded representation of the audio content.

Further embodiments according to the invention are related to a multi-mode audio signal encoder for providing an encoded representation of an audio content on the basis of an input representation of the audio content.

Further embodiments according to the invention are related to a method for providing a decoded representation of an audio content on the basis of an encoded representation of the audio content.

Further embodiments according to the invention are related to a method for providing an encoded representation of an audio content on the basis of an input representation of the audio content.

Further embodiments according to the invention are related to computer programs implementing said methods.

In the following, some background of the invention will be explained in order to facilitate the understanding of the invention and the advantages thereof.

During the past decade, big effort has been put on creating the possibility to digitally store and distribute audio contents. One important achievement on this way is the definition of the international standard ISO/IEC 14496-3. Part 3 of this standard is related to an encoding and decoding of audio contents, and sub-part 4 of part 3 is related to general audio coding. ISO/IEC 14496 part 3, sub-part 4 defines a concept for encoding and decoding of general audio content. In addition, further improvements have been proposed in order to improve the quality and/or reduce the needed bit rate.

Moreover, it has been found that the performance of frequency-domain based audio coders is not optimal for audio contents comprising speech. Recently, a unified speech-and-audio codec has been proposed which efficiently combines techniques from both worlds, namely speech coding and audio coding (see, for example, Reference [1].)

In such an audio coder, some audio frames are encoded in the frequency domain and some audio frames are encoded in the linear-prediction-domain.

However, it has been found that it is difficult to transition between frames encoded in different domains without sacrificing a significant amount of bit rate.

In view of this situation, there is a desire to create a concept for encoding and decoding an audio content comprising both speech and general audio, which allows for an efficient realization of transitions between portions encoded using different modes.

SUMMARY

According to an embodiment, a multi-mode audio signal decoder for providing a decoded representation of an audio content on the basis of an encoded representation of the audio content may have a spectral value determinator configured to acquire sets of decoded spectral coefficients for a plurality of portions of the audio content; a spectrum processor configured to apply a spectral shaping to a set of decoded spectral coefficients, or to a pre-processed version thereof, in dependence on a set of linear-prediction-domain parameters for a portion of the audio content encoded in the linear-prediction mode, and to apply a spectral shaping to a set of decoded spectral coefficients, or a pre-processed version thereof, in dependence on a set of scale factor parameters for a portion of the audio content encoded in the frequency-domain mode, and a frequency-domain-to-time-domain converter configured to acquire a time-domain representation of the audio content on the basis of a spectrally-shaped set of decoded spectral coefficients for a portion of the audio content encoded in the linear-prediction mode, and to acquire a time-domain representation of the audio content on the basis of a spectrally-shaped set of decoded spectral coefficients for a portion of the audio content encoded in the frequency-domain mode.

According to another embodiment, a multi-mode audio signal encoder for providing an encoded representation of an audio content on the basis of an input representation of the audio content may have a time-domain-to-frequency-domain converter configured to process the input representation of the audio content, to acquire a frequency-domain representation of the audio content, wherein the frequency-domain representation has a sequence of sets of spectral coefficients; a spectrum processor configured to apply a spectral shaping to a set of spectral coefficients, or a pre-processed version thereof, in dependence on a set of linear-prediction domain parameters for a portion of the audio content to be encoded in the linear-prediction mode, to acquire a spectrally-shaped set of spectral coefficients, and to apply a spectral shaping to a set of spectral coefficients, or a pre-processed version thereof, in dependence on a set of scale factor parameters for a portion of the audio content to be encoded in the frequency-domain mode, to acquire a spectrally-shaped set of spectral coefficients; and a quantizing encoder configured to provide an encoded version of a spectrally-shaped set of spectral coefficients for the portion of the audio content to be encoded in the linear-prediction mode, and to provide an encoded version of a spectrally-shaped set of spectral coefficients for the portion of the audio content to be encoded in the frequency-domain mode.

According to another embodiment, a method for providing a decoded representation of an audio content on the basis of an encoded representation of the audio content may have the steps of acquiring sets of decoded spectral coefficients for a plurality of portions of the audio content; applying a spectral shaping to a set of decoded spectral coefficients, or a pre-processed version thereof, in dependence on a set of linear-prediction-domain parameters for a portion of the audio content encoded in a linear-prediction mode, and applying a spectral shaping to a set of decoded spectral coefficients, or a pre-processed version thereof, in dependence on a set of scale factor parameters for a portion of the audio content encoded in a frequency-domain mode; and acquiring a time-domain representation of the audio content on the basis of a spectrally-shaped set of decoded spectral coefficients for a portion of the audio content encoded in the linear-prediction mode, and acquiring a time-domain representation of the audio content on the basis of a spectrally-shaped set of decoded spectral coefficients for a portion of the audio content encoded in the frequency-domain mode.

According to another embodiment, a method for providing an encoded representation of an audio content on the basis of an input representation of the audio content may have the steps of processing the input representation of the audio content, to acquire a frequency-domain representation of the audio content, wherein the frequency-domain representation has a sequence of sets of spectral coefficients; applying a spectral shaping to a set of spectral coefficients, or a preprocessed version thereof, in dependence on a set of linear-prediction domain parameters for a portion of the audio content to be encoded in the linear-prediction mode, to acquire a spectrally-shaped set of spectral coefficients; applying a spectral shaping to a set of spectral coefficients, or a preprocessed version thereof, in dependence on a set of scale factor parameters for a portion of the audio content to be encoded in the frequency-domain mode, to acquire a spectrally-shaped set of spectral coefficients; providing an encoded representation of a spectrally-shaped set of spectral coefficients for the portion of the audio content to be encoded in the linear-prediction mode using a quantizing encoding; and providing an encoded version of a spectrally-shaped set of spectral coefficients for the portion of the audio content to be encoded in the frequency domain mode using a quantizing encoding.

According to another embodiment, a computer program may performing one of the above mentioned methods, when the computer program runs on a computer.

An embodiment according to the invention creates a multi-mode audio signal decoder for providing a decoded representation of an audio content on the basis of an encoded representation of the audio content. The audio signal decoder comprises a spectral value determinator configured to obtain sets of decoded spectral coefficients for a plurality of portions of the audio content. The multi-mode audio signal decoder also comprises a spectrum processor configured to apply a spectral shaping to a set of the decoded spectral coefficients, or to a preprocessed version thereof, in dependence on a set of linear-prediction-domain parameters for a portion of the audio content encoded in a linear prediction mode, and to apply a spectral shaping to a set of decoded spectral coefficients, or to a pre-processed version thereof, in dependence on a set of scale factor parameters for a portion of the audio content encoded in a frequency domain mode. The multi-mode audio signal decoder also comprises a frequency-domain-to-time-domain converter configured to obtain a time-domain representation of the audio content on the basis of a spectrally shaped set of decoded spectral coefficients for a portion of the audio content encoded in the linear prediction mode, and to also obtain a time-domain representation of the audio content on the basis of a spectrally shaped set of decoded spectral coefficients for a portion of the audio content encoded in the frequency domain mode.

This multi-mode audio signal decoder is based on the finding that efficient transitions between portions of the audio content encoded in different modes can be obtained by performing a spectral shaping in the frequency domain, i.e., a spectral shaping of sets of decoded spectral coefficients, both for portions of the audio content encoded in the frequency-domain mode and for portions of the audio content encoded in the linear-prediction mode. By doing so, a time-domain representation obtained on the basis of a spectrally shaped set of decoded spectral coefficients for a portion of the audio content encoded in the linear-prediction mode is "in the same domain" (for example, are output values of frequency-domain-to-time-domain transforms of the same transform type) as a time domain representation obtained on the basis of a spectrally shaped set of decoded spectral coefficients for a portion of the audio content encoded in the frequency-domain mode. Thus, the time-domain representations of a portion of the audio content encoded in the linear prediction mode and of a portion of the audio content encoded in the frequency-domain mode can be combined efficiently and without inacceptable artifacts. For example, aliasing cancellation characteristics of typical frequency-domain-to-time-domain converters can be exploited by frequency-domain-to-time-domain converting signals, which are in the same domain (for example, both represent an audio content in an audio content domain). Thus, good quality transitions can be obtained between portions of the audio content encoded in different modes without needing a substantial amount of bit rate for allowing such transitions.

In an embodiment, the multi-mode audio signal decoder further comprises an overlapper configured to overlap-and-add a time-domain representation of a portion of the audio content encoded in the linear-prediction mode with a portion of the audio content encoded in the frequency-domain mode. By overlapping portions of the audio content encoded in different domains, the advantage, which can be obtained by inputting spectrally-shaped sets of decoded spectral coefficients to the frequency-domain-to-time-domain converter in both modes of the multi-mode audio signal decoder can be realized. By performing the spectral shaping before the frequency-domain-to-time-domain conversion in both modes of the multi-mode audio signal decoder, the time-domain representations of the portions of the audio contents encoded in the different modes typically comprise very good overlap-and-add-characteristics, which allow for good quality transitions without needing additional side information.

In an embodiment, the frequency-domain-to-time-domain converter is configured to obtain a time-domain representation of the audio content for a portion of the audio content encoded in the linear-prediction mode using a lapped transform and to obtain a time-domain representation of the audio content for a portion of the audio content encoded in the frequency-domain mode using a lapped transform. In this case, the overlapper is advantageously configured to overlap time domain representations of subsequent portions of the audio content encoded in different of the modes. Accordingly, smooth transitions can be obtained. Due to the fact that a spectral shaping is applied in the frequency domain for both of the modes, the time domain representations provided by the frequency-domain-to-time-domain converter in both of the modes are compatible and allow for a good-quality transition. The use of lapped transform brings an improved tradeoff between quality and bit rate efficiency of the transitions because lapped transforms allow for smooth transitions even in the presence of quantization errors while avoiding a significant bit rate overhead.

In an embodiment, the frequency-domain-to-time-domain converter is configured to apply a lapped transform of the same transform type for obtaining time-domain representation of the audio contents of portions of the audio content encoded in different of the modes. In this case, the overlapper is configured to overlap-and-add the time domain representations of subsequent portions of the audio content encoded in different of the modes, such that a time-domain aliasing caused by the lapped transform is reduced or eliminated by the overlap-and-add. This concept is based on the fact that the output signals of the frequency-domain-to-time-domain conversion is in the same domain (audio content domain) for both of the modes by applying both the scale factor parameters and the linear-prediction-domain parameters in the frequency-domain. Accordingly, the aliasing-cancellation, which is typically obtained by applying lapped transforms of the same transform type to subsequent and partially overlapping portions of an audio signal representation can be exploited.

In an embodiment, the overlapper is configured to overlap-and-add a time domain representation of a first portion of the audio content encoded in a first of the modes, as provided by an associated synthesis lapped transform, or an amplitude-scaled but spectrally-undistorted version thereof, and a time-domain representation of a second subsequent portion of the audio content encoded in a second of the modes, as provided by an associated synthesis lapped transform, or an amplitude-scaled but spectrally-undistorted version thereof. By avoiding at the output signals of the synthesis lapped transform to apply any signal processing (for example, a filtering or the like) not common to all different coding modes used for subsequent (partially overlapping) portions of the audio content, full advantage can be taken from the aliasing-cancellation characteristics of the lapped transform.

In an embodiment, the frequency-domain-to-time-domain converter is configured to provide time-domain representations of portions of the audio content encoded in different of the modes such that the provided time-domain representations are in a same domain in that they are linearly combinable without applying a signal shaping filtering operation to one or both of the provided time-domain representations. In other words, the output signals of the frequency-domain-to-time-domain conversion are time-domain representations of the audio content itself for both of the modes (and not excitation signals for an excitation-domain-to-time-domain conversion filtering operation).

In an embodiment, the frequency-domain-to-time-domain converter is configured to perform an inverse modified discrete cosine transform, to obtain, as a result of the inverse-modified-discrete-cosine-transform, a time domain representation of the audio content in a audio signal domain, both for a portion of the audio content encoded in the linear prediction mode and for a portion of the audio content encoded in the frequency-domain mode.

In an embodiment, the multi-mode audio signal decoder comprises an LPC-filter coefficient determinator configured to obtain decoded LPC-filter coefficients on the basis of an encoded representation of the LPC-filter coefficients for a portion of the audio content encoded in a linear-prediction mode. In this case, the multi-mode audio signal decoder also comprises a filter coefficient transformer configured to transform the decoded LPC-filter coefficients into a spectral representation, in order to obtain gain values associated with different frequencies. Thus, the LPC-filter coefficient may serve as linear prediction domain parameters. The multi-mode audio signal decoder also comprises a scale factor determinator configured to obtain decoded scale factor values (which serve as scale factor parameters) on the basis of an encoded representation of the scale factor values for a portion of the audio content encoded in a frequency-domain mode. The spectrum processor comprises a spectrum modifier configured to combine a set of decoded spectral coefficients associated with a portion of the audio content encoded in the linear-prediction mode, or a pre-processed version thereof, with the linear-prediction mode gain values, in order to obtain a gain-value processed (and, consequently, spectrally-shaped) version of the (decoded) spectral coefficients in which contributions of the decoded spectral coefficients, or of the pre-processed version thereof, are weighted in dependence on the gain values. Also, the spectrum modifier is configured to combine a set of decoded spectral coefficients associated to a portion of the audio content encoded in the frequency-domain mode, or a pre-processed version thereof, with the decoded scale factor values, in order to obtain a scale-factor-processed (spectrally shaped) version of the (decoded) spectral coefficients in which contributions of the decoded spectral coefficients, or of the pre-processed version thereof, are weighted in dependence on the scale factor values.

By using this approach, a known noise-shaping can be obtained in both modes of the multi-mode audio signal decoder while still ensuring that the frequency-domain-to-time-domain converter provides output signals with good transition characteristics at the transitions between portions of the audio signal encoded in different modes.

In an embodiment, the coefficient transformer is configured to transform the decoded LPC-filter coefficients, which represent a time-domain impulse response of a linear-prediction-coding filter (LPC-filter), into the spectral representation using an odd discrete Fourier transform. The filter coefficient transformer is configured to derive the linear prediction mode gain values from the spectral representation of the decoded LPC-filter coefficients, such that the gain values are a function of magnitudes of coefficients of the spectral representation. Thus, the spectral shaping, which is performed in the linear-prediction mode, takes over the noise-shaping functionality of a linear-prediction-coding filter. Accordingly, quantization noise of the decoded spectral representation (or of the pre-processed version thereof) is modified such that the quantization noise is comparatively small for "important" frequencies, for which the spectral representation of the decoded LPC-filter coefficient is comparatively large.

In an embodiment, the filter coefficient transformer and the combiner are configured such that a contribution of a given decoded spectral coefficient, or of a pre-processed version thereof, to a gain-processed version of the given spectral coefficient is determined by a magnitude of a linear-prediction mode gain value associated with the given decoded spectral coefficient.

In an embodiment, the spectral value determinator is configured to apply an inverse quantization to decoded quantized spectral values, in order to obtain decoded and inversely quantized spectral coefficients. In this case, the spectrum modifier is configured to perform a quantization noise shaping by adjusting an effective quantization step for a given decoded spectral coefficient in dependence on a magnitude of a linear prediction mode gain value associated with the given decoded spectral coefficient. Accordingly, the noise-shaping, which is performed in the spectral domain, is adapted to signal characteristics described by the LPC-filter coefficients.

In an embodiment, the multi-mode audio signal decoder is configured to use an intermediate linear-prediction mode start frame in order to transition from a frequency-domain mode frame to a combined linear-prediction mode/algebraic-code-excited-linear-prediction mode frame. In this case, the audio signal decoder is configured to obtain a set of decoded spectral coefficients for the linear-prediction mode start frame. Also, the audio decoder is configured to apply a spectral shaping to the set of decoded spectral coefficients for the linear-prediction mode start frame, or to a preprocessed version thereof, in dependence on a set of linear-prediction-domain parameters associated therewith. The audio signal decoder is also configured to obtain a time-domain representation of the linear-prediction mode start frame on the basis of a spectrally shaped set of decoded spectral coefficients. The audio decoder is also configured to apply a start window having a comparatively long left-sided transition slope and a comparatively short right-sided transition slope to the time-domain representation of the linear-prediction mode start frame. By doing so, a transition between a frequency-domain mode frame and a combined linear-prediction mode/algebraic-code-excited-linear-prediction mode frame is created which comprises good overlap-and-add characteristics with the preceding frequency-domain mode frame and which, at the same time, makes linear-prediction-domain coefficients available for use by the subsequent combined linear-prediction mode/algebraic-code-excited-linear-prediction mode frame.

In an embodiment, the multi-mode audio signal decoder is configured to overlap a right-sided portion of a time-domain representation of a frequency-domain mode frame preceding the linear-prediction mode start frame with a left-sided portion of a time-domain representation of the linear-prediction mode start frame, to obtain a reduction or cancellation of a time-domain aliasing. This embodiment is based on the finding that good time-domain aliasing cancellation characteristics are obtained by performing a spectral shaping of the linear-prediction mode start frame in the frequency domain, because a spectral shaping of the previous frequency-domain mode frame is also performed in the frequency-domain.

In an embodiment, the audio signal decoder is configured to use linear-prediction domain parameters associated with the linear-prediction mode start frame in order to initialize an algebraic-code-excited-linear-prediction mode decoder for decoding at least a portion of the combined linear-prediction mode/algebraic-code-excited-linear-prediction mode frame. In this way, the need to transmit an additional set of linear-prediction-domain parameters, which exists in some conventional approaches, is eliminated. Rather, the linear-prediction mode start frame allows to create a good transition from a previous frequency-domain mode frame, even for a comparatively long overlap period, and to initialize a algebraic-code-excited-linear-prediction (ACELP) mode decoder. Thus, transitions with good audio quality can be obtained with very high degree of efficiency.

Another embodiment according to the invention creates a multi-mode audio signal encoder for providing an encoded representation of an audio content on the basis of an input representation of the audio content. The audio encoder comprises a time-domain-to-time-frequency-domain converter configured to process the input representation of the audio content, to obtain a frequency-domain representation of the audio content. The audio encoder further comprises a spectrum processor configured to apply a spectral shaping to a set of spectral coefficients, or a pre-processed version thereof, in dependence on a set of linear-prediction-domain parameters for a portion of the audio content to be encoded in the linear-prediction-domain. The spectrum processor is also configured to apply a spectral shaping to a set of spectral coefficients, or to a preprocessed version thereof, in dependence on a set of a scale factor parameters for a portion of the audio content to be encoded in the frequency-domain mode.

The above described multi-mode audio signal encoder is based on the finding that an efficient audio encoding, which allows for a simple audio decoding with low distortions, can be obtained if an input representation of the audio content is converted into the frequency-domain (also designated as time-frequency domain) both for portions of the audio content to be encoded in the linear-prediction mode and for portions of the audio content to be encoded in the frequency-domain mode. Also, it has been found that quantization errors can be reduced by applying a spectral shaping to a set of spectral coefficients (or a pre-processed version thereof) both for a portion of the audio content to be encoded in the linear-prediction mode and for a portion of the audio content to be encoded in the frequency-domain mode. If different types of parameters are used to determine the spectral shaping in the different modes (namely, linear-prediction-domain parameters in the linear-prediction mode and scale factor parameters in the frequency-domain mode), the noise shaping can be adapted to the characteristic of the currently-processed portion of the audio content while still applying the time-domain-to-frequency-domain conversion to (portions of) the same audio signal in the different modes. Consequently, the multi-mode audio signal encoder is capable of providing a good coding performance for audio signals having both general audio portions and speech audio portions by selectively applying the proper type of spectral shaping to the sets of spectral coefficients. In other words, a spectral shaping on the basis of a set of linear-prediction-domain parameters can be applied to a set of spectral coefficients for an audio frame which is recognized to be speech-like, and a spectral shaping on the basis of a set of scale factor parameters can be applied to a set of spectral coefficients for an audio frame which is recognized to be of a general audio type, rather than of a speech-like type.

To summarize the multi-mode audio signal encoder allows for encoding an audio content having temporally variable characteristics (speech like for some temporal portions and general audio for other portions) wherein the time-domain representation of the audio content is converted into the frequency domain in the same way for portions of the audio content to be encoded in different modes. The different characteristics of different portions of the audio content are considered by applying a spectral shaping on the basis of different parameters (linear-prediction-domain parameters versus scale factor parameters), in order to obtain spectrally shaped spectral coefficients for the subsequent quantization.

In an embodiment, the time-domain-to-frequency-domain converter is configured to convert a time-domain representation of an audio content in an audio signal domain into a frequency-domain representation of the audio content both for a portion of the audio content to be encoded in the linear-prediction mode and for a portion of the audio content to be encoded in the frequency-domain mode. By performing the time-domain-to-frequency-domain conversion (in the sense of a transform operation, like, for example, an MDCT transform operation or a filter bank-based frequency separation operation) on the basis of the same input signal both for the frequency-domain mode and the linear-prediction mode, a decoder-sided overlap-and-add operation can be performed with particularly good efficiency, which facilitates the signal reconstruction at the decoder side and avoids the need to transmit additional data whenever there is a transition between the different modes.

In an embodiment, the time-domain-to-frequency-domain converter is configured to apply analysis lapped transforms of the same transform type for obtaining frequency-domain representations for portions of the audio content to be encoded in different modes. Again, using lapped transforms of the same transform type allows for a simple reconstruction of the audio content while avoiding blocking artifacts. In particular, it is possible to use a critical sampling without a significant overhead.

In an embodiment, the spectrum processor is configured to selectively apply the spectral shaping to the set of spectral coefficients, or a pre-processed version thereof, in dependence on a set of linear prediction domain parameters obtained using a correlation-based analysis of a portion of the audio content to be encoded in the linear prediction mode, or in dependence on a set of scale factor parameters obtained using a psychoacoustic model analysis of a portion of the audio content to be encoded in the frequency domain mode. By doing so, an appropriate noise shaping can be achieved both for speech-like portions of the audio content, in which the correlation-based analysis provides meaningful noise shaping information, and for general audio portions of the audio content, for which the psychoacoustic model analysis provides meaningful noise shaping information.

In an embodiment, the audio signal encoder comprises a mode selector configured to analyze the audio content in order to decide whether to encode a portion of the audio content in the linear-prediction mode or in the frequency-domain mode. Accordingly, the appropriate noise shaping concept can be chosen while leaving the type of time-domain-to-frequency-domain conversion unaffected in some cases.

In an embodiment, the multi-mode audio signal encoder is configured to encode an audio frame, which is between a frequency-domain mode frame and a combined linear-prediction mode/algebraic-code-excited-linear-prediction mode frame as a linear-prediction mode start frame. The multi-mode audio signal encoder is configured to apply a start window having a comparatively long left-sided transition slope and a comparatively short right-sided transition slope to the time-domain representation of the linear-prediction mode start frame, to obtain a windowed time-domain representation. The multi-mode audio signal encoder is also configured to obtain a frequency-domain representation of the windowed time-domain representation of the linear-prediction mode start frame. The multi-mode audio signal encoder is also configured to obtain a set of linear-prediction domain parameters for the linear-prediction mode start frame and to apply a spectral shaping to the frequency-domain representation of the windowed time-domain representation of the linear-prediction mode start frame, or to a pre-processed version thereof, in dependence on the set of linear-prediction-domain parameters. The audio signal encoder is also configured to encode the set of linear-prediction-domain parameters and the spectrally-shaped frequency-domain representation of the windowed time-domain representation of the linear-prediction mode start frame. In this manner, encoded information of a transition audio frame is obtained, which encoded information of the transition audio frame can be used for a reconstruction of the audio content, wherein the encoded information about the transition audio frame allows for a smooth left-sided transition and at the same time allows for an initialization of an ACELP mode decoder for decoding a subsequent audio frame. An overhead caused by the transition between different modes of the multi-mode audio signal encoder is minimized.

In an embodiment, the multi-mode audio signal encoder is configured to use the linear-prediction-domain parameters associated with the linear-prediction mode start frame in order to initialize an algebraic-code-excited-linear prediction mode encoder for encoding at least a portion of the combined linear-prediction mode/algebraic-code-excited-linear-prediction mode frame following the linear-prediction mode start frame. Accordingly, the linear-prediction-domain parameters, which are obtained for the linear-prediction mode start frame, and which are also encoded in a bit stream representing the audio content, are re-used for the encoding of a subsequent audio frame, in which the ACELP-mode is used. This increases the efficiency of the encoding and also allows for an efficient decoding without additional ACELP initialization side information.

In an embodiment, the multi-mode audio signal encoder comprises an LPC-filter coefficient determinator configured to analyze a portion of the audio content to be encoded in a linear-prediction mode, or a pre-processed version thereof, to determine LPC-filter coefficients associated with the portion of the audio content to be encoded in the linear-prediction mode. The multi-mode audio signal encoder also comprises a filter coefficient transformer configured to transform the decoded LPC-filter coefficients into a spectral representation, in order to obtain linear prediction mode gain values associated with different frequencies. The multi-mode audio signal encoder also comprises a scale factor determinator configured to analyze a portion of the audio content to be encoded in the frequency-domain mode, or a pre-processed version thereof, to determine scale factors associated with the portion of the audio content to be encoded in the frequency-domain mode. The multi-mode audio signal encoder also comprises a combiner arrangement configured to combine a frequency-domain representation of a portion of the audio content to be encoded in the linear prediction mode, or a processed version thereof, with the linear prediction mode gain values, to obtain gain-processed spectral components (also designated as coefficients), wherein contributions of the spectral components (or spectral coefficients) of the frequency-domain representation of the audio content are weighted in dependence on the linear prediction mode gain values. The combiner is also configured to combine a frequency-domain representation of a portion of the audio content to be encoded in the frequency domain mode, or a processed version thereof, with the scale factors, to obtain gain-processed spectral components, wherein contributions of the spectral components (or spectral coefficients) of the frequency-domain representation of the audio content are weighted in dependence on the scale factors.

In this embodiment, the gain-processed spectral components form spectrally shaped sets of spectral coefficients (or spectral components).

Another embodiment according to the invention creates a method for providing a decoded representation of an audio content on the basis of an encoded representation of the audio content.

Yet another embodiment according to the invention creates a method for providing an encoded representation of an audio content on the basis of an input representation of the audio content.

Yet another embodiment according to the invention creates a computer program for performing one or more of said methods.

The methods and the computer program are based on the same findings as the above discussed apparatus.

BRIEF DESCRIPTION OF THE DRAWINGS

Embodiments of the present invention will subsequently be described taking reference to the enclosed Figs., in which:

FIG. 5 shows a computer program code of a function for deriving linear-prediction-domain gain values on the basis of decoded LPC filter coefficients;

FIG. 15 shows a table representing a number of spectral coefficients as a function of a variable MOD [ ];

FIG. 16 shows a table representing window sequences and transform windows;

FIG. 17*a* shows a schematic representation of an audio window transition in an embodiment of the invention;

FIG. 17*b* shows a table representing an audio window transition in an extended embodiment according to the invention.

DETAILED DESCRIPTION OF THE INVENTION

1. Audio Signal Encoder According to FIG. 1

Figure 1A:
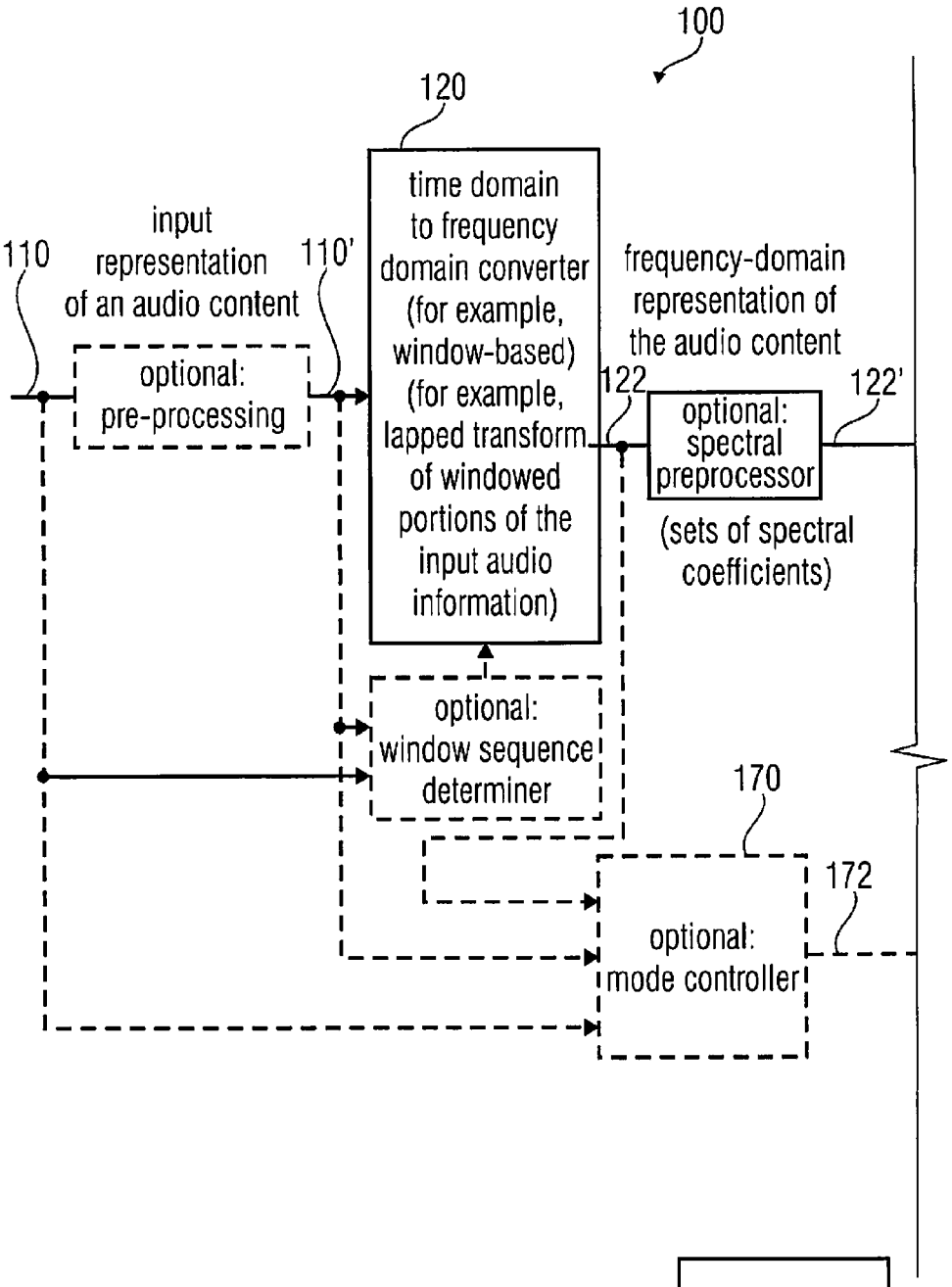
FIG. 1 shows a block schematic diagram of an audio signal encoder, according to an embodiment of the invention.
Figure 1B:
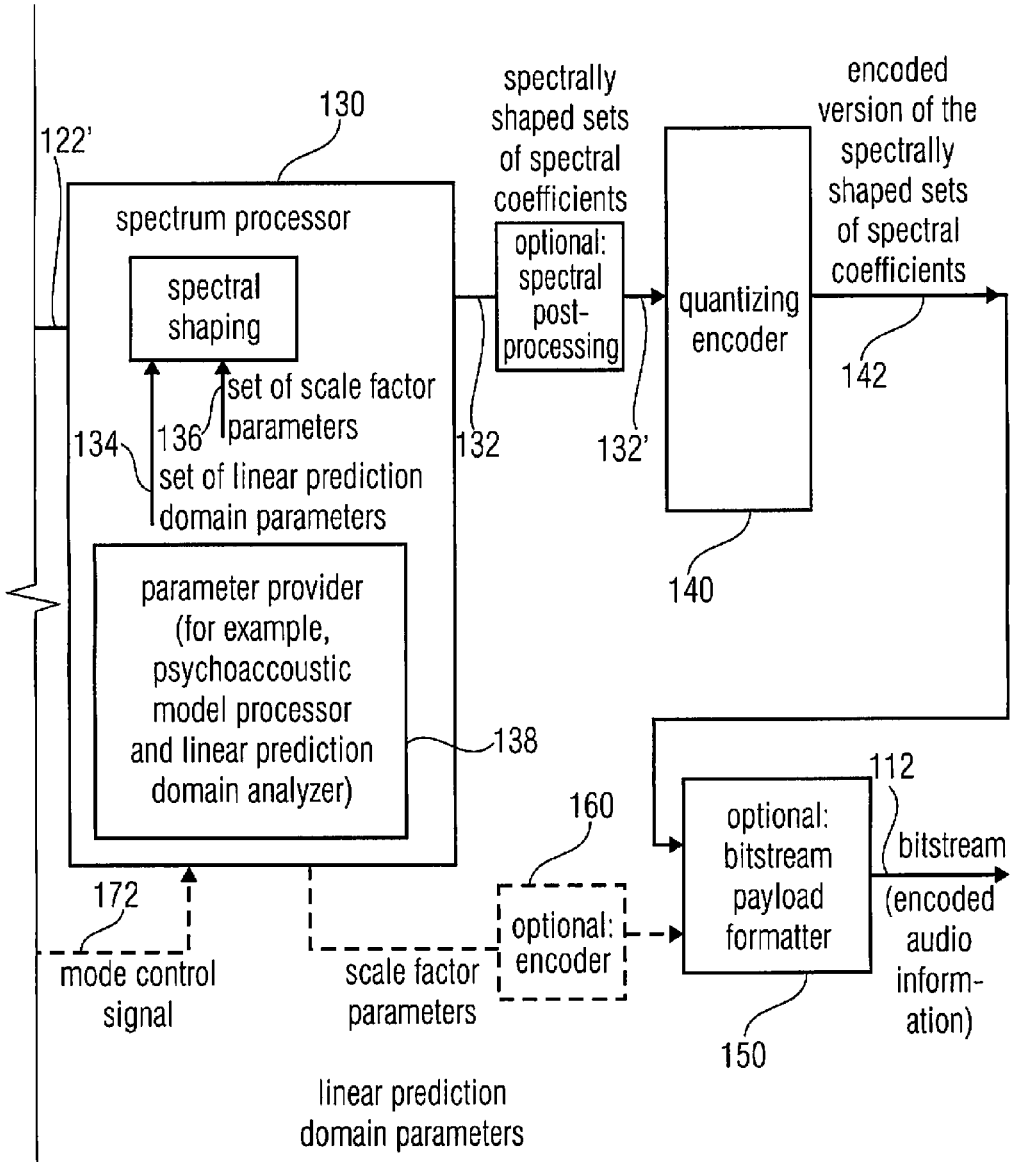

In the following, an audio signal encoder according to an embodiment of the invention will be discussed taking reference to FIG. 1, which shows a block schematic diagram of such a multi-mode audio signal encoder 100. The multi-mode audio signal encoder 100 is sometimes also briefly designated as an audio encoder.

The audio encoder 100 is configured to receive an input representation 110 of an audio content, which input representation 100 is typically a time-domain representation. The audio encoder 100 provides, on the basis thereof, an encoded representation of the audio content. For example, the audio encoder 100 provides a bitstream 112, which is an encoded audio representation.

The audio encoder 100 comprises a time-domain-to-frequency-domain converter 120, which is configured to receive the input representation 110 of the audio content, or a pre-processed version 110' thereof. The time-domain-to-frequency-domain converter 120 provides, on the basis of the input representation 110, 110', a frequency-domain representation 122 of the audio content. The frequency-domain representation 122 may take the form of a sequence of sets of spectral coefficients. For example, the time-domain-to-frequency-domain converter may be a window-based time-domain-to-frequency-domain converter, which provides a first set of spectral coefficients on the basis of time-domain samples of a first frame of the input audio content, and to provide a second set of spectral coefficients on the basis of time-domain samples of a second frame of the input audio content. The first frame of the input audio content may overlap, for example, by approximately 50%, with the second frame of the input audio content. A time-domain windowing may be applied to derive the first set of spectral coefficients from the first audio frame, and a windowing can also be applied to derive the second set of spectral coefficients from the second audio frame. Thus, the time-domain-to-frequency-domain converter may be configured to perform lapped transforms of windowed portions (for example, overlapping frames) of the input audio information.

The audio encoder 100 also comprises a spectrum processor 130, which is configured to receive the frequency-domain representation 122 of the audio content (or, optionally, a spectrally post-processed version 122' thereof), and to provide, on the basis thereof, a sequence of spectrally-shaped sets 132 of spectral coefficients. The spectrum processor 130 may be configured to apply a spectral shaping to a set 122 of spectral coefficients, or a pre-processed version 122' thereof, in dependence on a set of linear-prediction-domain parameters 134 for a portion (for example, a frame) of the audio content to be encoded in the linear-prediction mode, to obtain a spectrally-shaped set 132 of spectral coefficients. The spectrum processor 130 may also be configured to apply a spectral shaping to a set 122 of spectral coefficients, or to a pre-processed version 122' thereof, in dependence on a set of scale factor parameters 136 for a portion (for example, a frame) of the audio content to be encoded in a frequency-domain mode, to obtain a spectrally-shaped set 132 of spectral coefficients for said portion of the audio content to be encoded in the frequency domain mode. The spectrum processor 130 may, for example, comprise a parameter provider 138, which is configured to provide the set of linear-prediction-domain parameters 134 and the set of scale factor parameters 136. For example, the parameter provider 138 may provide the set of linear-prediction-domain parameters 134 using a linear-prediction-domain analyzer, and to provide the set of scale factor parameters 136 using a psycho-acoustic model processor. However, other possibilities to provide the linear-prediction-domain parameters 134 or the set of scale factor parameters 136 may also be applied.

The audio encoder 100 also comprises a quantizing encoder 140, which is configured to receive a spectrally-shaped set 132 of spectral coefficients (as provided by the spectrum processor 130) for each portion (for example, for each frame) of the audio content. Alternatively, the quantizing encoder 140 may receive a post-processed version 132' of a spectrally-shaped set 132 of spectral coefficients. The quantizing encoder 140 is configured to provide an encoded version 142 of a spectrally-shaped set of spectral coefficients 132 (or, optionally, of a pre-processed version thereof). The quantizing encoder 140 may, for example, be configured to provide an encoded version 142 of a spectrally-shaped set 132 of spectral coefficients for a portion of the audio content to be encoded in the linear-prediction mode, and to also provide an encoded version 142 of a spectrally-shaped set 132 of spectral coefficients for a portion of the audio content to be encoded in the frequency-domain mode. In other words, the same quantizing encoder 140 may be used for encoding spectrally-shaped sets of spectral coefficients irrespective of whether a portion of the audio content is to be encoded in the linear-prediction mode or the frequency-domain mode.

In addition, the audio encoder 100 may optionally comprise a bitstream payload formatter 150, which is configured to provide the bitstream 112 on the basis of the encoded versions 142 of the spectrally-shaped sets of spectral coefficients. However, the bitstream payload formatter 150 may naturally include additional encoded information in the bitstream 112, as well as configuration information control information, etc. For example, an optional encoder 160 may receive the encoded set 134 of linear-prediction-domain parameters and/or the set 136 of scale factor parameters and provide an encoded version thereof to the bitstream payload formatter 150. Accordingly, an encoded version of the set 134 of linear-prediction-domain parameters may be included into the bitstream 112 for a portion of the audio content to be encoded in the linear-prediction mode and an encoded version of the set 136 of scale factor parameters may be included into the bitstream 112 for a portion of the audio content to be encoded in the frequency-domain.

The audio encoder 100 further comprises, optionally, a mode controller 170, which is configured to decide whether a portion of the audio content (for example, a frame of the audio content) is to be encoded in the linear-prediction mode or in the frequency-domain mode. For this purpose, the mode controller 170 may receive the input representation 110 of the audio content, the pre-processed version 110' thereof or the frequency-domain representation 122 thereof. The mode controller 170 may, for example, use a speech detection algorithm to determine speech-like portions of the audio content and provide a mode control signal 172 which indicates to encode the portion of the audio content in the linear-prediction mode in response to detecting a speech-like portion. In contrast, if the mode controller finds that a given portion of the audio content is not speech-like, the mode controller 170 provides the mode control signal 172 such that the mode control signal 172 indicates to encode said portion of the audio content in the frequency-domain mode.

In the following, the overall functionality of the audio encoder 100 will be discussed in detail. The multi-mode audio signal encoder 100 is configured to efficiently encode both portions of the audio content which are speech-like and portions of the audio content which are not speech-like. For this purpose, the audio encoder 100 comprises at least two modes, namely the linear-prediction mode and the frequency-domain mode. However, the time-domain-to-frequency-domain converter 120 of the audio encoder 110 is configured to transform the same time-domain representation of the audio content (for example, the input representation 110, or the pre-processed version 110' thereof) into the frequency-domain both for the linear-prediction mode and the frequency-domain mode. A frequency resolution of the frequency-domain representation 122 may, however, be different for the different modes of operation. The frequency-domain representation 122 is not quantized and encoded immediately, but rather spectrally-shaped before the quantization and the encoding. The spectral-shaping is performed in such a manner that an effect of the quantization noise introduced by the quantizing encoder 140 is kept sufficiently small, in order to avoid excessive distortions. In the linear-prediction mode, the spectral shaping is performed in dependence on a set 134 of linear-prediction-domain parameters, which are derived from the audio content. In this case, the spectral shaping may, for example, be performed such that spectral coefficients are emphasized (weighted higher) if a corresponding spectral coefficient of a frequency-domain representation of the linear-prediction-domain parameters comprises a comparatively larger value. In other words, spectral coefficients of the frequency-domain representation 122 are weighted in accordance with corresponding spectral coefficients of a spectral domain representation of the linear-prediction-domain parameters. Accordingly, spectral coefficients of the frequency-domain representation 122, for which the corresponding spectral coefficient of the spectral domain representation of the linear-prediction-domain parameters take comparatively larger values, are quantized with comparatively higher resolution due to the higher weighting in the spectrally-shaped set 132 of spectral coefficients. In other words, there are portions of the audio content for which a spectral shaping in accordance with the linear-prediction-domain parameters 134 (for example, in accordance with a spectral-domain representation of the linear-prediction-domain parameters 134) brings along a good noise shaping, because spectral coefficients of the frequency-domain representation 132, which are more sensitive with respect to quantization noise, are weighted higher in the spectral shaping, such that the effective quantization noise introduced by the quantizing encoder 140 is actually reduced.

In contrast, portions of the audio content, which are encoded in the frequency-domain mode, experience a different spectral shaping. In this case, scale factor parameters 136 are determined, for example, using a psycho-acoustic model processor. The psycho-acoustic model processor evaluates a spectral masking and/or temporal masking of spectral components of the frequency-domain representation 122. This evaluation of the spectral masking and temporal masking is used to decide which spectral components (for example, spectral coefficients) of the frequency-domain representation 122 should be encoded with high effective quantization accuracy and which spectral components (for example, spectral coefficients) of the frequency-domain representation 122 may be encoded with comparatively low effective quantization accuracy. In other words, the psycho-acoustic model processor may, for example, determine the psycho-acoustic relevance of different spectral components and indicate that psycho-acoustically less-important spectral components should be quantized with low or even very low quantization accuracy. Accordingly, the spectral shaping (which is performed by the spectrum processor 130), may weight the spectral components (for example, spectral coefficients) of the frequency-domain representation 122 (or of the post-processed version 122' thereof), in accordance with the scale factor parameters 136 provided by the psycho-acoustic model processor. Psycho-acoustically important spectral components are given a high weighting in the spectral shaping, such that they are effectively quantized with high quantization accuracy by the quantizing encoder 140. Thus, the scale factors may describe a psychoacoustic relevance of different frequencies or frequency bands.

To conclude, the audio encoder 100 is switchable between at least two different modes, namely a linear-prediction mode and a frequency-domain mode. Overlapping portions of the audio content can be encoded in different of the modes. For this purpose, frequency-domain representations of different (but advantageously overlapping) portions of the same audio signal are used when encoding subsequent (for example immediately subsequent) portions of the audio content in different modes. Spectral domain components of the frequency-domain representation 122 are spectrally shaped in dependence on a set of linear-prediction-domain parameters for a portion of the audio content to be encoded in the frequency-domain mode, and in dependence on scale factor parameters for a portion of the audio content to be encoded in the frequency-domain mode. The different concepts, which are used to determine an appropriate spectral shaping, which is performed between the time-domain-to-frequency-domain conversion and the quantization/encoding, allows to have a good encoding efficiency and low distortion noise shaping for different types of audio contents (speech-like and non-speech-like).

2. Audio Encoder According to FIG. 3

In the following, an audio encoder 300 according to another embodiment of the invention will be described taking reference to FIG. 3. FIG. 3 shows a block schematic diagram of such an audio encoder 300. It should be noted that the audio encoder 300 is an improved version of the reference audio encoder 200, a block schematic diagram of which is shown in FIG. 2.

Figure 2:
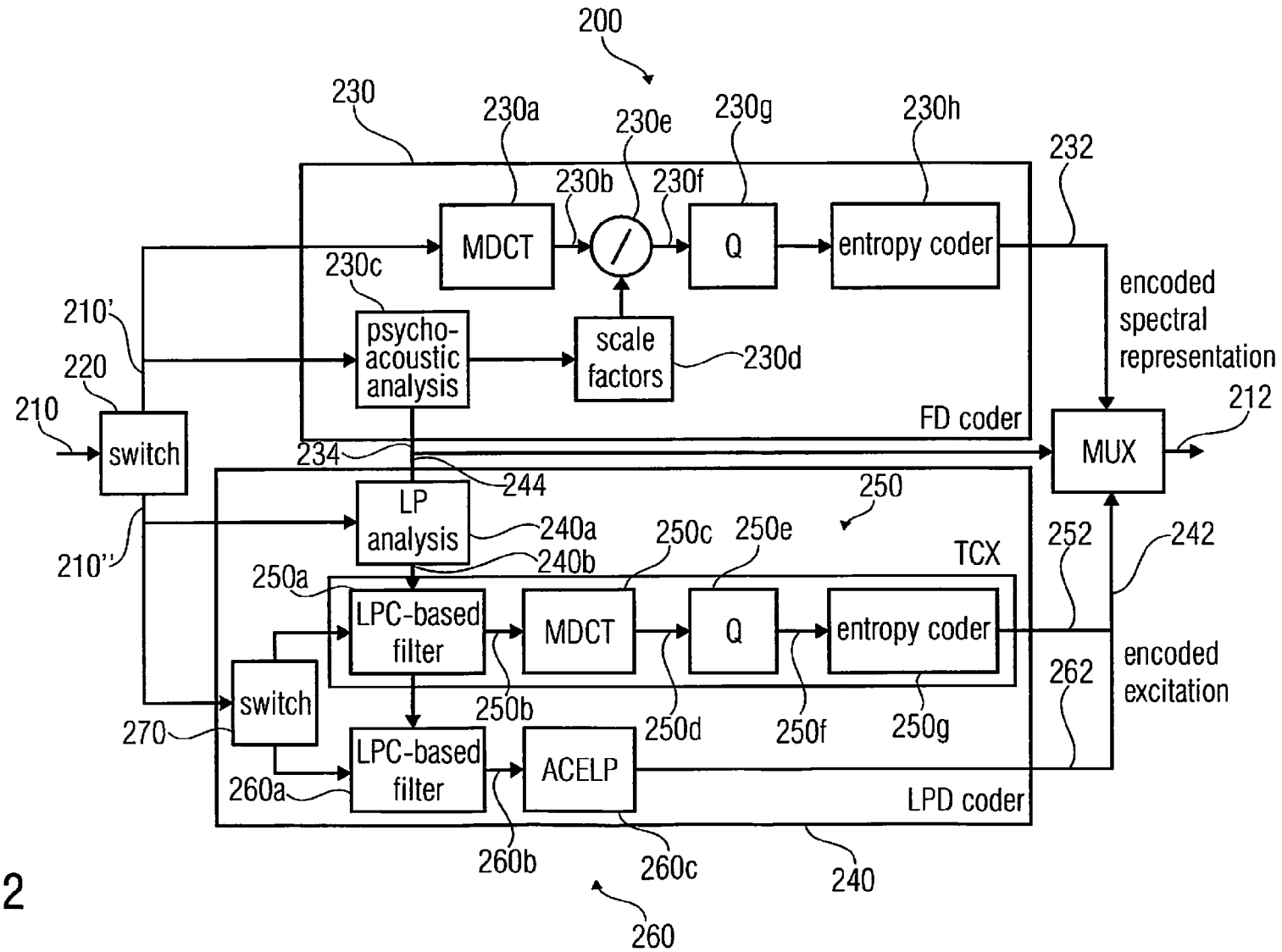
FIG. 2 shows a block schematic diagram of a reference audio signal encoder.
Figure 3:
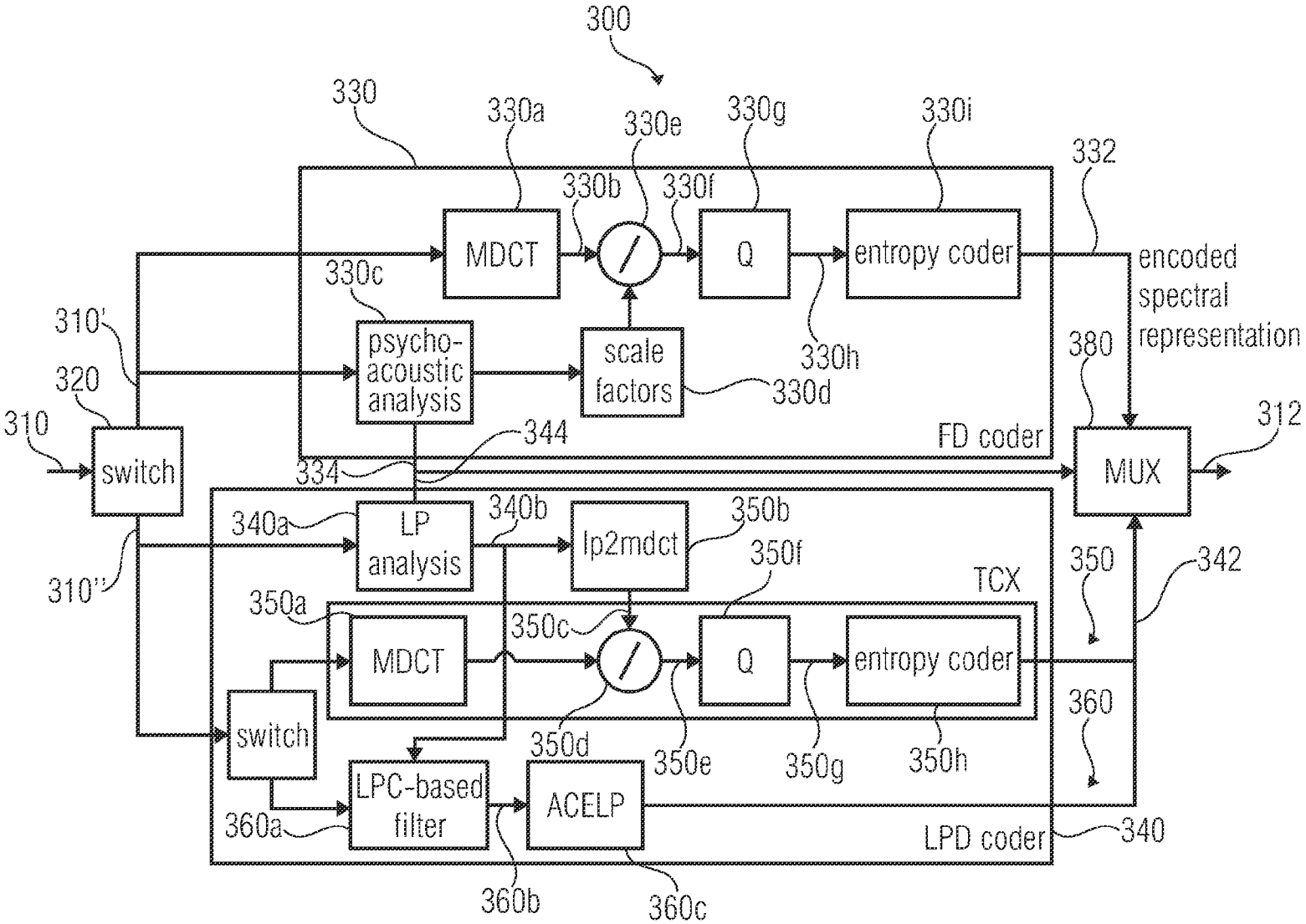
FIG. 3 shows a block schematic diagram of an audio signal encoder, according to an embodiment of the invention.

2.1 Reference Audio Signal Encoder, According to FIG. 2

In other words, to facilitate the understanding of the audio encoder 300 according to FIG. 3, the reference unified-speech-and-audio-coding encoder (USAC encoder) 200 will first be described taking reference to the block function diagram of the USAC encoder, which is shown in FIG. 2. The reference audio encoder 200 is configured to receive an input representation 210 of an audio content, which is typically a time-domain representation, and to provide, on the basis thereof, an encoded representation 212 of the audio content. The audio encoder 200 comprises, for example, a switch or distributor 220, which is configured to provide the input representation 210 of the audio content to a frequency-domain encoder 230 and/or a linear-prediction-domain encoder 240. The frequency-domain encoder 230 is configured to receive the input representation 210' of the audio content and to provide, on the basis thereof, an encoded spectral representation 232 and an encoded scale factor information 234. The linear-prediction-domain encoder 240 is configured to receive the input representation 210" and to provide, on the basis thereof, an encoded excitation 242 and an encoded LPC-filter coefficient information 244. The frequency-domain encoder 230 comprises, for example, a modified-discrete-cosine-transform time-domain-to-frequency-domain converter 230*a*, which provides a spectral representation 230*b* of the audio content. The frequency-domain encoder 230 also comprises a psycho-acoustic analysis 230*c*, which is configured to analyze spectral masking and temporal-masking of the audio content and to provide scale factors 230*d* and the encoded scale factor information 234. The frequency-domain encoder 230 also comprises a scaler 230*e*, which is configured to scale the spectral values provided by the time-domain-to-frequency-domain converter 230*a* in accordance with the scale factors 230*d*, thereby obtaining a scaled spectral representation 230*f* of the audio content. The frequency-domain encoder 230 also comprises a quantizer 230*g* configured to quantize the scaled spectral representation 230*f* of the audio content and an entropy coder 230*h*, configured to entropy-code the quantized scaled spectral representation of the audio content provided by the quantizer 230*g*. The entropy-coder 230*h* consequently provides the encoded spectral representation 232.

The linear-prediction-domain encoder 240 is configured to provide an encoded excitation 242 and an encoded LPC-filter coefficient information 244 on the basis of the input audio representation 210". The LPD coder 240 comprises a linear-prediction analysis 240*a*, which is configured to provide LPC-filter coefficients 240*b* and the encoded LPC-filter coefficient information 244 on the basis of the input representation 210" of the audio content. The LPD coder 240 also comprises an excitation encoding, which comprises two parallel branches, namely a TCX branch 250 and an ACELP branch 260. The branches are switchable (for example, using a switch 270), to either provide a transform-coded-excitation 252 or an algebraic-encoded-excitation 262. The TCX branch 250 comprises an LPC-based filter 250*a*, which is configured to receive both the input representation 210" of the audio content and the LPC-filter coefficients 240*b* provided by the LP analysis 240*a*. The LPC-based filter 250*a* provides a filter output signal 250*b*, which may describe a stimulus needed by an LPC-based filter in order to provide an output signal which is sufficiently similar to the input representation 210" of the audio content. The TCX branch also comprises a modified-discrete-cosine-transform (MDCT) 250*c* configured to receive the stimulus signal 250*b* and to provide, on the basis thereof, a frequency-domain representation 250*d* of the stimulus signal 250*b*. The TCX branch also comprises a quantizer 250*e* configured to receive the frequency-domain representation 250*b* and to provide a quantized version 250*f* thereof. The TCX branch also comprises an entropy-coder 250*g* configured to receive the quantized version 250*f* of the frequency-domain representation 250*d* of the stimulus signal 250*b* and to provide, on the basis thereof, the transform-coded excitation signal 252.

The ACELP branch 260 comprises an LPC-based filter 260*a* which is configured to receive the LPC filter coefficients 240*b* provided by the LP analysis 240*a* and to also receive the input representation 210" of the audio content. The LPC-based filter 260*a* is configured to provide, on the basis thereof, a stimulus signal 260*b*, which describes, for example, a stimulus needed by a decoder-sided LPC-based filter in order to provide a reconstructed signal which is sufficiently similar to the input representation 210" of the audio content. The ACELP branch 260 also comprises an ACELP encoder 260*c* configured to encode the stimulus signal 260*b* using an appropriate algebraic coding algorithm.

To summarize the above, in a switching audio codec, like, for example, an audio codec according to the MPEG-D unified speech and audio coding working draft (USAC), which is described in reference [1], adjacent segments of an input signal can be processed by different coders. For example, the audio codec according to the unified speech and audio coding working draft (USAC WD) can switch between a frequency-domain coder based on the so-called advanced audio coding (AAC), which is described, for example, in reference [2], and linear-prediction-domain (LPD) coders, namely TCX and ACELP, based on the so-called AMR-WB+concept, which is described, for example, in reference [3]. The USAC encoder is schematized in FIG. 2.

It has been found that the design of transitions between the different coders is an important or even essential issue for being able to switch seamlessly between the different coders. It has also been found that it is usually difficult to achieve such transitions due to the different nature of the coding techniques gathering in the switched structure. However, it has been found that common tools shared by the different coders may ease the transitions. Taking reference now to the reference audio encoder 200 according to FIG. 2, it can be seen that in USAC, the frequency-domain coder 230 computes a modified discrete cosine transform (MDCT) in the signal-domain while the transform-coded excitation branch (TCX) computes a modified-discrete-cosine-transform (MDCT 250*c*) in the LPC residual domain (using the LPC residual 250*b*). Also, both coders (namely, the frequency-domain coder 230 and the TCX branch 250) share the same kind of filter bank, being applied in a different domain. Thus, the reference audio encoder 200 (which may be a USAC audio encoder) can't exploit fully the great properties of the MDCT, especially the time-domain-aliasing cancellation (TDAC) when going from one coder (for example, frequency-domain coder 230) to another coder (for example, TCX coder 250).

Taking reference again to the reference audio encoder 200 according to FIG. 2, it can also be seen that the TCX branch 250 and the ACELP branch 260 share a linear predictive coding (LPC) tool. It is a key feature for ACELP, which is a source model coder, where the LPC is used for modeling the vocal tract of the speech. For TCX, LPC is used for shaping the quantization noise introduced on the MDCT coefficients 250*d*. It is done by filtering (for example, using the LPC-based filter 250*a*) in the time-domain the input signal 210" before performing the MDCT 250*c*. Moreover, the LPC is used within TCX during the transitions to ACELP by getting an excitation signal fed into the adaptive codebook of ACELP. It permits additionally to obtain interpolated LPC sets of coefficients for the next ACELP frame.

2.2 Audio Signal Encoder According to FIG. 3

In the following, the audio signal encoder 300 according to FIG. 3 will be described. For this purpose, reference will be made to the reference audio signal encoder 200 according to FIG. 2, as the audio signal encoder 300 according to FIG. 3 has some similarities with the audio signal encoder 200 according to FIG. 2.

The audio signal encoder 300 is configured to receive an input representation 310 of an audio content, and to provide, on the basis thereof, an encoded representation 312 of the audio content. The audio signal encoder 300 is configured to be switchable between a frequency-domain mode, in which an encoded representation of a portion of the audio content is provided by a frequency domain coder 330, and a linear-prediction mode in which an encoded representation of a portion of the audio content is provided by the linear prediction-domain coder 340. The portions of the audio content encoded in different of the modes may be overlapping in some embodiments, and may be non-overlapping in other embodiments.

The frequency-domain coder 330 receives the input representation 310' of the audio content for a portion of the audio content to be encoded in the frequency-domain mode and provides, on the basis thereof, an encoded spectral representation 332. The linear-prediction domain coder 340 receives the input representation 310" of the audio content for a portion of the audio content to be encoded in the linear-prediction mode and provides, on the basis thereof, an encoded excitation 342. The switch 320 may be used, optionally, to provide the input representation 310 to the frequency-domain coder 330 and/or to the linear-prediction-domain coder 340.

The frequency-domain coder also provides an encoded scale factor information 334. The linear-prediction-domain coder 340 provides an encoded LPC-filter coefficient information 344.

The output-sided multiplexer 380 is configured to provide, as the encoded representation 312 of the audio content, the encoded spectral representation 332 and the encoded scale factor information 334 for a portion of the audio content to be encoded in the frequency-domain and to provide, as the encoded representation 312 of the audio content, the encoded excitation 342 and the encoded LPC filter coefficient information 344 for a portion of the audio content to be encoded in the linear-prediction mode.

The frequency-domain encoder 330 comprises a modified-discrete-cosine-transform 330*a*, which receives the time-domain representation 310' of the audio content and transforms the time-domain representation 310' of the audio content, to obtain a MDCT-transformed frequency-domain representation 330*b* of the audio content. The frequency-domain coder 330 also comprises a psycho-acoustic analysis 330*c*, which is configured to receive the time-domain representation 310' of the audio content and to provide, on the basis thereof, scale factors 330*d* and the encoded scale factor information 334. The frequency-domain coder 330 also comprises a combiner 330*e* configured to apply the scale factors 330*e* to the MDCT-transformed frequency-domain representation 330*b* of the audio content, in order to scale the different spectral coefficients of the MDCT-transformed frequency-domain representation 330*b* of the audio content with different scale factor values. Accordingly, a spectrally-shaped version 330*f* of the MDCT-transformed frequency-domain representation 330*b* of the audio content is obtained, wherein the spectral-shaping is performed in dependence on the scale factors 330*d*, wherein spectral regions, to which comparatively large scale factors 330*d* are associated, are emphasized over spectral regions to which comparatively smaller scale factors 330*d* are associated. The frequency-domain coder 330 also comprises a quantizer configured to receive the scaled (spectrally-shaped) version 330*f* of the MDCT-transformed frequency-domain representation 330*b* of the audio content, and to provide a quantized version 330*h* thereof. The frequency-domain coder 330 also comprises an entropy coder 330*i* configured to receive the quantized version 330*h* and to provide, on the basis thereof, the encoded spectral representation 332. The quantizer 330*g* and the entropy coder 330*i* may be considered as a quantizing encoder.

The linear-prediction-domain coder 340 comprises a TCX branch 350 and a ACELP branch 360. In addition, the LPD coder 340 comprises an LP analysis 340*a*, which is commonly used by the TCX branch 350 and the ACELP branch 360. The LP analysis 340*a* provides LPC-filter coefficients 340*b* and the encoded LPC-filter coefficient information 344.

The TCX branch 350 comprises an MDCT transform 350*a*, which is configured to receive, as an MDCT transform input, the time-domain representation 310". Importantly to note, the MDCT 330*a* of the frequency-domain coder and the MDCT 350*a* of the TCX branch 350 receive (different) portions of the same time-domain representation of the audio content as transform input signals.

Accordingly, if subsequent and overlapping portions (for example, frames) of the audio content are encoded in different modes, the MDCT 330*a* of the frequency domain coder 330 and the MDCT 350*a* of the TCX branch 350 may receive time domain representations having a temporal overlap as transform input signals. In other words, the MDCT 330*a* of the frequency domain coder 330 and the MDCT 350*a* of the TCX branch 350 receive transform input signals which are "in the same domain", i.e. which are both time domain signals representing the audio content. This is in contrast to the audio encoder 200, wherein the MDCT 230*a* of the frequency domain coder 230 receives a time domain representation of the audio content while the MDCT 250*c* of the TCX branch 250 receives a residual time-domain representation of a signal or excitation signal 250*b*, but not a time domain representation of the audio content itself.

The TCX branch 350 further comprises a filter coefficient transformer 350*b*, which is configured to transform the LPC filter coefficients 340*b* into the spectral domain, to obtain gain values 350*c*. The filter coefficient transformer 350*b* is sometimes also designated as a "linear-prediction-to-MDCT-converter". The TCX branch 350 also comprises a combiner 350*d*, which receives the MDCT-transformed representation of the audio content and the gain values 350*c* and provides, on the basis thereof, a spectrally shaped version 350*e* of the MDCT-transformed representation of the audio content. For this purpose, the combiner 350*d* weights spectral coefficients of the MDCT-transformed representation of the audio content in dependence on the gain values 350*c* in order to obtain the spectrally shaped version 350*e*. The TCX branch 350 also comprises a quantizer 350*f* which is configured to receive the spectrally shaped version 350*e* of the MDCT-transformed representation of the audio content and to provide a quantized version 350*g* thereof. The TCX branch 350 also comprises an entropy encoder 350*h*, which is configured to provide an entropy-encoded (for example, arithmetically encoded) version of the quantized representation 350*g* as the encoded excitation 342.

The ACELP branch comprises an LPC based filter 360*a*, which receives the LPC filter coefficients 340*b* provided by the LP analysis 340*a* and the time domain representation 310" of the audio content. The LPC based filter 360*a* takes over the same functionality as the LPC based filter 260*a* and provides an excitation signal 360*b*, which is equivalent to the excitation signal 260*b*. The ACELP branch 360 also comprises an ACELP encoder 360*c*, which is equivalent to the ACELP encoder 260*c*. The ACELP encoder 360*c* provides an encoded excitation 342 for a portion of the audio content to be encoded using the ACELP mode (which is a sub-mode of the linear prediction mode).

Regarding the overall functionality of the audio encoder 300, it can be said that a portion of the audio content can either be encoded in the frequency domain mode, in the TCX mode (which is a first sub-mode of the linear prediction mode) or in the ACELP mode (which is a second sub-mode of the linear prediction mode). If a portion of the audio content is encoded in the frequency domain mode or in the TCX mode, the portion of the audio content is first transformed into the frequency domain using the MDCT 330*a* of the frequency domain coder or the MDCT 350*a* of the TCX branch. Both the MDCT 330*a* and the MDCT 350*a* operate on the time domain representation of the audio content, and even operate, at least partly, on identical portions of the audio content when there is a transition between the frequency domain mode and the TCX mode. In the frequency domain mode, the spectral shaping of the frequency domain representation provided by the MDCT transformer 330*a* is performed in dependence on the scale factor provided by the psychoacoustic analysis 330*c*, and in the TCX mode, the spectral shaping of the frequency domain representation provided by the MDCT 350*a* is performed in dependence on the LPC filter coefficients provided by the LP analysis 340*a*. The quantization 330*g* may be similar to, or even identical to the quantization 350*f*, and the entropy encoding 330*i* may be similar to, or even identical to, the entropy encoding 350*h*. Also, the MDCT transform 330*a* may be similar to, or even identical to, the MDCT transform 350*a*. However, different dimensions of the MDCT transform may be used in the frequency domain coders 330 and the TCX branch 350.

Moreover, it can be seen that the LPC filter coefficients 340*b* are used both by the TCX branch 350 and the ACELP branch 360. This facilitates transitions between portions of the audio content encoded in the TCX mode and portions of the audio content encoded in the ACELP mode.

To summarize the above, one embodiment of the present invention consists of performing, in the context of unified speech and audio coding (USAC), the MDCT 350*a* of the TCX in the time domain and applying the LPC-based filtering in the frequency domain (combiner 350*d*). The LPC analysis (for example, LP analysis 340*a*) is done as before (for example, as in the audio signal encoder 200), and the coefficients (for example, the coefficients 340*b*) are still transmitted as usual (for example, in the form of encoded LPC filter coefficients 344). However, the noise shaping is no more done by applying in the time domain a filter but by applying a weighting in the frequency domain (which is performed, for example, by the combiner 350*d*). The noise shaping in the frequency domain is achieved by converting the LPC coefficients (for example, the LPC filter coefficients 340*b*) into the MDCT domain (which may be performed by the filter coefficients transformer 350*b*). For details, reference is made to FIG. 3, which shows the concept of applying the LPC-based noise shaping of TCX in frequency domain.

2.3 Details Regarding the Computation and Application of the LPC Coefficients

In the following, the computation and application of the LPC coefficients will be described. First, a appropriate set of LPC coefficients are calculated for the present TCX window, for example, using the LPC analysis 340*a*. A TCX window may be a windowed portion of the time domain representation of the audio content, which is to be encoded in the TCX mode. The LPC analysis windows are located at the end bounds of LPC coder frames, as is shown in FIG. 4.

Figure 4:
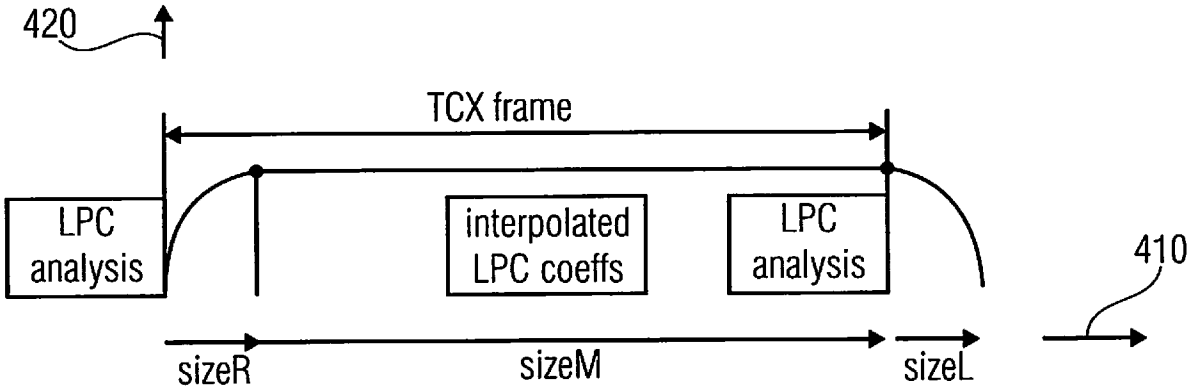
FIG. 4 shows an illustration of an LPC coefficients interpolation for a TCX window.

Taking reference to FIG. 4, a TCX frame, i.e. an audio frame to be encoded in the TCX mode, is shown. An abscissa 410 describes the time, and an ordinate 420 describes magnitude values of a window function.

An interpolation is done for computing the LPC set of coefficients 340*b* corresponding to the barycentre of the TCX window. The interpolation is performed in the immittance spectral frequency (ISF domain), where the LPC coefficients are usually quantized and coded. The interpolated coefficients are then centered in the middle of the TCX window of size sizeR+sizeM+sizeL.

For details, reference is made to FIG. 4, which shows an illustration of the LPC coefficients interpolation for a TCX window.

Figures 6, 7:
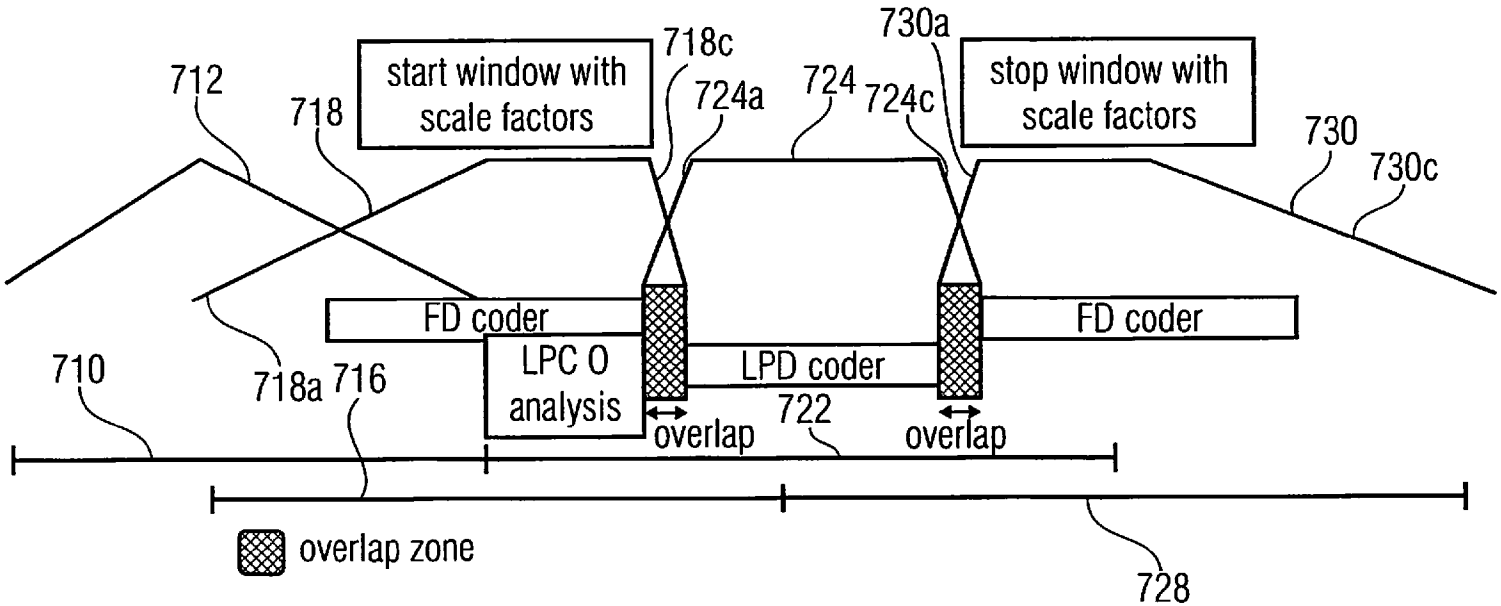
FIG. 6 shows a computer program code for combining a set of decoded spectral coefficients with the linear-prediction mode gain values (or linear-prediction-domain gain values)
FIG. 7 shows a schematic representation of different frames and associated information for a switched time domain/frequency domain (TD/FD) codec sending a so-called "LPC" as overhead.

The interpolated LPC coefficients are then weighted as is done in TCX (for details, see reference [3]), for getting an appropriate noise shaping inline with psychoacoustic consideration. The obtained interpolated and weighted LPC coefficients (also briefly designated with lpc_coeffs) are finally converted to MDCT scale factors (also designated as linear prediction mode gain values) using a method, a pseudo code of which is shown in FIGS. 5 and 6.

FIG. 5 shows a pseudo program code of a function "LPC2MDCT" for providing MDCT scale factors ("mdct_scaleFactors") on the basis of input LPC coefficients ("lpc_coeffs"). As can be seen, the function "LPC2MDCT" receives, as input variables, the LPC coefficients "lpc_coeffs", an LPC order value "lpc_order" and window size values "sizeR", "sizeM", "sizeL". In a first step, entries of an array "InRealData[i]" is filled with a modulated version of the LPC coefficients, as shown at reference numeral 510. As can be seen, entries of the array "InRealData" and entries of the array "InImagData" having indices between 0 and lpc_order−1 are set to values determined by the corresponding LPC coefficient "lpcCoeffs[i]", modulated by a cosine term or a sine term. Entries of the array "InRealData" and "InImagData" having indices i≥lpc_order are set to 0.

Accordingly, the arrays "InRealData[i]" and "InImagData [i]" describe a real part and an imaginary part of a time domain response described by the LPC coefficients, modulated with a complex modulation term $(\cos(i\cdot\pi/\text{sizeN})-j\cdot\sin(i\cdot\pi/\text{sizeN}))$.

Subsequently, a complex fast Fourier transform is applied, wherein the arrays "InRealData[i]" and "InImagData[i]" describe the input signal of the complex fast Fourier transform. A result of the complex fast Fourier transform is provided by the arrays "OutRealData" and "OutImagData". Thus, the arrays "OutRealData" and "OutImagData" describe spectral coefficients (having frequency indices i) representing the LPC filter response described by the time domain filter coefficients.

Subsequently, so-called MDCT scale factors are computed, which have frequency indices i, and which are designated with "mdct_scaleFactors[i]". An MDCT scale factor "mdct_scaleFactors[i]" is computed as the inverse of the absolute value of the corresponding spectral coefficient (described by the entries "OutRealData[i]" and "OutImagData [i]").

It should be noted that the complex-valued modulation operation shown at reference numeral 510 and the execution of a complex fast Fourier transform shown at reference numeral 520 effectively constitute an odd discrete Fourier transform (ODFT). The odd discrete Fourier transform has the following formula:

$$X_0(k) = \sum_{n=0}^{n=N} x(n)e^{-j\frac{2\pi}{N}(k+\frac{1}{2})n},$$

where N=sizeN, which is two times the size of the MDCT.

In the above formula, LPC coefficients lpc_coeffs[n] take the role of the transform input function x(n). The output function $X_0(k)$ is represented by the values "OutRealData[k]" (real part) and "OutImagData[k]" (imaginary part).

The function "complex_fft( )" is a fast implementation of a conventional complex discrete Fourier transform (DFT). The obtained MDCT scale factors ("mdct_scaleFactors") are positive values which are then used to scale the MDCT coefficients (provided by the MDCT 350*a*) of the input signal. The scaling will be performed in accordance with the pseudo-code shown in FIG. 6.

2.4 Details Regarding the Windowing and the Overlapping

Figure 8:
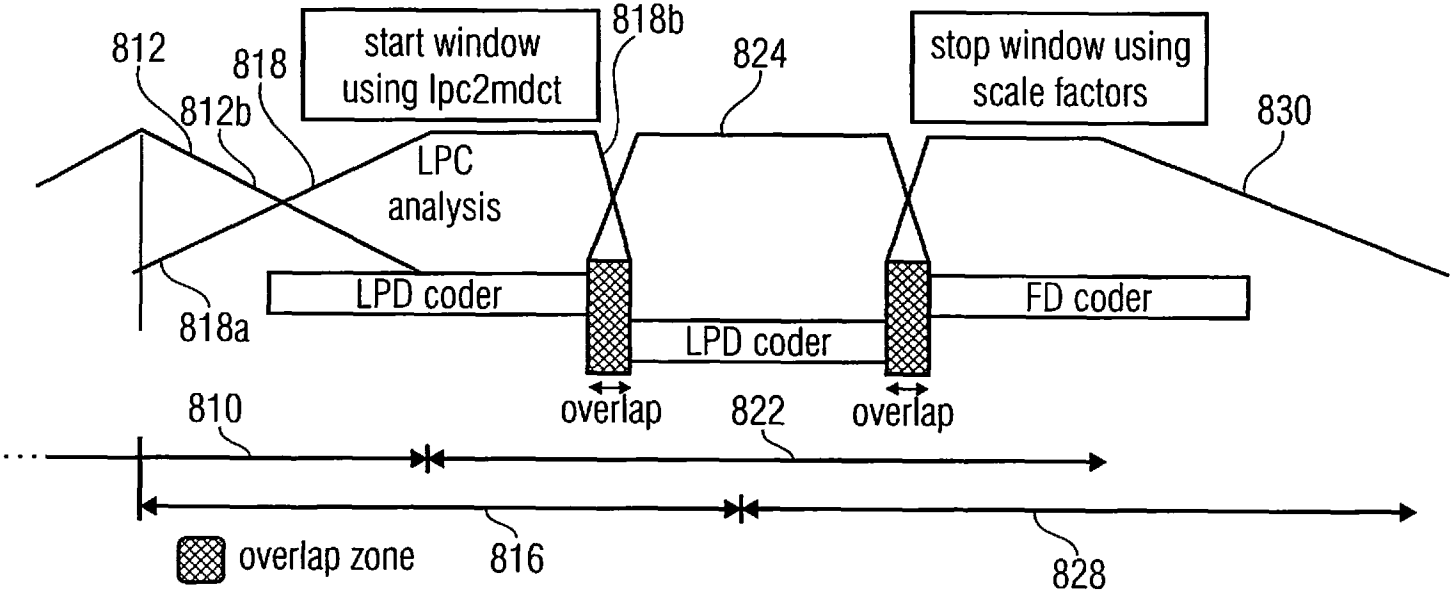
FIG. 8 shows a schematic representation of frames and associated parameters for a switch from frequency domain to linear-prediction-domain coder using "LPC2MDCT" for transitions.

The windowing and the overlapping between subsequent frames are described in FIGS. 7 and 8.

FIG. 7 shows a windowing which is performed by a switched time-domain/frequency-domain codec sending the LPC0 as overhead. FIG. 8 shows a windowing which is performed when switching from a frequency domain coder to a time domain coder using "lpc2mdct" for transitions.

Taking reference now to FIG. 7, a first audio frame 710 is encoded in the frequency-domain mode and windowed using a window 712.

The second audio frame 716, which overlaps the first audio frame 710 by approximately 50%, and which is encoded in the frequency-domain mode, is windowed using a window 718, which is designated as a "start window". The start window has a long left-sided transition slope 718*a* and a short right-sided transition slope 718*c*.

A third audio frame 722, which is encoded in the linear prediction mode, is windowed using a linear prediction mode window 724, which comprises a short left-sided transition slope 724*a* matching the right-sided transition slope 718*c* and a short right-sided transition slope 724*c*. A fourth audio frame 728, which is encoded in the frequency domain mode, is windowed using a "stop window" 730 having a comparatively short left-sided transition slope 730*a* and a comparatively long right-sided transition slope 730*c*.

When transitioning from the frequency domain mode to the linear prediction mode, i.e. as a transition between the second audio frame 716 and the third audio frame 722, an extra set of LPC coefficients (also designated as "LPC0") is conventionally sent for securing a proper transition to the linear prediction domain coding mode.

However, an embodiment according the invention creates an audio encoder having a new type of start window for the transition between the frequency domain mode and the linear prediction mode. Taking reference now to FIG. 8, it can be seen that a first audio frame 810 is windowed using the so-called "long window" 812 and encoded in the frequency domain mode. The "long window" 812 comprises a comparatively long right-sided transition slope 812*b*. A second audio frame 816 is windowed using a linear prediction domain start window 818, which comprises a comparatively long left-sided transition slope 818*a*, which matches the right-sided transition slope 812*b* of the window 812. The linear prediction domain start window 818 also comprises a comparatively short right-sided transition slope 818*b*. The second audio frame 816 is encoded in the linear prediction mode. Accordingly, LPC filter coefficients are determined for the second audio frame 816, and the time domain samples of the second audio frame 816 are also transformed into the spectral representation using an MDCT. The LPC filter coefficients, which have been determined for the second audio frame 816, are then applied in the frequency domain and used to spectrally shape the spectral coefficients provided by the MDCT on the basis of the time domain representation of the audio content.

A third audio frame 822 is windowed using a window 824, which is identical to the window 724 described before. The third audio frame 822 is encoded in the linear prediction mode. A fourth audio frame 828 is windowed using a window 830, which is substantially identical to the window 730.

The concept described with reference to FIG. 8 brings the advantage that a transition between the audio frame 810, which is encoded in the frequency domain mode using a so-called "long window" and a third audio frame 822, which is encoded in the linear prediction mode using the window 824, is made via an intermediate (partly overlapping) second audio frame 816, which is encoded in the linear prediction mode using the window 818. As the second audio frame is typically encoded such that the spectral shaping is performed in the frequency domain (i.e. using the filter coefficient transformer 350*b*), a good overlap-and-add between the audio frame 810 encoded in the frequency domain mode using a window having a comparatively long right-sided transition slope 812*b* and the second audio frame 816 can be obtained. In addition, encoded LPC filter coefficients are transmitted for the second audio frame 816 instead of scale factor values. This distinguishes the transition of FIG. 8 from the transition of FIG. 7, where extra LPC coefficients (LPC0) are transmitted in addition to scale factor values. Consequently, the transition between the second audio frame 816 and the third audio frame 822 can be performed with good quality without transmitting additional extra data like, for example, the LPC0 coefficients transmitted in the case of FIG. 7. Thus, the information which is needed for initializing the linear predictive domain codec used in the third audio frame 822 is available without transmitting extra information.

To summarize, in the embodiment described with reference to FIG. 8, the linear prediction domain start window 818 can use an LPC-based noise shaping instead of the conventional scale factors (which are transmitted, for example, for the audio frame 716). The LPC analysis window 818 correspond to the start window 718, and no additional setup LPC coefficients (like, for example, the LPC0 coefficients) need to be sent, as described in FIG. 8. In this case, the adaptive codebook of ACELP (which may be used for encoding at least a portion of the third audio frame 822) can easily be fed with the computed LPC residual of the decoded linear prediction domain coder start window 818.

To summarize the above, FIG. 7 shows a function of a switched time domain/frequency domain codec which needs to send a extra set of LPC coefficient set called LP0 as overhead. FIG. 8 shows a switch from a frequency domain coder to a linear prediction domain coder using the so-called "LPC2MDCT" for transitions.

3. Audio Signal Encoder According to FIG. 9

Figure 9:
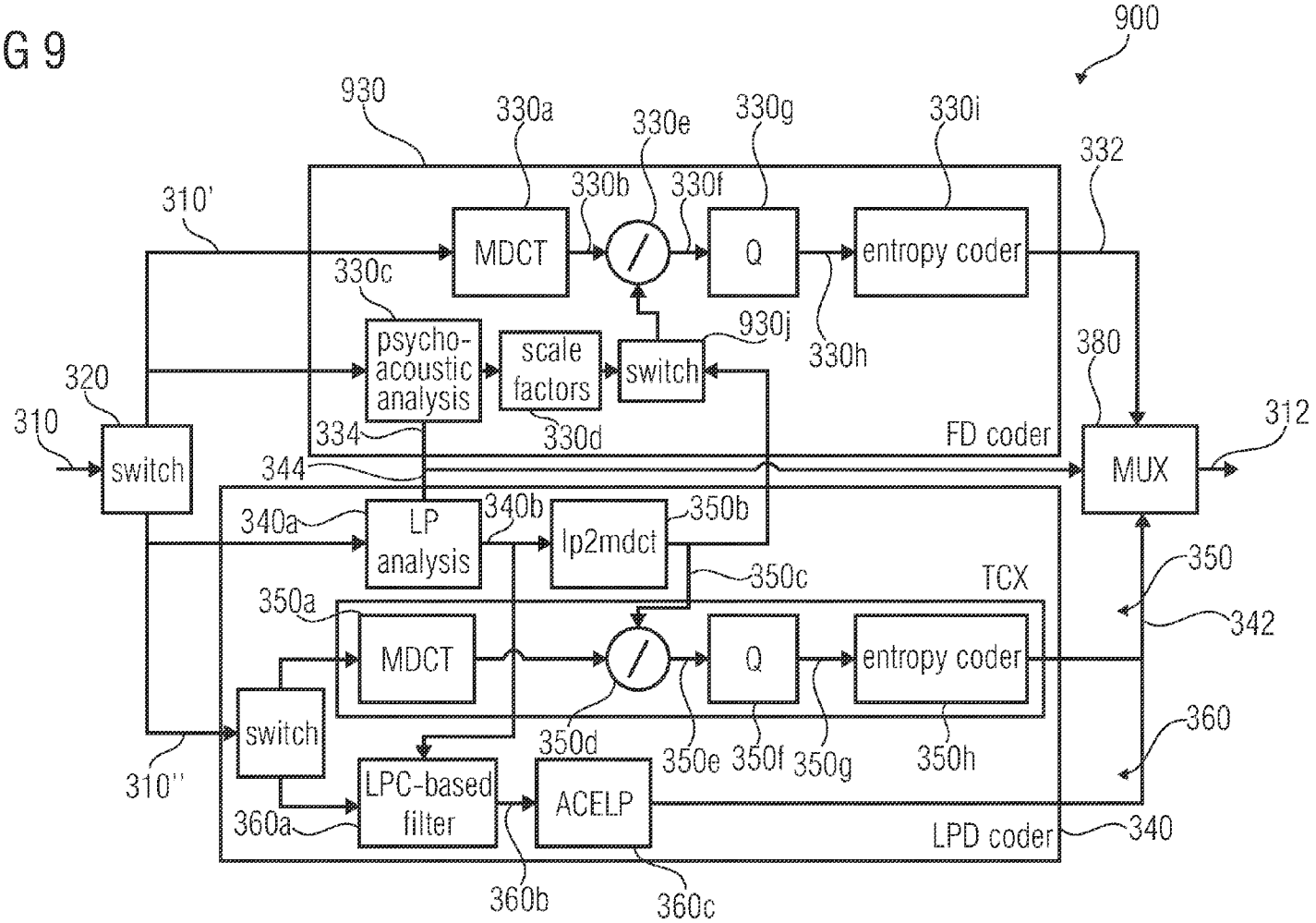
FIG. 9 shows a schematic representation of an audio signal encoder comprising a LPC-based noise shaping for TCX and a frequency domain coder.

In the following, an audio signal encoder 900 will be described taking reference to FIG. 9, which is adapted to implement the concept as described with reference to FIG. 8. The audio signal encoder 900 according to FIG. 9 is very similar to the audio signal 300 according to FIG. 3, such that identical means and signals are designated with identical reference numerals. A discussion of such identical means and signals will be omitted here, and reference is made to the discussion of the audio signal encoder 300.

However, the audio signal encoder 900 is extended in comparison to the audio signal encoder 300 in that the combiner 330*e* of the frequency domain coder 930 can selectively apply the scale factors 330*d* or linear prediction domain gain values 350*c* for the spectral shaping. For this purpose, a switch 930*j* is used, which allows to feed either the scale factors 330*d* or the linear prediction domain gain values 350*c* to the combiner 330*e* for the spectral shaping of the spectral coefficients 330*b*. Thus, the audio signal encoder 900 knows even three modes of operation, namely:

1. Frequency domain mode: the time domain representation of the audio content is transformed into the frequency domain using the MDCT 330*a* and a spectral shaping is applied to the frequency domain representation 330*b* of the audio content in dependence on the scale factors 330*d*. A quantized and encoded version 332 of the spectrally shaped frequency domain representation 330*f* and an encoded scale factor information 334 is included into the bitstream for an audio frame encoded using the frequency domain mode.
2. Linear prediction mode: in the linear prediction mode, LPC filter coefficients 340*b* are determined for a portion of the audio content and either a transform-coded-excitation (first sub-mode) or an ACELP-coded excitation is determined using said LPC filter coefficients 340*b*, depending on which of the coded excitation appears to be more bit rate efficient. The encoded excitation 342 and the encoded LPC filter coefficient information 344 is included into the bitstream for an audio frame encoded in the linear prediction mode.
3. Frequency domain mode with LPC filter coefficient based spectral shaping: alternatively, in a third possible mode, the audio content can be processed by the frequency domain coder 930. However, instead of the scale factors 330*d*, the linear prediction domain gain values 350*c* are applied for the spectral shaping in the combiner 330*e*. Accordingly, a quantized and entropy coded version 332 of the spectrally shaped frequency domain representation 330*f* of the audio content is included into the bitstream, wherein the spectrally shaped frequency domain representation 330*f* is spectrally shaped in accordance with the linear prediction domain gain values 350*c* provided by the linear prediction domain coder 340. In addition, an encoded LPC filter coefficient information 344 is included into the bitstream for such an audio frame.

By using the above-described third mode, it is possible to achieve the transition which has been described with reference to FIG. 8 for the second audio frame 816. It should be noted here that the encoding of an audio frame using the frequency domain encoder 930 with a spectral shaping in dependence on the linear prediction domain gain values is equivalent to the encoding of the audio frame 816 using a linear prediction domain coder if the dimension of the MDCT used by the frequency domain coder 930 corresponds to the dimension of the MDCT used by the TCX branch 350, and if the quantization 330*g* used by the frequency domain coder 930 corresponds to the quantization 350*f* used by the TCX branch 350 and if the entropy encoding 330*i* used by the frequency domain coder corresponds with the entropy coding 350*h* used in the TCX branch. In other words, the encoding of the audio frame 816 can either be done by adapting the TCX branch 350, such that the MDCT 350*a* takes over the characteristics of the MDCT 330*a*, and such that the quantization 350*f* takes over the characteristics of the quantization 330*g* and such that the entropy encoding 350*h* takes over the characteristics of the entropy encoding 330*i*, or by applying the linear predication domain gain values 350*c* in the frequency domain coder 930. Both solutions are equivalent and lead to the processing of the start window 816 as discussed with reference to FIG. 8.

4. Audio Signal Decoder According to FIG. 10

In the following, a unified view of the USAC (unified speech-and-audio coding) with TCX MDCT performed in the signal domain will be described taking reference to FIG. 10.

Figure 10:
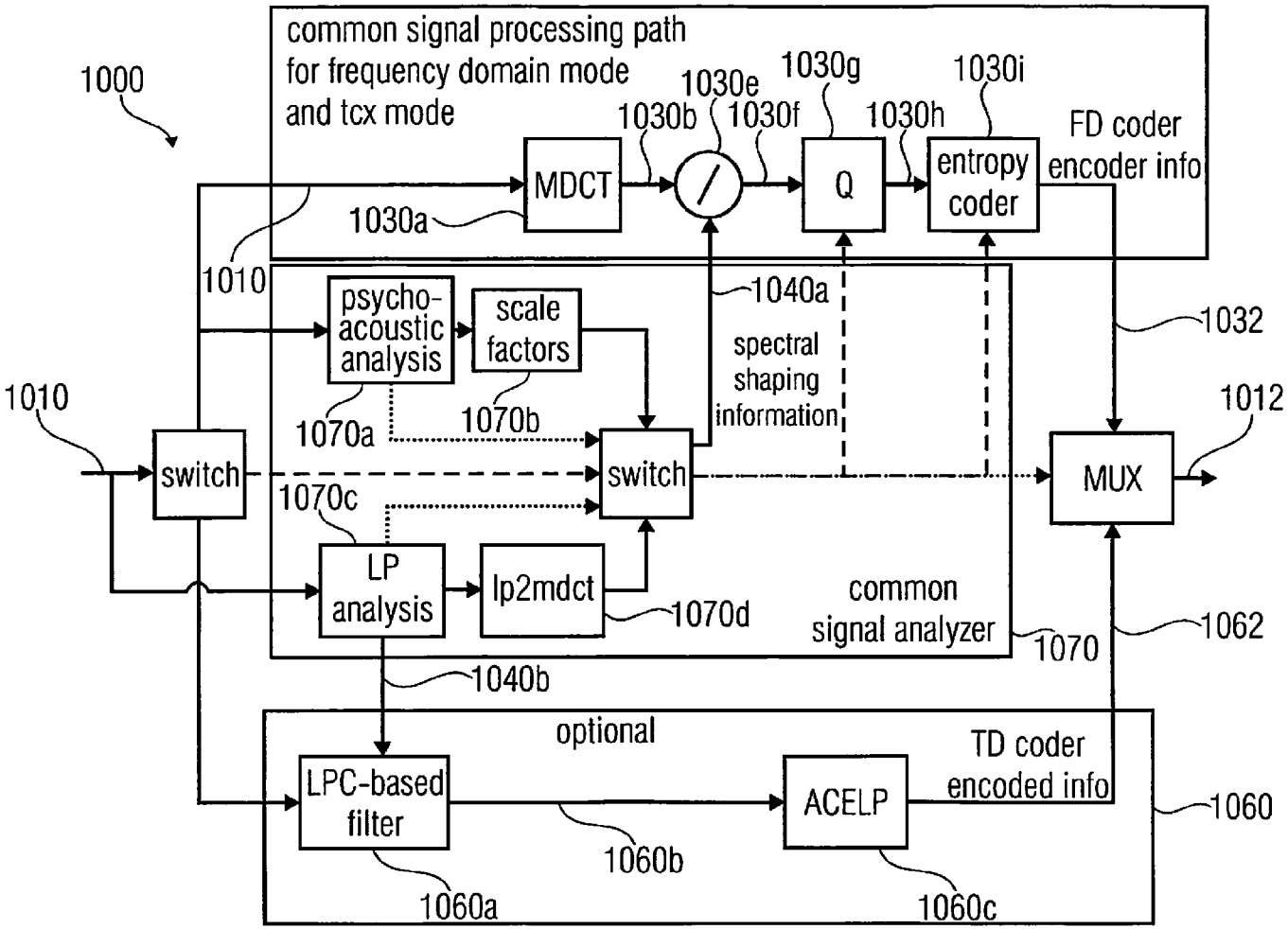
FIG. 10 shows a unified view of a unified speech-and-audio-coding (USAC) with TCX MDCT performed in the signal domain.

It should be noted here that in some embodiments according to the invention the TCX branch 350 and the frequency domain coder 330, 930 share almost all the same coding tools (MDCT 330*a*, 350*a*; combiner 330*e*, 350*d*; quantization 330*g*, 350*f*; entropy coder 330*i*, 350*h*) and can be considered as a single coder, as it is depicted in FIG. 10. Thus, embodiments according to the present invention allow for a more unified structure of the switched coder USAC, where only two kinds of codecs (frequency domain coder and time domain coder) can be delimited.

Taking reference now to FIG. 10, it can be seen that the audio signal encoder 1000 is configured to receive an input representation 1010 of the audio content and to provide, on the basis thereof, an encoded representation 1012 of the audio content. The input representation 1010 of the audio content, which is typically a time domain representation, is input to an MDCT 1030*a* if a portion of the audio content is to be encoded in the frequency domain mode or in a TCX sub-mode of the linear prediction mode. The MDCT 1030*a* provides a frequency domain representation 1030*b* of the time domain representation 1010. The frequency domain representation 1030*b* is input into a combiner 1030*e*, which combines the frequency domain representation 1030*b* with spectral shaping values 1040*a*, to obtain a spectrally shaped version 1030*f* of the frequency domain representation 1030*b*. The spectrally shaped representation 1030*f* is quantized using a quantizer 1030*g*, to obtain a quantized version 1030*h* thereof, and the quantized version 1030*h* is sent to an entropy coder (for example, arithmetic encoder) 1030*i*. The entropy coder 1030*i* provides a quantized and entropy coded representation of the spectrally shaped frequency domain representation 1030*f*, which quantized and encoded representation is designated with 1032. The MDCT 1030*a*, the combiner 1030*e*, the quantizer 1030*g* and the entropy encoder 1030*i* form a common signal processing path for the frequency domain mode and the TCX sub-mode of the linear prediction mode.

The audio signal encoder 1000 comprises an ACELP signal processing path 1060, which also receives the time domain representation 1010 of the audio content and which provides, on the basis thereof, an encoded excitation 1062 using an LPC filter coefficient information 1040*b*. The ACELP signal processing path 1060, which may be considered as being optional, comprises an LPC based filter 1060*a*, which receives the time domain representation 1010 of the audio content and provides a residual signal or excitation signal 1060*b* to the ACELP encoder 1060*c*. The ACELP encoder provides the encoded excitation 1062 on the basis of the excitation signal or residual signal 1060*b*.

The audio signal encoder 1000 also comprises a common signal analyzer 1070 which is configured to receive the time domain representation 1010 of the audio content and to provide, on the basis thereof, the spectral shaping information 1040*a* and the LPC filter coefficient filter information 1040*b*, as well as an encoded version of the side information needed for decoding a current audio frame. Thus, the common signal analyzer 1070 provides the spectral shaping information 1040*a* using a psychoacoustic analysis 1070*a* if the current audio frame is encoded in the frequency domain mode, and provides an encoded scale factor information if the current audio frame is encoded in the frequency domain mode. The scale factor information, which is used for the spectral shaping, is provided by the psychoacoustic analysis 1070*a*, and an encoded scale factor information describing the scale factors 1070*b* is included into the bitstream 1012 for an audio frame encoded in the frequency domain mode.

For an audio frame encoded in the TCX sub-mode of the linear prediction mode, the common signal analyzer 1070 derives the spectral shaping information 1040*a* using a linear prediction analysis 1070*c*. The linear prediction analysis 1070*c* results in a set of LPC filter coefficients, which are transformed into a spectral representation by the linear prediction-to-MDCT block 1070*d*. Accordingly, the spectral shaping information 1040*a* is derived from the LPC filter coefficients provided by the LP analysis 1070*c* as discussed above. Consequently, for an audio frame encoded in the transform-coded excitation sub-mode of the linear-prediction mode, the common signal analyzer 1070 provides the spectral shaping information 1040*a* on the basis of the linear-prediction analysis 1070*c* (rather than on the basis of the psychoacoustic analysis 1070*a*) and also provides an encoded LPC filter coefficient information rather than an encoded scale-factor information, for inclusion into the bitstream 1012.

Moreover, for an audio frame to be encoded in the ACELP sub-mode of the linear-prediction mode, the linear-prediction analysis 1070*c* of the common signal analyzer 1070 provides the LPC filter coefficient information 1040*b* to the LPC-based filter 1060*a* of the ACELP signal processing branch 1060. In this case, the common signal analyzer 1070 provides an encoded LPC filter coefficient information for inclusion into the bitstream 1012.

To summarize the above, the same signal processing path is used for the frequency-domain mode and for the TCX sub-mode of the linear-prediction mode. However, the windowing applied before or in combination with the MDCT and the dimension of the MDCT 1030*a* may vary in dependence on the encoding mode. Nevertheless, the frequency-domain mode and the TCX sub-mode of the linear-prediction mode differ in that an encoded scale-factor information is included into the bitstream in the frequency-domain mode while an encoded LPC filter coefficient information is included into the bitstream in the linear-prediction mode.

In the ACELP sub-mode of the linear-prediction mode, an ACELP-encoded excitation and an encoded LPC filter coefficient information is included into the bitstream.

5. Audio Signal Decoder According to FIG. 11

5.1. The Decoder Overview

In the following, an audio signal decoder will be described, which is capable of decoding the encoded representation of an audio content provided by the audio signal encoder described above.

Figure 11B:
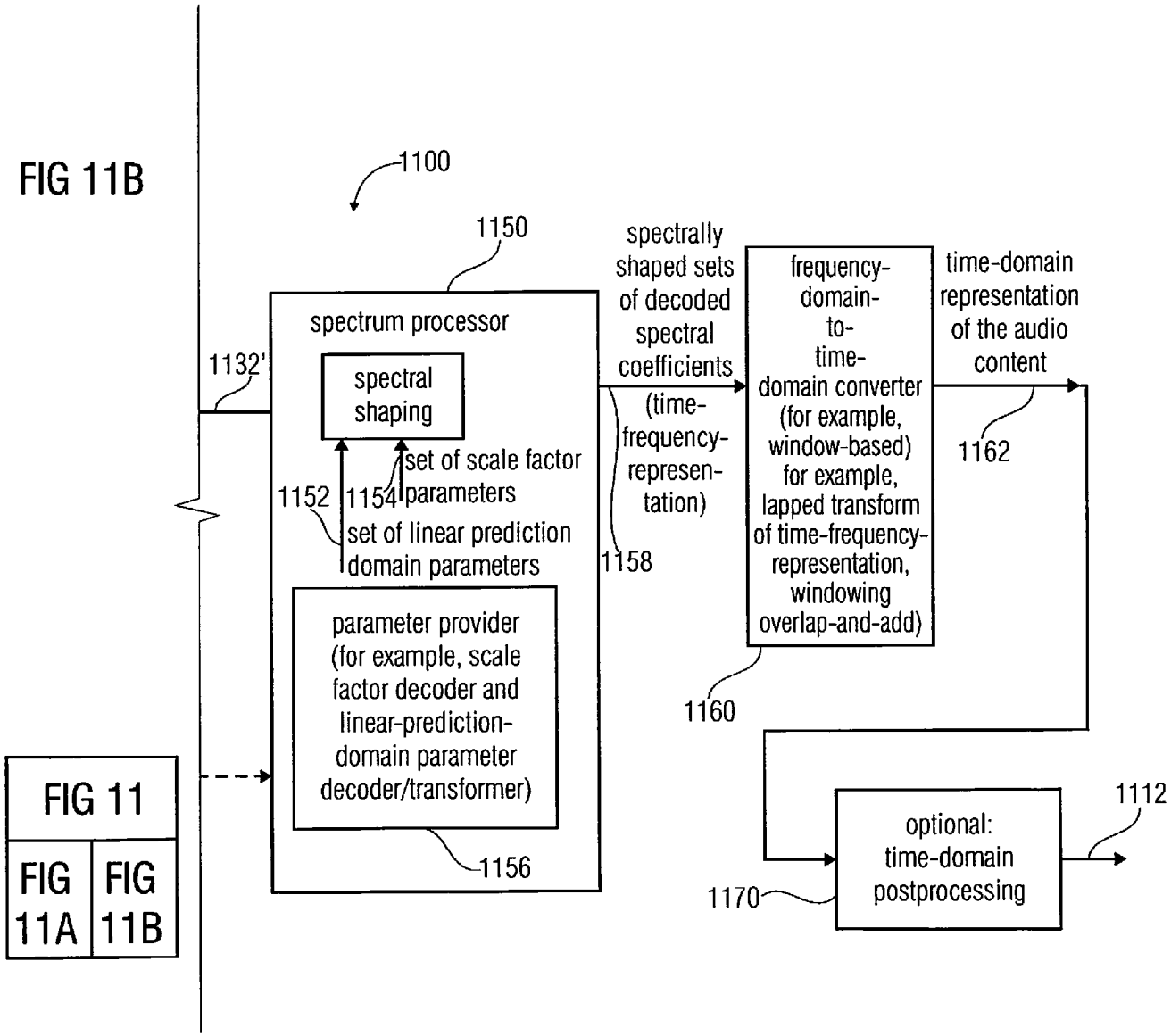
FIG. 11 shows a block schematic diagram of an audio signal decoder, according to an embodiment of the invention.

The audio signal decoder 1100 according to FIG. 11 is configured to receive the encoded representation 1110 of an audio content and provides, on the basis thereof, a decoded representation 1112 of the audio content. The audio signal decoder 1100 comprises an optional bitstream payload deformatter 1120 which is configured to receive a bitstream comprising the encoded representation 1110 of the audio content and to extract the encoded representation of the audio content from said bitstream, thereby obtaining an extracted encoded representation 1110' of the audio content. The optional bitstream payload deformatter 1120 may extract from the bitstream an encoded scale-factor information, an encoded LPC filter coefficient information and additional control information or signal enhancement side information.

The audio signal decoder 1100 also comprises a spectral value determinator 1130 which is configured to obtain a plurality of sets 1132 of decoded spectral coefficients for a plurality of portions (for example, overlapping or non-overlapping audio frames) of the audio content. The sets of decoded spectral coefficients may optionally be preprocessed using a preprocessor 1140, thereby yielding preprocessed sets 1132' of decoded spectral coefficients.

The audio signal decoder 1100 also comprises a spectrum processor 1150 configured to apply a spectral shaping to a set 1132 of decoded spectral coefficients, or to a preprocessed version 1132' thereof, in dependence on a set 1152 of linear-prediction-domain parameters for a portion of the audio content (for example, an audio frame) encoded in a linear-prediction mode, and to apply a spectral shaping to a set 1132 of decoded spectral coefficients, or to a preprocessed version 1132' thereof, in dependence on a set 1154 of scale-factor parameters for a portion of the audio content (for example, an audio frame) encoded in a frequency-domain mode. Accordingly, the spectrum processor 1150 obtains spectrally shaped sets 1158 of decoded spectral coefficients.

The audio signal decoder 1100 also comprises a frequency-domain-to-time-domain converter 1160, which is configured to receive a spectrally-shaped set 1158 of decoded spectral coefficients and to obtain a time-domain representation 1162 of the audio content on the basis of the spectrally-shaped set 1158 of decoded spectral coefficients for a portion of the audio content encoded in the linear-prediction mode. The frequency-domain-to-time-domain converter 1160 is also configured to obtain a time-domain representation 1162 of the audio content on the basis of a respective spectrally-shaped set 1158 of decoded spectral coefficients for a portion of the audio content encoded in the frequency-domain mode.

The audio signal decoder 1100 also comprises an optional time-domain processor 1170, which optionally performs a time-domain post processing of the time-domain representation 1162 of the audio content, to obtain the decoded representation 1112 of the audio content. However, in the absence of the time-domain post-processor 1170, the decoded representation 1112 of the audio content may be equal to the time-domain representation 1162 of the audio content provided by the frequency-domain-to-time-domain converter 1160.

5.2 Further Details

In the following, further details of the audio decoder 1100 will be described, which details may be considered as optional improvements of the audio signal decoder.

It should be noted that the audio signal decoder 1100 is a multi-mode audio signal decoder, which is capable of handling an encoded audio signal representation in which subsequent portions (for example, overlapping or non-overlapping audio frames) of the audio content are encoded using different modes. In the following, audio frames will be considered as a simple example of a portion of the audio content. As the audio content is sub-divided into audio frames, it is particularly important to have smooth transitions between decoded representations of subsequent (partially overlapping or non-overlapping) audio frames encoded in the same mode, and also between subsequent (overlapping or non-overlapping) audio frames encoded in different modes. Advantageously, the audio signal decoder 1100 handles audio signal representations in which subsequent audio frames are overlapping by approximately 50%, even though the overlapping may be significantly smaller in some cases and/or for some transitions.

By this reason, the audio signal decoder 1100 comprises an overlapper configured to overlap-and-add time-domain representations of subsequent audio frames encoded in different of the modes. The overlapper may, for example, be part of the frequency-domain-to-time-domain converter 1160, or may be arranged at the output of the frequency-domain-to-time-domain converter 1160. In order to obtain high efficiency and good quality when overlapping subsequent audio frames, the frequency-domain-to-time-to-domain converter is configured to obtain a time-domain representation of an audio frame encoded in the linear-prediction mode (for example, in the transform-coded-excitation sub-mode thereof) using a lapped transform, and to also obtain a time-domain-representation of an audio frame encoded in the frequency-domain mode using a lapped transform. In this case, the overlapper is configured to overlap the time-domain-representations of the subsequent audio frames encoded in different of the modes. By using such synthesis lapped transforms for the frequency-domain-to-time-domain conversions, which may advantageously be of the same transform type for audio frames encoded in different of the modes, a critical sampling can be used and the overhead caused by the overlap-and-add operation is minimized. At the same time, there is a time domain aliasing cancellation between overlapping portions of the time-domain-representations of the subsequent audio frames. It should be noted that the possibility to have a time-domain aliasing cancellation at the transition between subsequent audio frames encoded in different modes is caused by the fact that a frequency-domain-to-time-domain conversion is applied in the same domain in different modes, such that an output of a synthesis lapped transform performed on a spectrally-shaped set of decoded spectral coefficients of a first audio frame encoded in a first of the modes can be directly combined (i.e. combined without an intermediate filtering operation) with an output of a lapped transform performed on a spectrally-shaped set of decoded spectral coefficients of a subsequent audio frame encoded in a second of the modes. Thus, a linear combination of the output of the lapped transform performed for an audio frame encoded in the first mode and of the output of the lapped transform for an audio frame encoded in the second of the mode is performed. Naturally, an appropriate overlap windowing can be performed as part of the lapped transform process or subsequent to the lapped transform process.

Accordingly, a time-domain aliasing cancellation is obtained by the mere overlap-and-add operation between time-domain representations of subsequent audio frames encoded in different of the modes.

In other words, it is important that the frequency-domain-to-time-domain converter 1160 provides time-domain output signals, which are in the same domain for both of the modes. The fact that the output signals of the frequency-domain-to-time-domain conversion (for example, the lapped transform in combination with an associated transition windowing) is in the same domain for different modes means that output signals of the frequency-domain-to-time-domain conversion are linearly combinable even at a transition between different modes. For example, the output signals of the frequency-domain-to-time-domain conversion are both time-domain representations of an audio content describing a temporal evolution of a speaker signal. In other words, the time-domain representations 1162 of the audio contents of subsequent audio frames can be commonly processed in order to derive the speaker signals.

Moreover, it should be noted that the spectrum processor 1150 may comprise a parameter provider 1156, which is configured to provide the set 1152 of linear-prediction domain parameters and the set 1154 of scale factor parameters on the basis of the information extracted from the bitstream 1110, for example, on the basis of an encoded scale factor information and an encoded LPC filter parameter information. The parameter provider 1156 may, for example, comprise an LPC filter coefficient determinator configured to obtain decoded LPC filter coefficients on the basis of an encoded representation of the LPC filter coefficients for a portion of the audio content encoded in the linear-prediction mode. Also, the parameter provider 1156 may comprise a filter coefficient transformer configured to transform the decoded LPC filter coefficients into a spectral representation, in order to obtain linear-prediction mode gain values associated with different frequencies. The linear-prediction mode gain values (sometimes also designated with g[k]) may constitute a set 1152 of linear-prediction domain parameters.

The parameter provider 1156 may further comprise a scale factor determinator configured to obtain decoded scale factor values on the basis of an encoded representation of the scale factor values for an audio frame encoded in the frequency-domain mode. The decoded scale factor values may serve as a set 1154 of scale factor parameters.

Accordingly, the spectral-shaping, which may be considered as a spectrum modification, is configured to combine a set 1132 of decoded spectral coefficients associated to an audio frame encoded in the linear-prediction mode, or a pre-processed version 1132' thereof, with the linear-prediction mode gain values (constituting the set 1152 of linear-prediction domain parameters), in order to obtain a gain processed (i.e. spectrally-shaped) version 1158 of the decoded spectral coefficients 1132 in which contributions of the decoded spectral coefficients 1132, or of the pre-processed version 1132' thereof, are weighted in dependence on the linear-prediction mode gain values. In addition, the spectrum modifier may be configured to combine a set 1132 of decoded spectral coefficients associated to an audio frame encoded in the frequency-domain mode, or a pre-processed version 1132' thereof, with the scale factor values (which constitute the set 1154 of scale factor parameters) in order to obtain a scale-factor-processed (i.e. spectrally-shaped) version 1158 of the decoded spectral coefficients 1132 in which contributions of the decoded spectral coefficients 1132, or of the pre-processed version 1132' thereof, are weighted in dependence on the scale factor values (of the set 1154 of scale factor parameters). Accordingly, a first type of spectral shaping, namely a spectral shaping in dependence on a set 1152 of linear-prediction domain parameters, is performed in the linear-prediction mode, and a second type of spectral-shaping, namely a spectral-shaping in dependence on a set 1154 of scale factor parameters, is performed in the frequency-domain mode. Consequently, a detrimental impact of the quantization noise on the time-domain-representation 1162 is kept small both for speech-like audio frames (in which the spectral-shaping is advantageously performed in dependence on the set 1152 of linear-prediction-domain parameters) and for general audio, for example, non-speech-like audio frames for which the spectral shaping is advantageously performed in dependence the set 1154 of scale factor parameters. However, by performing the noise-shaping using the spectral shaping both for speech-like and non-speech-like audio frames, i.e. both for audio frames encoded in the linear-prediction mode and for audio frames encoded in the frequency-domain mode, the multi-mode audio decoder 1100 comprises a low-complexity structure and at the same time allows for an aliasing-canceling overlap-and-add of the time-domain representations 1162 of audio frames encoded in different of the modes.

Other details will be discussed below.

6. Audio Signal Decoder According to FIG. 12

Figure 12A:
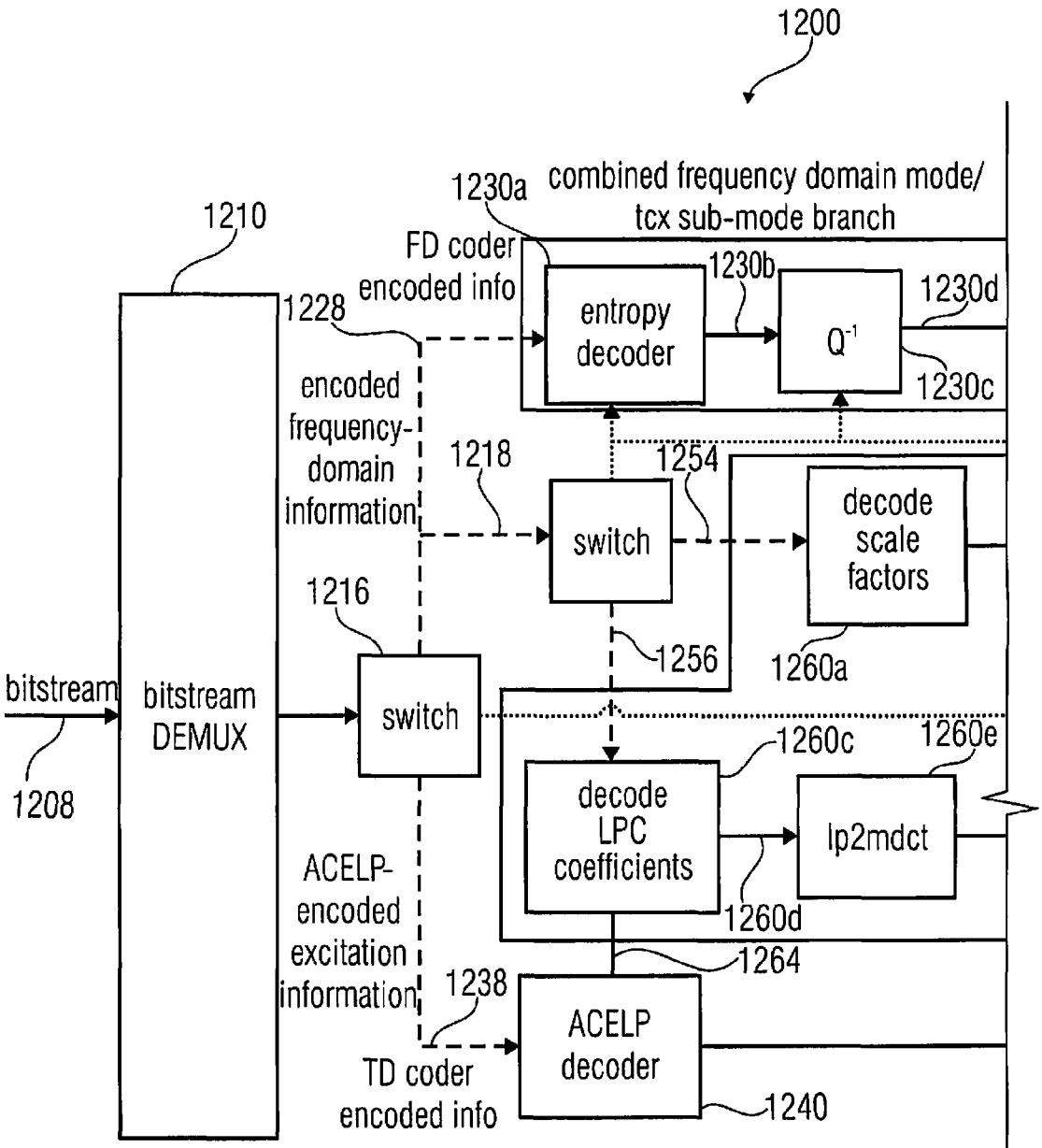
FIG. 12 shows a unified view of a USAC decoder with TCX-MDCT in the signal domain.
Figure 12B:
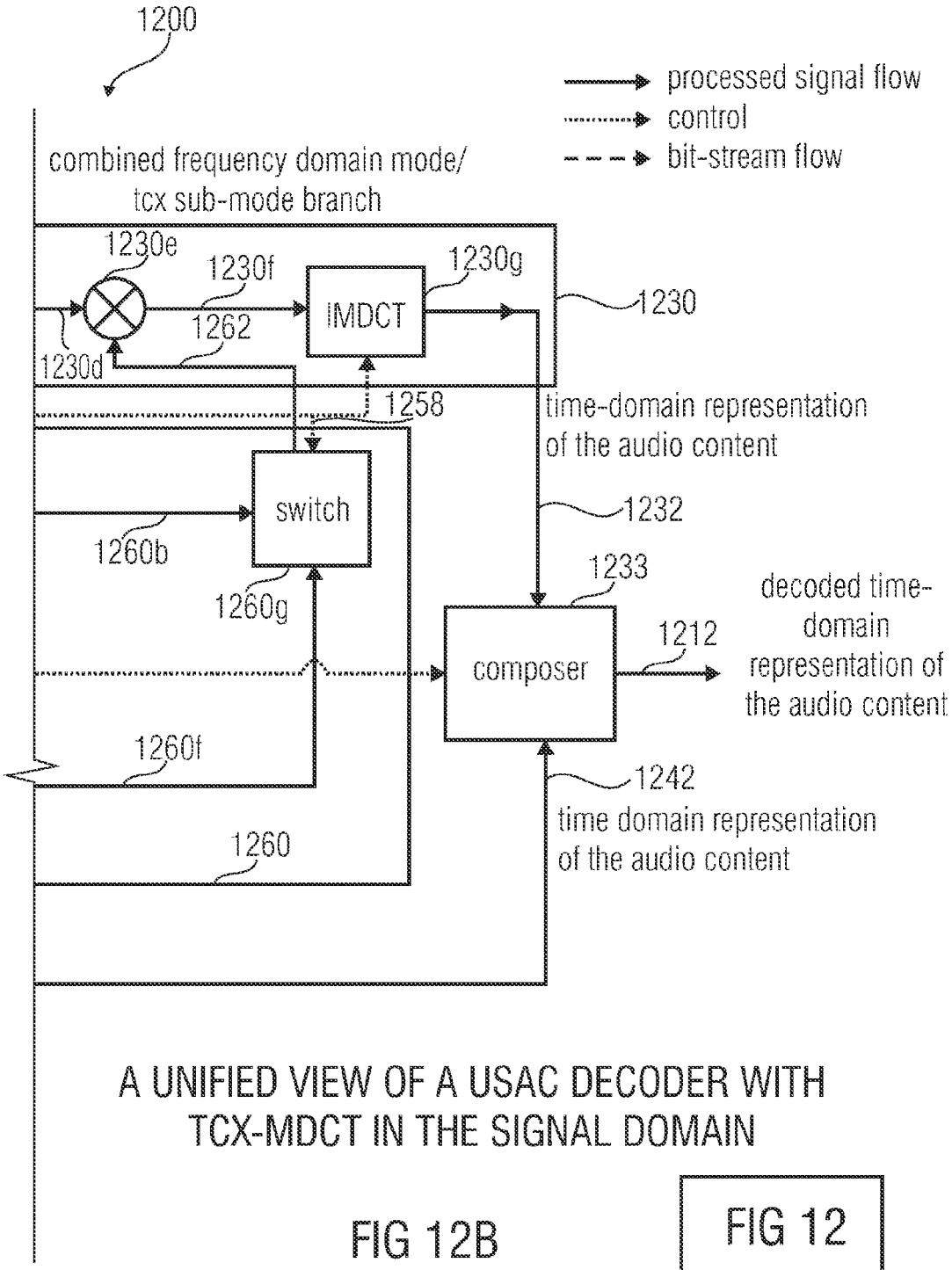

FIG. 12 shows a block schematic diagram of an audio signal decoder 1200, according to a further embodiment of the invention. FIG. 12 shows a unified view of a unified-speech-and-audio-coding (USAC) decoder with a transform-coded excitation-modified-discrete-cosine-transform (TCX-MDCT) in the signal domain.

The audio signal decoder 1200 according to FIG. 12 comprises a bitstream demultiplexer 1210, which may take the function of the bitstream payload deformatter 1120. The bitstream demultiplexer 1210 extracts from a bitstream representing an audio content an encoded representation of the audio content, which may comprise encoded spectral values and additional information (for example, an encoded scale-factor information and an encoded LPC filter parameter information).

The audio signal decoder 1200 also comprises switches 1216, 1218, which are configured to distribute components of the encoded representation of the audio content provided by the bitstream demultiplexer to different component processing blocks of the audio signal decoder 1200. For example, the audio signal decoder 1200 comprises a combined frequency-domain-mode/TCX sub-mode branch 1230, which receives from the switch 1216 an encoded frequency-domain representation 1228 and provides, on the basis thereof, a time-domain representation 1232 of the audio content. The audio signal decoder 1200 also comprises an ACELP decoder 1240, which is configured to receive from the switch 1216 an ACELP-encoded excitation information 1238 and to provide, on the basis thereof, a time-domain representation 1242 of the audio content.

The audio signal decoder 1200 also comprises a parameter provider 1260, which is configured to receive from the switch 1218 an encoded scale-factor information 1254 for an audio frame encoded in the frequency-domain mode and an encoded LPC filter coefficient information 1256 for an audio frame encoded in the linear-prediction mode, which comprises the TCX sub-mode and the ACELP sub-mode. The parameter provider 1260 is further configured to receive control information 1258 from the switch 1218. The parameter provider 1260 is configured to provide a spectral-shaping information 1262 for the combined frequency-domain mode/TCX sub-mode branch 1230. In addition, the parameter provider 1260 is configured to provide a LPC filter coefficient information 1264 to the ACELP decoder 1240.

The combined frequency domain mode/TCX sub-mode branch 1230 may comprise an entropy decoder 1230*a*, which receives the encoded frequency domain information 1228 and provides, on the basis thereof, a decoded frequency domain information 1230*b*, which is fed to an inverse quantizer 1230*c*. The inverse quantizer 1230*c* provides, on the basis of the decoded frequency domain information 1230*b*, a decoded and inversely quantized frequency domain information 1230*d*, for example, in the form of sets of decoded spectral coefficients. A combiner 1230*e* is configured to combine the decoded and inversely quantized frequency domain information 1230*d* with the spectral shaping information 1262, to obtain the spectrally-shaped frequency domain information 1230*f*. An inverse modified-discrete-cosine-transform 1230*g* receives the spectrally shaped frequency domain information 1230*f* and provides, on the basis thereof, the time domain representation 1232 of the audio content.

The entropy decoder 1230*a*, the inverse quantizer 1230*c* and the inverse modified discrete cosine transform 1230*g* may all optionally receive some control information, which may be included in the bitstream or derived from the bitstream by the parameter provider 1260.

The parameter provider 1260 comprises a scale factor decoder 1260*a*, which receives the encoded scale factor information 1254 and provides a decoded scale factor information 1260*b*. The parameter provider 1260 also comprises an LPC coefficient decoder 1260*c*, which is configured to receive the encoded LPC filter coefficient information 1256 and to provide, on the basis thereof, a decoded LPC filter coefficient information 1260*d* to a filter coefficient transformer 1260*e*. Also, the LPC coefficient decoder 1260*c* provides the LPC filter coefficient information 1264 to the ACELP decoder 1240. The filter coefficient transformer 1260*e* is configured to transform the LPC filter coefficients 1260*d* into the frequency domain (also designated as spectral domain) and to subsequently derive linear prediction mode gain values 1260*f* from the LPC filter coefficients 1260*d*. Also, the parameter provider 1260 is configured to selectively provide, for example using a switch 1260*g*, the decoded scale factors 1260*b* or the linear prediction mode gain values 1260*f* as the spectral shaping information 1262.

It should be noted here that the audio signal encoder 1200 according to FIG. 12 may be supplemented by a number of additional preprocessing steps and post-processing steps circuited between the stages. The preprocessing steps and post-processing steps may be different for different of the modes.

Some details will be described in the following.

7. Signal Flow According to FIG. 13

In the following, a possible signal flow will be described taking reference to FIG. 13. The signal flow 1300 according to FIG. 13 may occur in the audio signal decoder 1200 according to FIG. 12.

Figures 13A, 13B:
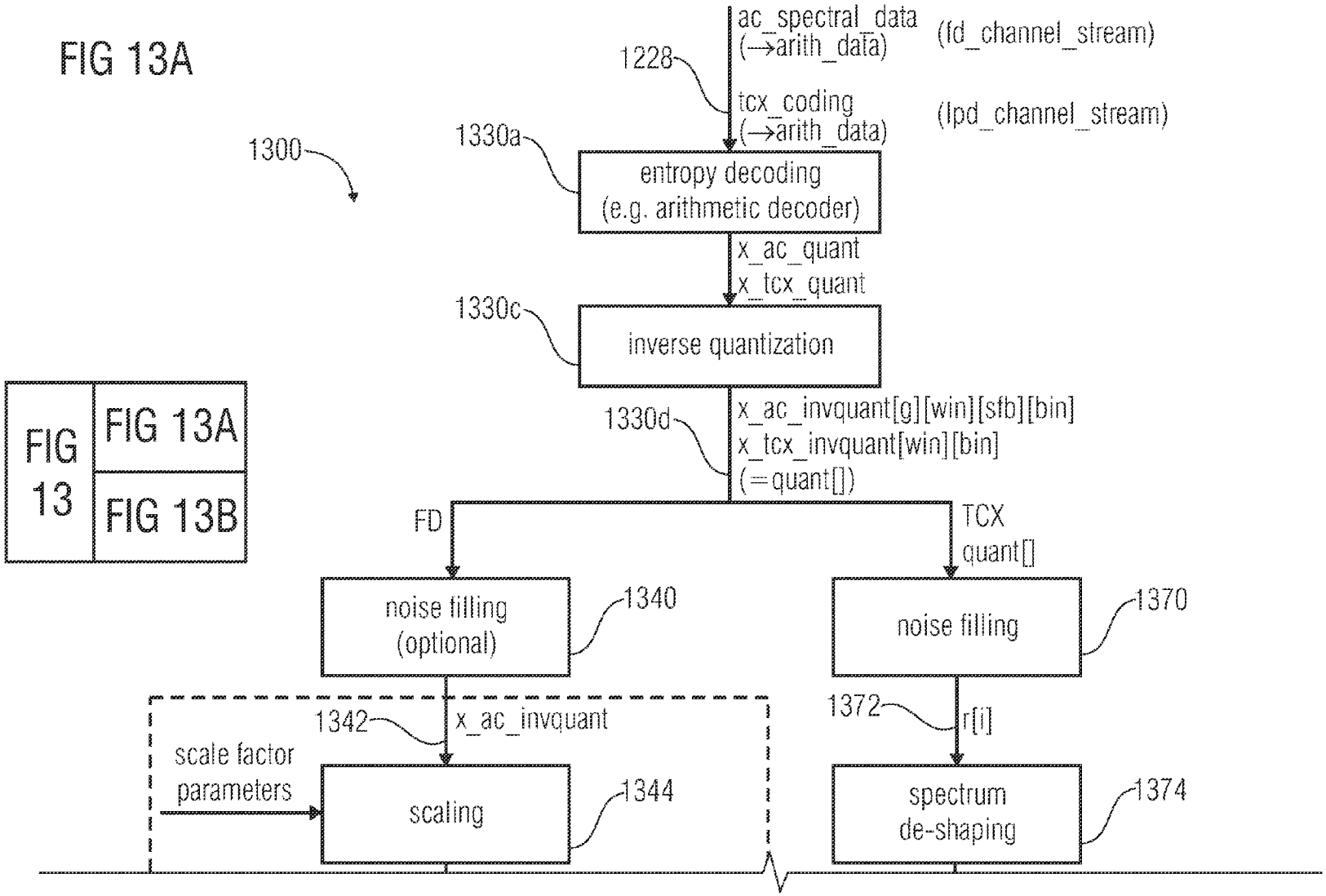
FIG. 13 shows a schematic representation of processing steps, which may be performed in the audio signal decoders according to FIGS. 7 and 12.
Figure 13B:
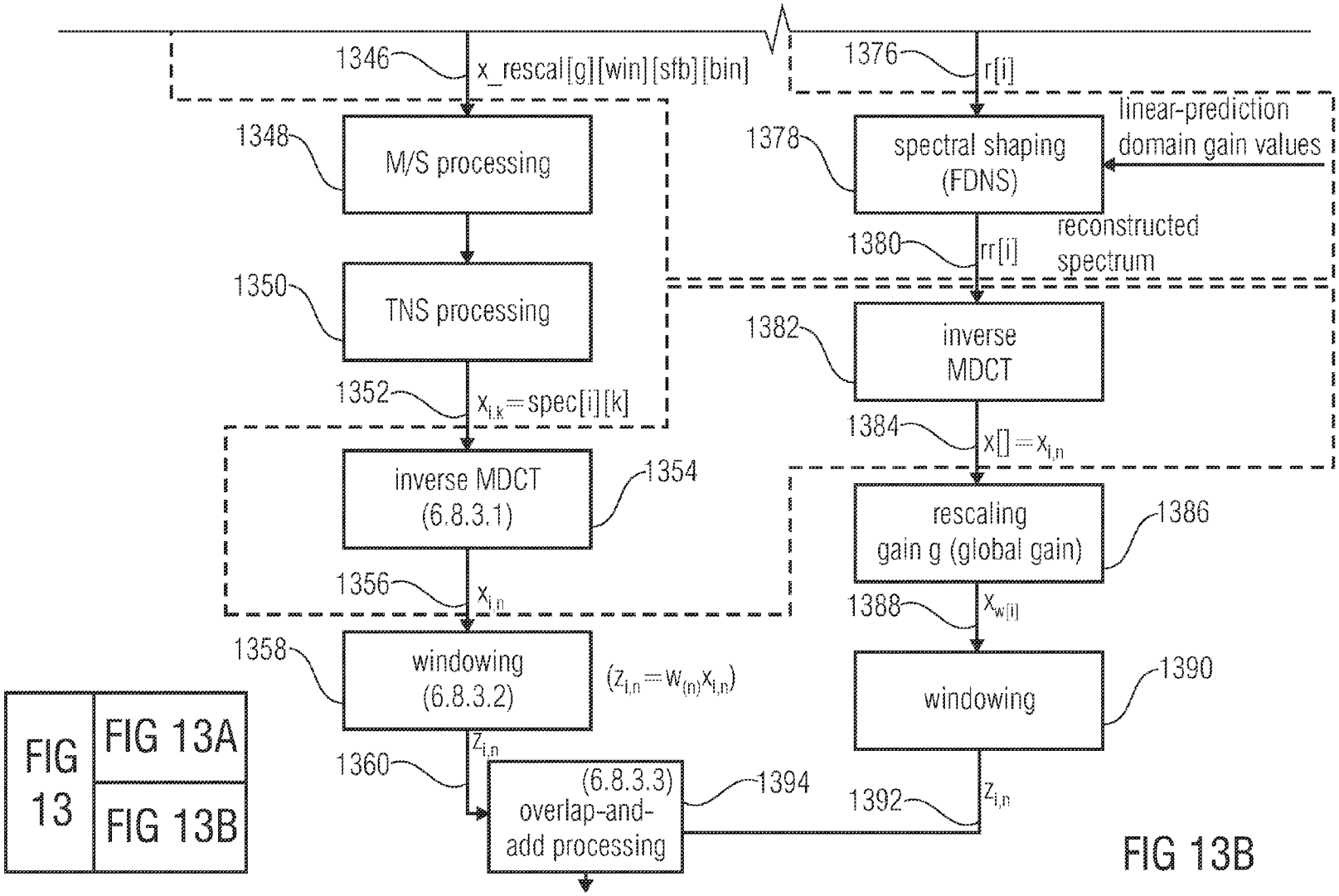

It should be noted that the signal flow 1300 of FIG. 13 only describes the operation in the frequency domain mode and the TCX sub-mode of the linear prediction mode for the sake of simplicity. However, decoding in the ACELP sub-mode of the linear prediction mode may be done as discussed with reference to FIG. 12.

The common frequency domain mode/TCX sub-mode branch 1230 receives the encoded frequency domain information 1228. The encoded frequency domain information 1228 may comprise so-called arithmetically coded spectral data "ac_spectral_data", which are extracted from a frequency domain channel stream ("fd_channel_stream") in the frequency domain mode. The encoded frequency domain information 1228 may comprise a so-called TCX coding ("tcx_coding"), which may be extracted from a linear prediction domain channel stream ("lpd_channel_stream") in the TCX sub-mode. An entropy decoding 1330*a* may be performed by the entropy decoder 1230*a*. For example, the entropy decoding 1330*a* may be performed using an arithmetic decoder. Accordingly, quantized spectral coefficients "x_ac_quant" are obtained for frequency-domain encoded audio frames, and quantized TCX mode spectral coefficients "x_tcx_quant" are obtained for audio frames encoded in the TCX mode. The quantized frequency domain mode spectral coefficients and the quantized TCX mode spectral coefficients may be integer numbers in some embodiments. The entropy decoding may, for example, jointly decode groups of encoded spectral coefficients in a context-sensitive manner. Moreover, the number of bits needed to encode a certain spectral coefficient may vary in dependence on the magnitude of the spectral coefficients, such that more codeword bits are needed for encoding a spectral coefficient having a comparatively larger magnitude.

Subsequently, inverse quantization 1330*c* of the quantized frequency domain mode spectral coefficients and of the quantized TCX mode spectral coefficients will be performed, for example using the inverse quantizer 1230*c*. The inverse quantization may be described by the following formula:

$$x_invquant = Sign(x_quant) \cdot |x_quant|^{\frac{4}{3}}$$

Accordingly, inversely quantized frequency domain mode spectral coefficients ("x_ac_invquant") are obtained for audio frames encoded in the frequency domain mode, and inversely quantized TCX mode spectral coefficients ("x_tcx_invquant") are obtained for audio frames encoded in the TCX sub-mode.

7.1 Processing for Audio Frame Encoded in the Frequency Domain

In the following, the processing in the frequency domain mode will be summarized. In the frequency domain mode, a noise filling 1340 is optionally applied to the inversely quantized frequency domain mode spectral coefficients, to obtain a noise-filled version 1342 of the inversely quantized frequency domain mode spectral coefficients 1330*d* ("x_ac_invquant"). Next, a scaling of the noise filled version 1342 of the inversely quantized frequency domain mode spectral coefficients may be performed, wherein the scaling is designated with 1344. In the scaling, scale factor parameters (also briefly designated as scale factors or sf[g][sfb]) are applied to scale the inversely quantized frequency domain mode spectral coefficients 1342 ("x_ac_invquant"). For example, different scale factors may be associated to spectral coefficients of different frequency bands (frequency ranges or scale factor bands). Accordingly, inversely quantized spectral coefficients 1342 may be multiplied with associated scale factors to obtain scaled spectral coefficients 1346. The scaling 1344 may advantageously be performed as described in International Standard ISO/IEC 14496-3, subpart 4, sub-clauses 4.6.2 and 4.6.3. The scaling 1344 may, for example, be performed using the combiner 1230*e*. Accordingly, a scaled (and consequently, spectrally shaped) version 1346, "x_rescal" of the frequency domain mode spectral coefficients is obtained, which may be equivalent to the frequency domain representation 1230*f*. Subsequently, a combination of a mid/side processing 1348 and of a temporal noise shaping processing 1350 may optionally be performed on the basis of the scaled version 1346 of the frequency domain mode spectral coefficients, to obtain a post-processed version 1352 of the scaled frequency domain mode spectral coefficients 1346. The optional mid/side processing 1348 may, for example, be performed as described in ISO/IEC 14496-3: 2005, information technology-coding of audio-visual objects—part 3: Audio, subpart 4, sub-clause 4.6.8.1. The optional temporal noise shaping may be performed as described in ISO/IEC 14496-3: 2005, information technology-coding of audio-visual objects—part 3: Audio, subpart 4, sub-clause 4.6.9.

Subsequently, an inverse modified discrete cosine transform 1354 may be applied to the scaled version 1346 of the frequency-domain mode spectral coefficients or to the post-processed version 1352 thereof. Consequently, a time domain representation 1356 of the audio content of the currently processed audio frame is obtained. The time domain representation 1356 is also designated with $x_{i,n}$. As a simplifying assumption, it can be assumed that there is one time domain representation $x_{i,n}$ per audio frame. However, in some cases, in which multiple windows (for example, so-called "short windows") are associated with a single audio frame, there may be a plurality of time domain representations $x_{i,n}$ per audio frame.

Subsequently, a windowing 1358 is applied to the time domain representation 1356, to obtain a windowed time domain representation 1360, which is also designated with $z_{i,n}$. Accordingly, in a simplified case, in which there is one window per audio frame, one windowed time domain representation 1360 is obtained per audio frame encoded in the frequency domain mode.

7.2. Processing for Audio Frame Encoded in the TCX Mode

In the following, the processing will be described for an audio frame encoded entirely or partly in the TCX mode. Regarding this issue, it should be noted that an audio frame may be divided into a plurality of, for example, four sub-frames, which can be encoded in different sub-modes of the linear prediction mode. For example, the sub-frames of an audio frame can selectively be encoded in the TCX sub-mode of the linear prediction mode or in the ACELP sub-mode of the linear prediction mode. Accordingly, each of the sub-frames can be encoded such that an optimal coding efficiency or an optimal tradeoff between audio quality and bitrate is obtained. For example, a signaling using an array named "mod [ ]" may be included in the bitstream for an audio frame encoded in the linear prediction mode to indicate which of the sub-frames of said audio frame are encoded in the TCX sub-mode and which are encoded in the ACELP sub-mode. However, it should be noted that the present concept can be understood most easily if it is assumed that the entire frame is encoded in the TCX mode. The other cases, in which an audio frame comprises both TCX sub-frames should be considered as an optional extension of said concept.

Assuming now that the entire frame is encoded in the TCX mode, it can be seen that a noise filling 1370 is applied to inversely quantized TCX mode spectral coefficients 1330*d*, which are also designated as "quant[ ]". Accordingly, a noise filled set of TCX mode spectral coefficients 1372, which is also designated as "r[i]", is obtained. In addition, a so-called spectrum de-shaping 1374 is applied to the noise filled set of TCX mode spectral coefficients 1372, to obtain a spectrum-de-shaped set 1376 of TCX mode spectral coefficients, which is also designated as "r[i]". Subsequently, a spectral shaping 1378 is applied, wherein the spectral shaping is performed in dependence on linear-prediction-domain gain values which are derived from encoded LPC coefficients describing a filter response of a Linear-Prediction-Coding (LPC) filter. The spectral shaping 1378 may for example be performed using the combiner 1230*e*. Accordingly, a reconstructed set 1380 of TCX mode spectral coefficients, also designated with "rr[i]", is obtained. Subsequently, an inverse MDCT 1382 is performed on the basis of the reconstructed set 1380 of TCX mode spectral coefficients, to obtain a time domain representation 1384 of a frame (or, alternatively, of a sub-frame) encoded in the TCX mode. Subsequently, a rescaling 1386 is applied to the time domain representation 1384 of a frame (or a sub-frame) encoded in the TCX mode, to obtain a rescaled time domain representation 1388 of the frame (or sub-frame) encoded in the TCX mode, wherein the rescaled time domain representation is also designated with "$x_w$[i]". It should be noted that the rescaling 1386 is typically an equal scaling of all time domain values of a frame encoded in the TCX mode or of sub-frame encoded in the TCX mode. Accordingly, the rescaling 1386 typically does not bring along a frequency distortion, because it is not frequency selective.

Subsequent to the rescaling 1386, a windowing 1390 is applied to the rescaled time domain representation 1388 of a frame (or a sub-frame) encoded in the TCX mode. Accordingly, windowed time domain samples 1392 (also designated with "$z_{i,n}$") are obtained, which represent the audio content of a frame (or a sub-frame) encoded in the TCX mode.

7.3. Overlap-and-Add Processing

The time domain representations 1360, 1392 of a sequence of frames are combined using an overlap-and-add processing 1394. In the overlap-and-add processing, time domain samples of a right-sided (temporally later) portion of a first audio frame are overlapped and added with time domain samples of a left-sided (temporally earlier) portion of a subsequent second audio frame. This overlap-and-add processing 1394 is performed both for subsequent audio frames encoded in the same mode and for subsequent audio frames encoded in different modes. A time domain aliasing cancellation is performed by the overlap-and-add processing 1394 even if subsequent audio frames are encoded in different modes (for example, in the frequency domain mode and in the TCX mode) due to the specific structure of the audio decoder, which avoids any distorting processing between the output of the inverse MDCT 1354 and the overlap-and-add processing 1394, and also between the output of the inverse MDCT 1382 and the overlap-and-add processing 1394. In other words, there is no additional processing between the inverse MDCT processing 1354, 1382 and the overlap-and-add processing 1394 except for the windowing 1358, 1390 and the rescaling 1386 (and optionally, a spectrally non-distorting combination of a pre-emphasis filtering and a de-emphasizing operation).

8. Details Regarding the MDCT Based TCX 8.1. MDCT Based TCX-Tool Description

When the core mode is a linear prediction mode (which is indicated by the fact the bitstream variable "core_mode" is equal to one) and when one or more of the three TCX modes (for example, out of a first TCX mode for providing a TCX portion of 512 samples, including 256 samples of overlap, a second TCX mode for providing 768 time domain samples, including 256 overlap samples, and a third TCX mode for providing 1280 TCX samples, including 256 overlap samples) is selected as the "linear prediction domain" coding, i.e. if one of the four array entries of "mod [x]" is greater than zero (wherein four array entries mod [0], mod [1], mod [2], mod [3] are derived from a bitstream variable and indicate the LPC sub-modes for four sub-frames of the current audio frame, i.e. indicate whether a sub-frame is encoded in the ACELP sub-mode of the linear prediction mode or in the TCX sub-mode of the linear prediction mode, and whether a comparatively long TCX encoding, a medium length TCX encoding or a short length TCX encoding is used), the MDCT based TCX tool is used. In other words, if one of the sub-frames of the current audio frame is encoded in the TCX sub-mode of the linear prediction mode, the TCX tool is used. The MDCT based TCX receives the quantized spectral coefficients from an arithmetic decoder (which may be used to implement the entropy decoder 1230*a* or the entropy decoding 1330*a*). The quantized coefficients (or an inversely quantized version 1230*b* thereof) are first completed by a comfort noise (which may be performed by the noise filling operation 1370). LPC based frequency-domain noise shaping is then applied to the resulting spectral coefficients (for example, using the combiner 1230*e*, or the spectral shaping operation 1378) (or to a spectral-de-shaped version thereof), and an inverse MDCT transformation (which may be implemented by the MDCT 1230*g* or by the inverse MDCT operation 1382) is performed to get the time domain synthesis signal.

8.2. MDCT-Based TCX-Definitions

In the following, some definitions will be given.

"lg" designates a number of quantized spectral coefficients output by the arithmetic decoder (for example, for an audio frame encoded in the linear prediction mode).

The bitstream variable "noise_factor" designates a noise level quantization index.

The variable "noise level" designates a level of noise injected in the reconstructed spectrum.

The variable "noise[ ]" designates a vector of generated noise.

The bitstream variable "global_gain" designates a rescaling gain quantization index.

The variable "g" designates a rescaling gain.

The variable "rms" designates a root mean square of the synthesized time-domain signal "x[ ]".

The variable "x[ ]" designates the synthesized time-domain signal.

8.3. Decoding Process

The MDCT-based TCX requests from the arithmetic decoder 1230*a* a number of quantized spectral coefficients, lg, which is determined by the mod [ ] value (i.e. by the value of the variable mod [ ]). This value (i.e. the value of the variable mod [ ]) also defines the window length and shape which will be applied in the inverse MDCT 1230*g* (or by the inverse MDCT processing 1382 and the corresponding windowing 1390). The window is composed of three parts, a left side overlap of L samples (also designated as left-sided transition slope), a middle part of ones of M samples and a right overlap part (also designated as right-sided transition slope) of R samples. To obtain an MDCT window of length 2*lg, ZL zeros are added on the left side and ZR zeros are added on the right side.

In case of a transition from or to a "short_window" the corresponding overlap region L or R may need to be reduced to 128 (samples) in order to adapt to a possible shorter window slope of the "short_window". Consequently, the region M and the corresponding zero region ZL or ZR may need to be expanded by 64 samples each.

In other words, normally there is an overlap of 256 samples=L=R. It is reduced to 128 in case of FD mode to LPD mode.

The diagram of FIG. 15 shows a number of spectral coefficients as a function of mod [ ], as well as a number of time domain samples of the left zero region ZL, of the left overlap region L, of the middle part M, of the right overlap region R and of the right zero region ZR.

The MDCT window is given by $$W(n) = \begin{cases} 0 & \text{for } 0 \le n < ZL \\ W_{SIN_LEFT,L}(n - ZL) & \text{for } ZL \le n < ZL + L \\ 1 & \text{for } ZL + L \le n < ZL + L + M \\ W_{SIN_RIGHT,R}(n - ZL - L - M) & \text{for } ZL + L + M \le n < ZL + L + M + R \\ 0 & \text{for } ZL + L + M + R \le n < 2\,lg \end{cases}$$

The definitions of $W_{SIN_LEFT,L}$ and $W_{SIN_RIGHT\ R}$ will be given below.

The MDCT window W(n) is applied in the windowing step 1390, which may be considered as a part of a windowing inverse MDCT (for example, of the inverse MDCT 1230*g*).

The quantized spectral coefficients, also designated as "quant[ ]", delivered by the arithmetic decoder 1230*a* (or, alternatively, by the inverse quantization 1230*c*) are completed by a comfort noise. The level of the injected noise is determined by the decoded bitstream variable "noise_factor" as follows:

noise_level=0.0625*(8−noise_factor)

A noise vector, also designated with "noise[ ]", is then computed using a random function, designated with "random_sign( )", delivering randomly the value −1 or +1. The following relationship holds:

noise[*i*]=random_sign( )*noise_level;

The "quant[ ]" and "noise[ ]" vectors are combined to form the reconstructed spectral coefficients vector, also designated with "r[ ]", in a way that the runs of 8 consecutive zeros in "quant[ ]" are replaced by the components of "noise[ ]". A run of 8 non-zeros are detected according to the following formula:

$$\begin{cases} rl[i] = 1 & \text{for } i \in [0, lg/6[ \\ rl[lg/6 + i] = \sum_{k=0}^{min(7, lg-8.\lfloor i/8 \rfloor - 1)} |\text{quant}[lg/6 + 8.\lfloor i/8 \rfloor + k]|^2 & \text{for } i \in [0, 5.lg/6[ \end{cases}$$

One obtains the reconstructed spectrum as follows:

$$r[i] = \begin{cases} \text{noise}[i] & \text{if } rl[i] = 0 \\ \text{quant}[i] & \text{otherwise} \end{cases}$$

The above described noise filling may be performed as a post-processing between the entropy decoding performed by the entropy decoder 1230*a* and the combination performed by the combiner 1230*e*.

A spectrum de-shaping is applied to the reconstructed spectrum (for example, to the reconstructed spectrum 1376, r[i]) according to the following steps:

1. calculate the energy $E_m$ of the 8-dimensional block at index m for each 8-dimensional block of the first quarter of the spectrum
2. compute the ratio $R_m$=sqrt($E_m/E_I$), where I is the block index with the maximum value of all $E_m$
3. if $R_m$<0.1, then set $R_m$=0.1
4. if $R_m$<$R_m$−1, then set $R_m$=$R_m$−1

Each 8-dimensional block belonging to the first quarter of the spectrum is then multiplied by the factor $R_m$.

A spectrum de-shaping will be performed as a post-processing arranged in a signal path between the entropy decoder 1230*a* and the combiner 1230*e*. The spectrum de-shaping may, for example, be performed by the spectrum de-shaping 1374.

Prior to applying the inverse MDCT, the two quantized LPC filters corresponding to both extremity of the MDCT block (i.e. the left and right folding points) are retrieved, their weighted versions are computed, and the corresponding decimated (64 points, whatever the transform length) spectrums are computed.

In other words, a first set of LPC filter coefficients is obtained for a first period of time and a second set of LPC filter coefficients is determined for a second period of time. The sets of LPC filter coefficients are advantageously derived from an encoded representation of said LPC filter coefficients, which is included in the bitstream. The first period of time is advantageously at or before the beginning of the current TCX-encoded frame (or sub-frame), and the second period of time is advantageously at or after the end of the TCX encoded frame or sub-frame. Accordingly, an effective set of LPC filter coefficients is determined by forming a weighted average of the LPC filter coefficients of the first set and of the LPC filter coefficients of the second set.

The weighted LPC spectrums are computed by applying an odd discrete Fourier transform (ODFT) to the LPC filters coefficients. A complex modulation is applied to the LPC (filter) coefficients before computing the odd discrete Fourier transform (ODFT), so that the ODFT frequency bins are (advantageously perfectly) aligned with the MDCT frequency bins. For example, the weighted LPC synthesis spectrum of a given LPC filter $\hat{A}(z)$ is computed as follows:

$$X_o[k] = \sum_{n=0}^{M-1} x_t[n] e^{-j\frac{2\pi k}{M}n}$$

with $$x_t[n] = \begin{cases} \hat{w}[n] e^{-j\frac{\pi}{M}n} & \text{if } 0 \le n < \text{lpc_order} + 1 \\ 0 & \text{if lpc_order} + 1 \le n < M \end{cases}$$

where $\hat{w}$[n], n=0 . . . lpc_order+1, are the coefficients of the weighted LPC filter given by:

$\hat{W}(z)=\hat{A}(z/\gamma_1)$ with $\gamma_1$=0.92

In other words, a time domain response of an LPC filter, represented by values $\hat{w}$[n], with n between 0 and lpc_order−1, is transformed into the spectral domain, to obtain spectral coefficients $X_0$[k]. The time domain response $\hat{w}$[n] of the LPC filter may be derived from, the time domain coefficients $a_1$ to $a_{16}$ describing the Linear Prediction Coding filter.

Gains g[k] can be calculated from the spectral representation $X_0$[k] of the LPC coefficients (for example, $a_1$ to $a_{16}$) according to the following equation:

$$g[k] = \sqrt{\frac{1}{X_o[k] X_o^*[k]}} \quad \forall k \in \{0, \ldots, M-1\}$$

where M=64 is the number of bands in which the calculated gains are applied.

Subsequently, a reconstructed spectrum 1230*f*, 1380, rr[i] is obtained in dependence on the calculated gains g[k] (also designated as linear prediction mode gain values). For example, a gain value g[k] may be associated with a spectral coefficient 1230*d*, 1376, r[i]. Alternatively, a plurality of gain values may be associated with a spectral coefficient 1230*d*,

1376, r[i]. A weighting coefficient a[i] may be derived from one or more gain values g[k], or the weighting coefficient a[i] may even be identical to a gain value g[k] in some embodiments. Consequently, a weighting coefficient a[i] may be multiplied with an associated spectral value r[i], to determine a contribution of the spectral coefficient r[i] to the spectrally shaped spectral coefficient rr[i].

For example, the following equation may hold:

$$rr[i]=g[k]\cdot r[i].$$

However, different relationships may also be used.

In the above, the variable k is equal to i/(lg/64) to take into consideration the fact that the LPC spectrums are decimated. The reconstructed spectrum rr[ ] is fed into an inverse MDCT 1230*g*, 1382. When performing the inverse MDCT, which will be described in detail below, the reconstructed spectrum values rr[i] serve as the time-frequency values k, or as the time-frequency values spec[i][k]. The following relationship may hold:

$$X_{i,k}=rr[k];\ or$$

$$\mathrm{spec}[i][k]=rr[k].$$

It should be pointed out here that in the above discussion of the spectrum processing in the TCX branch, the variable i is a frequency index. In contrast, in the discussion of the MDCT filter bank and the block switching, the variable i is a window index. A person skilled in the art will easily recognize from the context whether the variable i is a frequency index or a window index.

Also, it should be noted that a window index may be equivalent to a frame index, if an audio frame comprises only one window. If a frame comprises multiple windows, which is the case sometimes, there may be multiple window index values per frame.

The non-windowed output signal x[ ] is resealed by the gain g, obtained by an inverse quantization of the decoded global gain index ("global_gain"):

$$g=\frac{10^{global_gain/28}}{2\cdot \mathrm{rms}}$$

Where rms is calculated as:

$$\mathrm{rms}=\sqrt{\frac{\sum_{k=lg/2}^{3*lg/2-1} rr^2[k]}{L+M+R}}$$

The resealed synthesized time-domain signal is then equal to:

$$x_w[n]=x[n]\cdot g$$

After resealing, the windowing and overlap-add is applied. The windowing may be performed using a window W(n) as described above and taking into account the windowing parameters shown in FIG. 15. Accordingly, a windowed time domain signal representation $z_{i,n}$ is obtained as:

$$z_{i,n}=x_w[n]\cdot W(n).$$

In the following, a concept will be described which is helpful if there are both TCX encoded audio frames (or audio subframes) and ACELP encoded audio frames (or audio subframes). Also, it should be noted that the LPC filter coefficients, which are transmitted for TCX-encoded frames or subframes means some embodiments will be applied in order to initialize the ACELP decoding.

Note also that the length of the TCX synthesis is given by the TCX frame length (without the overlap): 256, 512 or 1024 samples for the mod [ ] of 1, 2 or 3 respectively.

Afterwards, the following notation is adopted: x[ ] designates the output of the inverse modified discrete cosine transform, z[ ] the decoded windowed signal in the time domain and out[ ] the synthesized time domain signal.

The output of the inverse modified discrete cosine transform is then rescaled and windowed as follows:

$$z[n]=x[n]\cdot w[n]\cdot g;\ \forall 0\le n<N$$

N corresponds to the MDCT window size, i.e. N=2lg.

When the previous coding mode was either FD mode or MDCT based TCX, a conventional overlap and add is applied between the current decoded windowed signal $z_{i,n}$ and the previous decoded windowed signal $z_{i-1,n}$, where the index i counts the number of already decoded MDCT windows. The final time domain synthesis out is obtained by the following formulas.

In case $z_{i-1,n}$ comes from FD mode:

$$\mathrm{out}[i_{out}+n]=\begin{cases} z_{i-1,\frac{N_l}{2}+n};\ \forall\, 0\le n<\frac{N_l}{4}-\frac{L}{2} \\ z_{i,\frac{N-N_l}{4}+n}+z_{i-1,\frac{N_l}{2}+n};\ \forall\, \frac{N_l}{4}-\frac{L}{2}\le n<\frac{N_l}{4}+\frac{L}{2} \\ z_{i,\frac{N-N_l}{4}+n};\ \forall\, \frac{N_l}{4}+\frac{L}{2}\le n<\frac{N_l}{4}+\frac{N}{2}-\frac{R}{2} \end{cases}$$

N_l is the size of the window sequence coming from FD mode. i_out indexes the output buffer out and is incremented by the number $$\frac{N_l}{4}+\frac{N}{2}-\frac{R}{2}$$

of written samples.

In case $z_{i-1,n}$ comes from MDCT based TCX:

$$out[i_{out}+n]=\begin{cases} z_{i,\frac{N}{4}-\frac{L}{2}+n}+z_{i-1,\frac{3*N_{i-1}}{4}-\frac{L}{2}+n};\ \forall\, 0\le n<L \\ z_{i,\frac{N}{4}-\frac{L}{2}+n};\ \forall\, L\le n<\frac{N+L-R}{2} \end{cases}$$

$N_{i-1}$ is the size of the previous MDCT window. i_out indexes the output buffer out and is incremented by the number (N+L−R)/2 of written samples.

In the following, some possibilities will be described to reduce artifacts at a transition from a frame or sub-frame encoded in the ACELP mode to a frame or sub-frame encoded in the MDCT-based TCX mode. However, it should be noted that different approaches may also be used.

In the following, a first approach will be briefly described. When coming from ACELP, a specific window can be used for the next TCX by means of reducing R to 0, and then eliminating overlapping region between the two subsequent frames.

In the following, a second approach will be briefly described (as it is described in USAC WD5 and earlier). When coming from ACELP, the next TCX window is enlarged by means of increasing M (middle length) by 128 samples. At decoder the right part of window, i.e. the first R non-zero decoded samples are simply discarded and replaced by the decoded ACELP samples.

The reconstructed synthesis out[$i_{out}$+n] is then filtered through the pre-emphasis filter ($1-0.68z^{-1}$). The resulting pre-emphasized synthesis is then filtered by the analysis filter $\hat{A}(z)$ in order to obtain the excitation signal. The calculated excitation updates the ACELP adaptive codebook and allows switching from TCX to ACELP in a subsequent frame. The analysis filter coefficients are interpolated in a subframe basis.

9. Details Regarding the Filterbank and Block Switching

In the following, details regarding the inverse modified discrete cosine transform and the block switching, i.e. the overlap-and-add performed between subsequent frames or subframes, will be described in more detail. It should be noted that the inverse modified discrete cosine transform described in the following can be applied both for audio frames encoded in the frequency domain and for audio frames or audio subframes encoded in the TCX mode. While the windows (W(n)) for use in the TCX mode have been described above, the windows used for the frequency-domain-mode will be discussed in the following: it should be noted that the choice of appropriate windows, in particular at the transition from a frame encoded in the frequency-mode to a subsequent frame encoded in the TCX mode, or vice versa, allows to have a time-domain aliasing cancellation, such that transitions with low or no aliasing can be obtained without the bitrate overhead.

9.1. Filterbank and Block Switching—Description

The time/frequency representation of the signal (for example, the time-frequency representation 1158, 1230*f*, 1352, 1380) is mapped onto the time domain by feeding it into the filterbank module (for example, the module 1160, 1230*g*, 1354-1358-1394, 1382-1386-1390-1394). This module consists of an inverse modified discrete cosine transform (IMDCT), and a window and an overlap-add function. In order to adapt the time/frequency resolution of the filterbank to the characteristics of the input signal, a block switching tool is also adopted. N represents the window length, where N is a function of the bitstream variable "window_sequence". For each channel, the N/2 time-frequency values $X_{i,k}$ are transformed into the N time domain values $x_{i,n}$ via the IMDCT. After applying the window function, for each channel, the first half of the $z_{i,n}$ sequence is added to the second half of the previous block windowed sequence $z_{(i-1),n}$ to reconstruct the output samples for each channel $out_{i,n}$.

9.2. Filterbank and Block Switching—Definitions

In the following, some definitions of bitstream variables will be given.

The bitstream variable "window_sequence" comprises two bits indicating which window sequence (i.e. block size) is used. The bitstream variable "window_sequence" is typically used for audio frames encoded in the frequency-domain.

Bitstream variable "window_shape" comprises one bit indicating which window function is selected.

The table of FIG. 16 shows the eleven window sequences (also designated as window_sequences) based on the five transform windows. (ONLY_LONG_SEQUENCE,LONG_START_SEQUENCE,EIGHT_SHORT_SEQUENCE, LONG_STOP_SEQUENCE, STOP_START_SEQUENCE).

In the following, LPD_SEQUENCE refers to all allowed window/coding mode combinations inside the so called linear prediction domain codec. In the context of decoding a frequency domain coded frame it is important to know only if a following frame is encoded with the LP domain coding modes, which is represented by an LPD_SEQUENCE. However, the exact structure within the LPD_SEQUENCE is taken care of when decoding the LP domain coded frame.

In other words, an audio frame encoded in the linear-prediction mode may comprise a single TCX-encoded frame, a plurality of TCX-encoded subframes or a combination of TCX-encoded subframes and ACELP-encoded subframes.

9.3. Filterbank and Block Switching-Decoding Process

9.3.1 Filterbank and Block Switching-IMDCT

The analytical expression of the IMDCT is:

$$x_{i,n} = \frac{2}{N}\sum_{k=0}^{\frac{N}{2}-1} \mathrm{spec}[i][k]\cos\left(\frac{2\pi}{N}(n+n_0)\left(k+\frac{1}{2}\right)\right) \quad \text{for } 0 \le n < N$$

where:

n=sample index i=window index k=spectral coefficient index

N=window length based on the window_sequence value $$n_0=(N/2+1)/2$$

The synthesis window length N for the inverse transform is a function of the syntax element "window_sequence" and the algorithmic context. It is defined as follows:

Window Length 2048:

$$N = \begin{cases} 2048, & \text{if ONLY_LONG_SEQUENCE} \\ 2048, & \text{if LONG_START_SEQUENCE} \\ 256, & \text{if EIGHT_SHORT_SEQUENCE} \\ 2048 & \text{If LONG_STOP_SEQUENCE} \\ 2048, & \text{If STOP_START_SEQUENCE} \end{cases}$$

A tick mark (☑) in a given table cell of the table of FIG. 17*a* or 17*b* indicates that a window sequence listed in that particular row may be followed by a window sequence listed in that particular column.

Meaningful block transitions of a first embodiment are listed in FIG. 17*a*. Meaningful block transitions of an additional embodiment are listed in the table of FIG. 17*b*. Additional block transitions in the embodiment according to FIG. 17*b* will be explained separately below.

9.3.2 Filterbank and Block Switching—Windowing and Block Switching

Depending on the bitstream variables (or elements) "window_sequence" and "window_shape" element different transform windows are used. A combination of the window halves described as follows offers all possible window sequences. For "window_shape"==1, the window coefficients are given by the Kaiser-Bessel derived (KBD) window as follows:

$$W_{KBD_LEFT,N}(n) = \sqrt{\frac{\sum_{p=0}^{n}[W'(p,\alpha)]}{\sum_{p=0}^{N/2}[W'(p,\alpha)]}} \quad \text{for } 0 \le n < \frac{N}{2}$$

-continued $$W_{KBD_RIGHT,N}(n) = \sqrt{\frac{\sum_{p=0}^{N-n-1}[W'(p,\alpha)]}{\sum_{p=0}^{N/2}[W'(p,\alpha)]}} \quad \text{for } \frac{N}{2} \le n < N$$

where:

W', Kaiser-Bessel kernel window function, see also [5], is defined as follows:

$$W'(n,\alpha) = \frac{I_0\left[\pi\alpha\sqrt{1.0-\left(\frac{n-N/4}{N/4}\right)^2}\right]}{I_0[\pi\alpha]} \quad \text{for } 0 \le n \le \frac{N}{2}$$

$$I_0[x] = \sum_{k=0}^{\infty}\left[\frac{\left(\frac{x}{2}\right)^k}{k!}\right]^2$$

α=kernel window alpha factor, $$\alpha = \begin{cases} 4 \text{ for } N = 2048(1920) \\ 6 \text{ for } N = 256(240) \end{cases}$$

Otherwise, for "window_shape"==0, a sine window is employed as follows:

$$W_{SIN_LEFT,N}(n) = \sin\left(\frac{\pi}{N}\left(n+\frac{1}{2}\right)\right) \quad \text{for } 0 \le n < \frac{N}{2}$$

$$W_{SIN_RIGHT,N}(n) = \sin\left(\frac{\pi}{N}\left(n+\frac{1}{2}\right)\right) \quad \text{for } \frac{N}{2} \le n < N$$

The window length N can be 2048 (1920) or 256 (240) for the KBD and the sine window.

How to obtain the possible window sequences is explained in the parts a)-e) of this subclause.

For all kinds of window sequences the variable "window_shape" of the left half of the first transform window is determined by the window shape of the previous block which is described by the variable "window_shape_previous_ block". The following formula expresses this fact:

$$W_{LEFT,N}(n) = \begin{cases} W_{KBD_LEFT,N}(n), & \text{if "window_shape_previous_block" == 1} \\ W_{SIN_LEFT,N}(n) & \text{if "window_shape_previous_block" == 0} \end{cases}$$

where:

"window_shape_previous_block" is a variable, which is equal to the bitstream variable "window_shape" of the previous block (i−1).

For the first raw data block "raw_data_block( )" to be decoded, the variable "window_shape" of the left and right half of the window are identical.

In case the previous block was coded using LPD mode, "window_shape_previous_block" is set to 0.

a) ONLY_LONG_SEQUENCE:

The window sequence designated by window_sequence==ONLY_LONG_SEQUENCE is equal to one window of type "LONG_WINDOW" with a total window length N_l of 2048 (1920).

For window_shape==1 the window for variable value "ONLY_LONG_SEQUENCE" is given as follows:

$$W(n) = \begin{cases} W_{LEFT,N_l}(n), & \text{for } 0 \le n < \text{N_l}/2 \\ W_{KBD_RIGHT,N_l}(n), & \text{for N_l}/2 \le n < \text{N_l} \end{cases}$$

If window_shape==0 the window for variable value "ONLY_LONG_SEQUENCE" can be described as follows:

$$W(n) = \begin{cases} W_{LEFT,N_l}(n), & \text{for } 0 \le n < \text{N_l}/2 \\ W_{SIN_RIGHT,N_l}(n), & \text{for N_l}/2 \le n < \text{N_l} \end{cases}$$

After windowing, the time domain values ($z_{i,n}$) can be expressed as:

$$z_{i,n} = w(n) \cdot x_{i,n};$$

b) LONG_START_SEQUENCE:

The window of type "LONG_START_SEQUENCE" can be used to obtain a correct overlap and add for a block transition from a window of type "ONLY_LONG_SEQUENCE" to any block with a low-overlap (short window slope) window half on the left (EIGHT_SHORT_SEQUENCE, LONG_STOP_SEQUENCE, STOP_START_SEQUENCE or LPD_SEQUENCE).

In case the following window sequence is not a window of type "LPD_SEQUENCE": Window length N_l and N_s is set to 2048 (1920) and 256 (240) respectively.

In case the following window sequence is a window of type "LPD_SEQUENCE": Window length N_l and N_s is set to 2048 (1920) and 512 (480) respectively.

If window_shape==1 the window for window type "LONG_START_SEQUENCE" is given as follows:

$$W(n) = \begin{cases} W_{LEFT,N_l}(n), & \text{for } 0 \le n < \text{N_l}/2 \\ 1.0, & \text{for N_l}/2 \le n < \frac{3\text{N_l} - \text{N_s}}{4} \\ W_{KBD_RIGHT,N_s}\left(n + \frac{\text{N_s}}{2} - \frac{3\text{N_l} - \text{N_s}}{4}\right), & \text{for } \frac{3\text{N_l} - \text{N_s}}{4} \le n < \frac{3\text{N_l} + \text{N_s}}{4} \\ 0.0, & \text{for } \frac{3\text{N_l} + \text{N_s}}{4} \le n < \text{N_l} \end{cases}$$

If window_shape==0 the window for window type "LONG_START_SEQUENCE" looks like:

$$W(n)=\begin{cases} W_{LEFT,N_l}(n), & \text{for } 0\le n<\text{N_l}/2 \\ 1.0, & \text{for } \text{N_l}/2\le n<\frac{3\text{N_l}-\text{N_s}}{4} \\ W_{SIN_RIGHT,N_s}\left(n+\frac{\text{N_s}}{2}-\frac{3\text{N_l}-\text{N_s}}{4}\right), & \text{for } \frac{3\text{N_l}-\text{N_s}}{4}\le n<\frac{3\text{N_l}+\text{N_s}}{4} \\ 0.0, & \text{for } \frac{3\text{N_l}+\text{N_s}}{4}\le n<\text{N_l} \end{cases}$$

The windowed time-domain values can be calculated with the formula explained in a).

c) EIGHT_SHORT

The window sequence for window_sequence==EIGHT_SHORT comprises eight overlapped and added SHORT_WINDOWs with a length N_s of 256 (240) each. The total length of the window_sequence together with leading and following zeros is 2048 (1920). Each of the eight short blocks are windowed separately first. The short block number is indexed with the variable j=0, . . . , M−1 (M=N_l/N_s).

The window_shape of the previous block influences the first of the eight short blocks ($W_0(n)$) only. If window_shape==1 the window functions can be given as follows:

$$W_0(n)=\begin{cases} W_{LEFT,N_s}(n), & \text{for } 0\le n<\text{N_s}/2 \\ W_{KBD_RIGHT,N_s}(n), & \text{for } \text{N_s}/2\le n<\text{N_s} \end{cases}$$

$$W_j(n)=\begin{cases} W_{KBD_LEFT,N_s}(n), & \text{for } 0\le n<\text{N_s}/2 \\ W_{KBD_RIGHT,N_s}(n), & \text{for } \text{N_s}/2\le n<\text{N_s} \end{cases},\ 0<j\le M-1$$

Otherwise, if window_shape==0, the window functions can be described as:

$$W_0(n)=\begin{cases} W_{LEFT,N_s}(n), & \text{for } 0\le n<\text{N_s}/2 \\ W_{SIN_RIGHT,N_s}(n), & \text{for } \text{N_s}/2\le n<\text{N_s} \end{cases}$$

$$W_j(n)=\begin{cases} W_{SIN_LEFT,N_s}(n), & \text{for } 0\le n<\text{N_s}/2 \\ W_{SIN_RIGHT,N_s}(n), & \text{for } \text{N_s}/2\le n<\text{N_s} \end{cases},\ 0<j\le M-1$$

The overlap and add between the EIGHT_SHORT window_sequence resulting in the windowed time domain values $z_{i,n}$ is described as follows:

$$z_{i,n}=\begin{cases} 0, & \text{for } 0\le n<\frac{N_l-N_s}{4} \\ x_{0,n-\frac{N_l-N_s}{4}}\cdot W_0\left(n-\frac{\text{N_l}-\text{N_s}}{4}\right), & \text{for } \frac{N_l-N_s}{4}\le n<\frac{N_l+N_s}{4} \\ x_{j-1,n-\frac{N_l+(2j-3)N_s}{4}}\cdot W_{j-1}\left(n-\frac{\text{N_l}+(2j-3)\text{N_s}}{4}\right)+ & \text{for } 1\le j<M,\ \frac{N_l+(2j-1)N_s}{4}\le n<\frac{N_l+(2j+1)N_s}{4} \\ \quad x_{j,n-\frac{N_l+(2j-1)N_s}{4}}\cdot W_j\left(n-\frac{\text{N_l}+(2j-1)\text{N_s}}{4}\right), & \\ x_{M-1,n-\frac{N_l+(2M-3)N_s}{4}}\cdot W_{M-1}\left(n-\frac{\text{N_l}+(2M-3)\text{N_s}}{4}\right), & \text{for } \frac{N_l+(2M-1)N_s}{4}\le n<\frac{N_l+(2M+1)N_s}{4} \\ 0, & \text{for } \frac{N_l+(2M+1)\text{N_s}}{4}\le n<N_l \end{cases}$$

d) LONG_STOP_SEQUENCE

This window_sequence is needed to switch from a window sequence "EIGHT_SHORT_SEQUENCE" or a window type "LPD_SEQUENCE" back to a window type "ONLY_LONG_SEQUENCE".

In case the previous window sequence is not an LPD_SEQUENCE:

Window length N_l and N_s is set to 2048 (1920) and 256 (240) respectively.

In case the previous window sequence is an LPD_SEQUENCE:

Window length N_l and N_s is set to 2048 (1920) and 512 (480) respectively.

If window_shape==1 the window for window type "LONG_STOP_SEQUENCE" is given as follows:

$$W(n)=\begin{cases} 0.0, & \text{for } 0\le n<\frac{\text{N_l}-\text{N_s}}{4} \\ W_{LEFT,N_s}\left(n-\frac{\text{N_l}-\text{N_s}}{4}\right), & \text{for } \frac{\text{N_l}-\text{N_s}}{4}\le n<\frac{\text{N_l}+\text{N_s}}{4} \\ 1.0, & \text{for } \frac{\text{N_l}+\text{N_s}}{4}\le n<\text{N_l}/2 \\ W_{KBD_RIGHT,N_l}(n), & \text{for } \text{N_l}/2\le n<\text{N_l} \end{cases}$$

If window_shape==0 the window for LONG_STOP_SEQUENCE is determined by:

$$W(n)=\begin{cases} 0.0, & \text{for } 0\le n<\frac{\text{N_l}-\text{N_s}}{4} \\ W_{LEFT,N_s}\left(n-\frac{\text{N_l}-\text{N_s}}{4}\right), & \text{for } \frac{\text{N_l}-\text{N_s}}{4}\le n<\frac{\text{N_l}+\text{N_s}}{4} \\ 1.0, & \text{for } \frac{\text{N_l}+\text{N_s}}{4}\le n<\text{N_l}/2 \\ W_{SIN_RIGHT,N_l}(n), & \text{for } \text{N_l}/2\le n<\text{N_l} \end{cases}$$

The windowed time domain values can be calculated with the formula explained in a).

e) STOP_START_SEQUENCE:

The window type "STOP_START_SEQUENCE" can be used to obtain a correct overlap and add for a block transition from any block with a low-overlap (short window slope) window half on the right to any block with a low-overlap (short window slope) window half on the left and if a single long transform is desired for the current frame.

In case the following window sequence is not an LPD_SEQUENCE: Window length N_l and N_sr is set to 2048 (1920) and 256 (240) respectively.

In case the following window sequence is an LPD_SEQUENCE:

Window length N_l and N_sr is set to 2048 (1920) and 512 (480) respectively.

In case the previous window sequence is not an LPD_SEQUENCE:

Window length N_l and $N_sl$ is set to 2048 (1920) and 256 (240) respectively.

In case the previous window sequence is an LPD_SEQUENCE:

Window length N_l and $N_sl$ is set to 2048 (1920) and 512 (480) respectively.

If window_shape==1 the window for window type "STOP_START_SEQUENCE" is given as follows:

$$W(n) = \begin{cases} 0.0, & \text{for } 0 \le n < \frac{N_l - N_sl}{4} \\ W_{LEFT,N_sl}\left(n - \frac{N_l - N_sl}{4}\right), & \text{for } \frac{N_l - N_sl}{4} \le n < \frac{N_l + N_sl}{4} \\ 1.0, & \text{for } \frac{N_l + N_sl}{4} \le n < \frac{3N_l - N_sr}{4} \\ W_{KBD_RIGHT,N_sr}\left(n + \frac{N_sr}{2} - \frac{3N_l - N_sr}{4}\right), & \text{for } \frac{3N_l - N_sr}{4} \le n < \frac{3N_l + N_sr}{4} \\ 0.0, & \text{for } \frac{3N_l + N_sr}{4} \le n < N_l \end{cases}$$

If window_shape==0 the window for window type "STOP_START_SEQUENCE" looks like:

$$W(n) = \begin{cases} 0.0, & \text{for } 0 \le n < \frac{N_l - N_sl}{4} \\ W_{LEFT,N_sl}\left(n - \frac{N_l - N_sl}{4}\right), & \text{for } \frac{N_l - N_sl}{4} \le n < \frac{N_l + N_sl}{4} \\ 1.0, & \text{for } \frac{N_l + N_sl}{4} \le n < \frac{3N_l - N_sr}{4} \\ W_{SIN_RIGHT,N_sr}\left(n + \frac{N_sr}{2} - \frac{3N_l - N_sr}{4}\right), & \text{for } \frac{3N_l - N_sr}{4} \le n < \frac{3N_l + N_sr}{4} \\ 0.0, & \text{for } \frac{3N_l + N_sr}{4} \le n < N_l \end{cases}$$

The windowed time-domain values can be calculated with the formula explained in a).

9.3.3 Filterbank and Block Switching—Overlapping and Adding with Previous Window Sequence Besides the overlap and add within the EIGHT_SHORT window sequence the first (left) part of every window sequence (or of every frame or subframe) is overlapped and added with the second (right) part of the previous window sequence (or the previous frame or subframe) resulting in the final time domain values $out_{i,n}$. The mathematic expression for this operation can be described as follows.

In case of ONLY_LONG_SEQUENCE, LONG_START_SEQUENCE, EIGHT_SHORT_SEQUENCE, LONG_STOP_SEQUENCE, STOP_START_SEQUENCE:

$$out_{i,n} = z_{i,n} + z_{i-1,n+\frac{N}{2}};\ \text{for } 0 \le n < \frac{N}{2},\ N = 2048\ (1920)$$

The above equation for the overlap-and-add between audio frames encoded in the frequency-domain mode may also be used for the overlap-and-add of time-domain representations of the audio frames encoded in different modes.

Alternatively, the overlap-and-add may be defined as follows:

In case of ONLY_LONG_SEQUENCE, LONG_START_SEQUENCE, EIGHT_SHORT_SEQUENCE, LONG_STOP_SEQUENCE, STOP_START_SEQUENCE:

$$\text{out}[i_{out} + n] = Z_{i,n} + Z_{i-1,n+\frac{N_l}{2}};\ \forall\ 0 \le n < \frac{N_l}{2}$$

N_l is the size of the window sequence. i_out indexes the output buffer out and is incremented by the number $$\frac{N_L}{2}$$

of written samples.

In case of LPD_SEQUENCE:

In the following, a first approach will be described which may be used to reduce aliasing artifacts. When coming from ACELP, a specific window cane be used for the next TCX by means of reducing R to 0, and then eliminating overlapping region between the two subsequent frames.

In the following, a second approach will be described which may be used to reduce aliasing artifacts (as it is described in USAC WD5 and earlier). When coming from ACELP, the next TCX window is enlarged by means of increasing M (middle length) by 128 samples and by also increasing a number of MDCT coefficients associated with the TCX window. At the decoder, the right part of window, i.e. the first R non-zero decoded samples are simply discarded and replaced by the decoded ACELP samples. In other words, by providing additional MDCT coefficients (for example, 1152 instead of 1024), aliasing artifacts are reduced. Worded differently, by providing extra MDCT coefficients (such that the number of MDCT coefficients is larger than half of the number of time domain samples per audio frame), an aliasing-free portion of the time-domain representation can be obtained, which eliminates the need for a dedicated aliasing cancellation at the cost of a non-critical sampling of the spectrum.

Otherwise, when the previous decoded windowed signal $z_{i-1,n}$ comes from the MDCT based TCX, a conventional overlap and add is performed for getting the final time signal out. The overlap and add can be expressed by the following formula when FD mode window sequence is a LONG_START_SEQUENCE or an EIGHT_SHORT_SEQUENCE:

$$\mathrm{out}[i_{out}+n]=\begin{cases} z_{i,\frac{N_l-N_s}{4}+n}+z_{i-1,\frac{3\cdot N_{i-1}-2\cdot N_s}{4}+n}; & \forall\, 0\le n<\frac{N_s}{2} \\ z_{i,\frac{N_l-N_s}{4}+n}; & \forall\, \frac{N_s}{2}\le n<\frac{N_l+N_s}{4} \end{cases}$$

$N_{i-1}$ corresponds to the size 2lg of the previous window applied in MDCT based TCX. i_out indexes the output buffer out and is incremented by the number of (N_l+N_s)/4 of written samples. N_s/2 should be equal to the value L of the previous MDCT based TCX defined in the table of FIG. 15.

For a STOP_START_SEQUENCE the overlap and add between FD mode and MDCT based TCX as the following expression:

$$\mathrm{out}[i_{out}+n]=\begin{cases} z_{i,\frac{N_l-N_sl}{4}+n}+z_{i-1,\frac{3\cdot N_{i-1}-2\cdot N_sl}{4}+n}; & \forall\, 0\le n<\frac{N_sl}{2} \\ z_{i,\frac{N_l-N_sl}{4}+n}; & \forall\, \frac{N_sl}{2}\le n<\frac{N_l+N_sl}{4} \end{cases}$$

$N_{i-1}$ corresponds to the size 2lg of the previous window applied in MDCT based TCX. i_out indexes the buffer out and is incremented by the number (N_l+N_sl)/4 of written samples N_sl/2 should be equal to the value L of the previous MDCT based TCX defined in the table of FIG. 15.

10. Details Regarding the Computation of $\hat{w}[n]$

Figure 18:
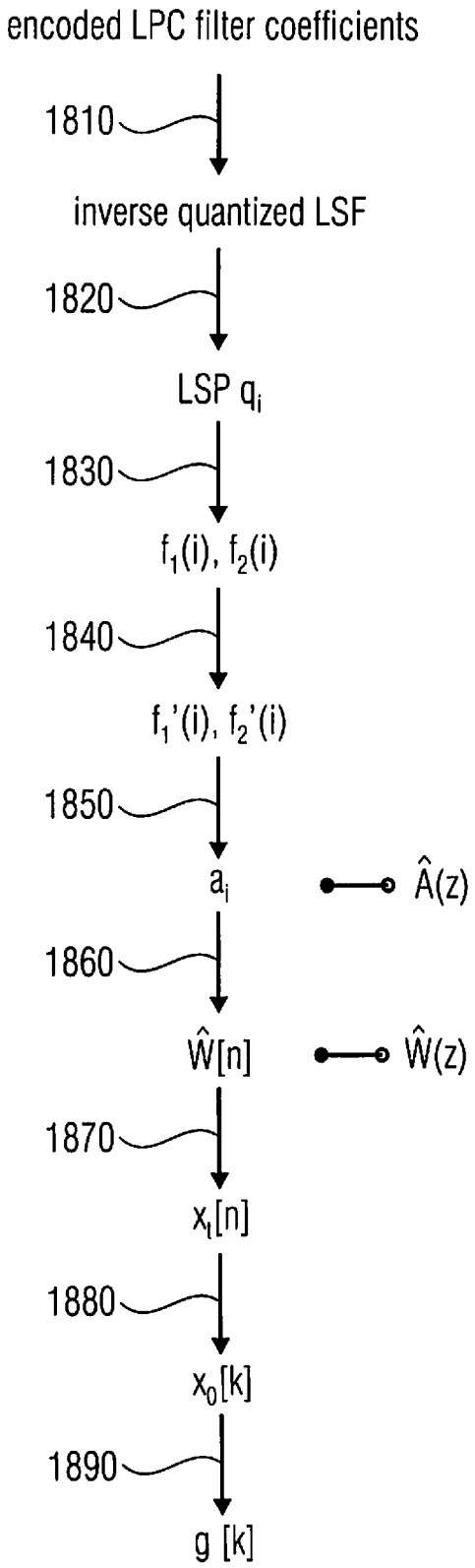
FIG. 18 shows a processing flow to derive linear-prediction-domain gain values g[k] in dependence on an encoded LPC filter coefficient.

In the following, some details regarding the computation of the linear-prediction-domain gain values g[k] will be described taking reference to FIG. 18, to facilitate the understanding. Typically, a bitstream representing the encoded audio content (encoded in the linear-prediction mode) comprises encoded LPC filter coefficients. The encoded LPC filter coefficients may for example be described by corresponding code words and may describe a linear prediction filter for recovering the audio content. It should be noted that the number of sets of LPC filter coefficients transmitted per LPC-encoded audio frame may vary. Indeed, the actual number of sets of LPC filter coefficients which are encoded within the bitstream for an audio frame encoded in the linear-prediction mode depends on the ACELP-TCX mode combination of the audio frame (which is sometimes also designated as "superframe"). This ACELP-TCX mode combination may be determined by a bitstream variable. However, there are naturally also cases in which there is only one TCX mode available, and there are also cases in which there is no ACELP mode available.

The bitstream is typically parsed to extract the quantization indices corresponding to each of the sets LPC filter coefficients needed by the ACELP TCX mode combination.

In a first processing step 1810, an inverse quantization of the LPC filter is performed. It should be noted that the LPC filters (i.e. the sets of LPC filter coefficients, for example, $a_1$ to $a_{16}$) are quantized using the line spectral frequency (LSF) representation (which is an encoding representation of the LPC filter coefficients). In the first processing step 1810, inverse quantized line spectral frequencies (LSF) are derived from the encoded indices.

For this purpose, a first stage approximation may be computed and an optional algebraic vector quantized (AVQ) refinement may be calculated. The inverse-quantized line spectral frequencies may be reconstructed by adding the first stage approximation and the inverse-weighted AVQ contribution. The presence of the AVQ refinement may depend on the actual quantization mode of the LPC filter.

The inverse-quantized line spectral frequencies vector, which may be derived from the encoded representation of the LPC filter coefficients, is later on converted into a vector of line-spectral pair parameters, then interpolated and converted again into LPC parameters. The inverse quantization procedure, performed in the processing step 1810, results in a set of LPC parameters in the line-spectral-frequency-domain. The line-spectral-frequencies are then converted, in a processing step 1820, to the cosine domain, which is described by line-spectral pairs. Accordingly, line-spectral pairs $q_i$ are obtained. For each frame or subframe, the line-spectral pair coefficients $q_i$ (or an interpolated version thereof) are converted into linear-prediction filter coefficients $a_k$, which are used for synthesizing the reconstructed signal in the frame or subframe. The conversion to the linear-prediction-domain is done as follows. The coefficients $f_{1(i)}$ and $f_{2(i)}$ may for example be derived using the following recursive relation:

```
for i = 1 to 8
    f1(i) = −2q2i−1f1(i − 1) + 2f1(i − 2)
    for j = i − 1 down to 1
        f1(j) = f1(j) − 2q2i−1f1(j − 1) + f1(j − 2)
    end
end
```

with initial values $f_1(0)=1$ and $f_1(-1)=0$. The coefficients $f_2(i)$ are computed similarly by replacing $q_{2i-1}$ by $q_{2i}$.

Once the coefficients of $f_1(i)$ and $f_2(i)$ are found, coefficients $f_1'(i)$ and $f_2'(i)$ are computed according to $$f_1'(i)=f_1(i)+f_1(i-1),\ i=1,\ldots,8$$

$$f_2'(i)=f_2(i)-f_2(i-1),\ i=1,\ldots,8$$

Finally, the LP coefficients $a_i$ are computed from $f'_1(i)$ and $f'_2(i)$ by $$a_i=\begin{cases}0.5f_1'(i)+0.5f_2'(i), & i=1,\ldots,8\\ 0.5f_1'(17-i)-0.5f_2'(17-i), & i=9,\ldots 16\end{cases}$$

To summarize, the derivation of the LPC coefficients $a_i$ from the line-spectral pair coefficients $q_i$ is performed using processing steps 1830, 1840, 1850, as explained above.

The coefficients $\hat{w}[n]$, n=0 . . . lpc_order−1, which are coefficients of a weighted LPC filter, are obtained in a processing step 1860. When deriving the coefficients $\hat{w}[n]$ from the coefficients $a_i$, it is considered that the coefficients $a_i$ are time-domain coefficients of a filter having filter characteristics $\hat{A}[z]$, and that the coefficients $\hat{w}[n]$ are time-domain coefficients of a filter having frequency-domain response $\hat{W}[z]$. Also, it is considered that the following relationship holds:

$$\hat{W}(z)=\hat{A}(z/\gamma_1)\text{ with }\gamma_1=0.92$$

In view of the above, it can be seen that the coefficients $\hat{w}[n]$ can easily be derived from the encoded LPC filter coefficients, which are represented, for example, by respective indices in the bitstream.

It should also be noted that the derivation of $x_t[n]$, which is performed in the processing step 1870 has been discussed above. Similarly, the computation of $X_0[k]$ has been discussed above. Similarly, the computation of the linear-prediction-domain gain values g[k], which is performed in step 1890, has been discussed above.

11. Alternative Solution for the Spectral-Shaping

It should be noted that a concept for spectral-shaping has been described above, which is applied for audio frames encoded in the linear-prediction-domain, and which is based on a transformation of LPC filter coefficients $\hat{w}_n[n]$ into a spectral representation $X_0[k]$ from which the linear-prediction-domain gain values are derived. As discussed above, the LPC filter coefficients $\hat{w}[n]$ are transformed into a frequency-domain representation $X_0[k]$, using an odd discrete Fourier transform having 64 equally-spaced frequency bins. However, it is naturally not necessary to obtain frequency-domain values $x_0[k]$, which are spaced equally in frequency. Rather, it may sometimes be recommendable to use frequency-domain values $x_0[k]$, which are spaced non-linearly in frequency. For example, the frequency-domain values $x_0[k]$ may be spaced logarithmically in frequency or may be spaced in frequency in accordance with a Bark scale. Such a non-linear spacing of the frequency-domain values $X_0[k]$ and of the linear-prediction-domain gain values g[k] may result in a particularly good trade-off between hearing impression and computational complexity. Nevertheless, it is not necessary to implement such a concept of a non-uniform frequency spacing of the linear-prediction-domain gain values.

12. Enhanced Transition Concept

In the following, an improved concept for the transition between an audio frame encoded in the frequency domain and an audio frame encoded in the linear-prediction-domain will be described. This improved concept uses a so-called linear-prediction mode start window, which will be explained in the following.

Taking reference first to FIGS. 17*a* and 17*b*, it should be noted that conventionally windows having a comparatively short right-side transition slope are applied to time-domain samples of an audio frame encoded in the frequency-domain mode when a transition for an audio frame encoded in the linear-prediction mode is made. As can be seen from FIG. 17*a*, a window of type "LONG_START_SEQUENCE", a window of type EIGHT_SHORT_SEQUENCE", a window of type "STOP_START_SEQUENCE" is conventionally applied before an audio frame encoded in the linear-prediction-domain. Thus, conventionally, there is no possibility to directly transition from a frequency-domain encoded audio frame, to which a window having a comparatively long right-sided slope is applied, to an audio frame encoded in the linear-prediction mode. This is due to the fact that conventionally, there are serious problems caused by the long time-domain aliasing portion of a frequency-domain encoded audio frame to which a window having a comparatively long right-sided transition slope is applied. As can be seen from FIG. 17*a*, it is conventionally not possible to transition from an audio frame to which the window type "only_long_sequence" is associated, or from an audio frame to which the window type "long_stop_sequence" is associated, to a subsequent audio frame encoded in the linear-prediction mode.

However, in some embodiments according to the invention, a new type of audio frame is used, namely an audio frame to which a linear-prediction mode start window is associated.

A new type of audio frame (also briefly designated as a linear-prediction mode start frame) is encoded in the TCX sub-mode of the linear-prediction-domain mode. The linear-prediction mode start frame comprises a single TCX frame (i.e., is not sub-divided into TCX subframes). Consequently, as much as 1024 MDCT coefficients are included in the bitstream, in an encoded form, for the linear-prediction mode start frame. In other words, the number of MDCT coefficients associated to a linear-prediction start frame is identical to the number of MDCT coefficients associated to the frequency-domain encoded audio frame to which a window of window type "only_long_sequence" is associated. Additionally, the window associated to the linear-prediction mode start frame may be of the window type "LONG_START_SEQUENCE". Thus, the linear-prediction mode start frame may be very similar to the frequency-domain encoded frame to which a window of type "long_start_sequence" is associated. However, the linear-prediction mode start frame differs from such a frequency-domain encoded audio frame in that the spectral-shaping is performed in dependence on the linear-prediction domain gain values, rather than in dependence on scale factor values. Thus, encoded linear-prediction-coding filter coefficients are included in the bitstream for the linear-prediction-mode start frame.

As the inverse MDCT 1354, 1382 is applied in the same domain (as explained above) both for an audio frame encoded in the frequency-domain mode and for an audio frame encoded in the linear-prediction mode, a time-domain-aliasing-canceling overlap-and-add operation with good time-aliasing-cancellation characteristics can be performed between a previous audio frame encoded in the frequency-domain mode and having a comparatively long right-sided transition slope (for example, of 1024 samples) and the linear-prediction mode start frame having a comparatively long left-sided transition slope (for example, of 1024 samples), wherein the transition slopes are matched for time-aliasing cancellation. Thus, the linear-prediction mode start frame is encoded in the linear-prediction mode (i.e. using linear-prediction-coding filter coefficients) and comprises a significantly longer (for example, at least by the factor of 2, or at least by the factor of 4, or at least by the factor of 8) left-sided transition slope than other linear-prediction mode encoded audio frames to create additional transition possibilities.

As a consequence, a linear-prediction mode start frame can replace the frequency-domain encoded audio frame having the window type "long_sequence". The linear-prediction mode start frame comprises the advantage that MDCT filter coefficients are transmitted for the linear-prediction mode start frame, which are available for a subsequent audio frame encoded in the linear-prediction mode. Consequently, it is not necessary to include extra LPC filter coefficient information into the bitstsream in order to have initialization information for a decoding of the subsequent linear-prediction-mode-encoded audio-frame.

Figure 14:
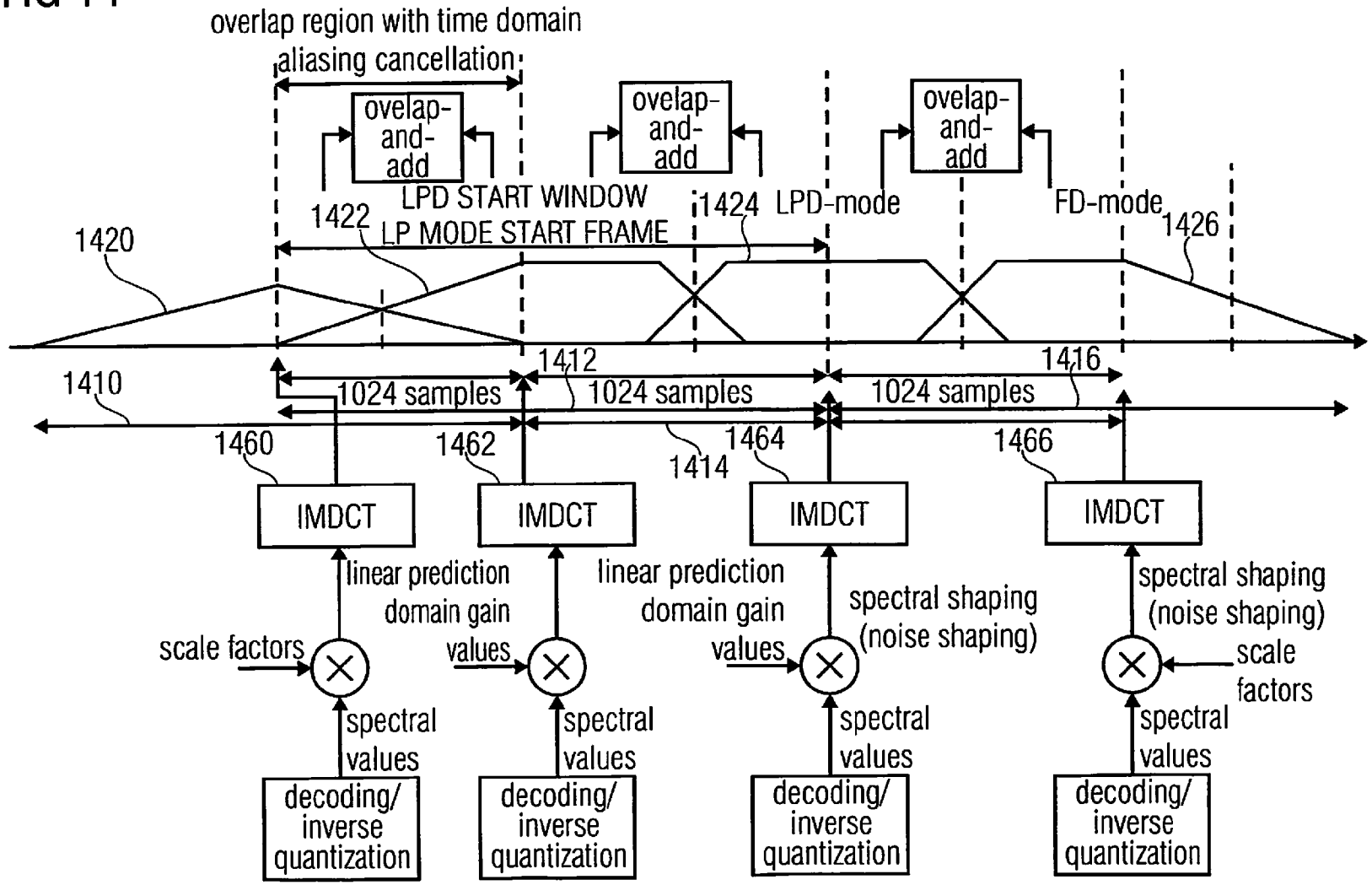
FIG. 14 shows a schematic representation of a processing of subsequent audio frames in the audio decoders according to FIGS. 11 and 12.

FIG. 14 illustrates this concept. FIG. 14 shows a graphical representation of a sequence of four audio frames 1410, 1412, 1414, 1416, which all comprise a length of 2048 audio samples, and which are overlapping by approximately 50%. The first audio frame 1410 is encoded in the frequency-domain mode using an "only_long_sequence" window 1420, the second audio frame 1412 is encoded in the linear-prediction mode using a linear-prediction mode start window, which is equal to the "long_start_sequence" window, the third audio frame 1414 is encoded in the linear-prediction mode using, for example, a window $\hat{W}[n]$ as defined above for a value of mod [x]=3, which is designated with 1424. It should be noted that the linear-prediction mode start window 1422 comprises a left-sided transition slope of length 1024 audio samples and a right-sided transition slope of length 256 samples. The window 1424 comprises a left-sided transition slope of length 256 samples and a right-sided transition slope of length 256 samples. The fourth audio frame 1416 is encoded in the frequency-domain mode using a "long_stop_sequence" window 1426, which comprises a left-sided transition slope of length 256 samples and a right-sided transition slope of length 1024 samples.

As can be seen in FIG. 14, time-domain samples for the audio frames are provided by inverse modified discrete cosine transforms 1460, 1462, 1464, 1466. For the audio frames 1410, 1416 encoded in the frequency-domain mode, the spectral-shaping is performed in dependence on scale factors and scale factor values. For the audio frames 1412, 1414, which are encoded in the linear-prediction mode, the spectral-shaping is performed in dependence on linear-prediction domain gain values which are derived from encoded linear prediction coding filter coefficients. In any case, spectral values are provided by a decoding (and, optionally, an inverse quantization).

13. Conclusion

To summarize, the embodiments according to the invention use an LPC-based noise-shaping applied in frequency-domain for a switched audio coder.

Embodiments according to the invention apply an LPC-based filter in the frequency-domain for easing the transition between different coders in the context of a switched audio codec.

Some embodiments consequently solve the problems to design efficient transitions between the three coding modes, frequency-domain coding, TCX (transform-coded-excitation linear-prediction-domain) and ACELP (algebraic-code-excited linear prediction). However, in some other embodiments, it is sufficient to have only two of said modes, for example, the frequency-domain coding and the TCX mode.

Embodiments according to the invention outperform the following alternative solutions:

- Non-critically sampled transitions between frequency-domain coder and linear-prediction domain coder (see, for example, reference [4]):
  - generate non-critical sampling, trade-off between overlapping size and overhead information, do not use fully the capacity (time-domain-aliasing cancellation TDAC) of the MDCTs.
  - need to send an extra LPC set of coefficients when going from frequency-domain coder to LPD coder.
- Apply a time-domain aliasing cancellation (TDAC) in different domains (see, for example, reference [5]). The LPC filtering is performed inside the MDCT between the folding and the DCT:
  - the time-domain aliased signal may not be appropriate for the filtering; and
  - it is needed to send an extra LPC set of coefficients when going from the frequency-domain coder to the LPD coder.
- Compute LPC coefficients in the MDCT domain for a non-switched coder ($T_{winVQ}$) (see, for example, reference [6]);
  - uses the LPC only as a spectral envelope presentation for flattening the spectrum. It does not exploit LPC neither for shaping the quantization noise nor for easing the transitions when switching to another audio coder.

Embodiments according to the present invention perform the frequency-domain coder and the LPC coder MDCT in the same domain while still using the LPC for shaping the quantization error in the MDCT domain. This brings along a number of advantages:

- LPC can still be used for switching to a speech-coder like ACELP.
- Time-domain aliasing cancellation (TDAC) is possible during transition from/to TCX to/from frequency-domain coder, the critical sampling is then maintained.
- LPC is still used as a noise-shaper in the surrounding of ACELP, which makes it possible to use the same objective function to maximize for both TCX and ACELP, (for example, the LPC-based weighted segmental SNR in a closed-loop decision process).

To further conclude, it is an important aspect that 1. transition between transform-coded-excitation (TCX) and frequency domain (FD) are significantly simplified/unified by applying the linear-prediction-coding in the frequency domain; and that
2. by maintaining the transmission of the LPC coefficients in the TCX case, the transitions between TCX and ACELP can be realized as advantageously as in other implementations (when applying the LPC filter in the time domain).

Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] "Unified speech and audio coding scheme for high quality at low bitrates", Max Neuendorf et al., in IEEE Int, Conf. Acoustics, Speech and Signal Processing, ICASSP, 2009

[2] Generic Coding of Moving Pictures and Associated Audio: Advanced Audio Coding. International Standard 13818-7, ISO/IEC JTC1/SC29/WG11 Moving Pictures Expert Group, 1997

[3] "Extended Adaptive Multi-Rate-Wideband (AMR-WB+) codec", 3GPP TS 26.290 V6.3.0, 2005-06, Technical Specification

[4] "Audio Encoder and Decoder for Encoding and Decoding Audio Samples", FH080703PUS, F49510, incorporated by reference,

[5] "Apparatus and Method for Encoding/Decoding an Audio Signal Using an Aliasing Switch Scheme", FH080715PUS, F49522, incorporated by reference

[6] "High-quality audio-coding at less than 64 kbits/s by using transform-domain weighted interleave vector quantization (Twin VQ)", N. Iwakami and T. Moriya and S. Miki, IEEE ICASSP, 1995

The invention claimed is:

1. A multi-mode audio signal decoder apparatus for providing a decoded representation of an audio content on the basis of an encoded representation of the audio content, the audio signal decoder comprising:

a spectral value determinator configured to acquire sets of decoded spectral coefficients for a plurality of portions of the audio content;

a spectrum processor configured to apply a spectral shaping to a set of decoded spectral coefficients, or to a pre-processed version thereof, in dependence on a set of linear-prediction-domain parameters for a portion of the audio content encoded in the linear-prediction mode, and to apply a spectral shaping to a set of decoded spectral coefficients, or a pre-processed version thereof, in dependence on a set of scale factor parameters for a portion of the audio content encoded in the frequency-domain mode, and a frequency-domain-to-time-domain converter configured to acquire a time-domain representation of the audio content on the basis of a spectrally-shaped set of decoded spectral coefficients for a portion of the audio content encoded in the linear-prediction mode, and to acquire a time-domain representation of the audio content on the basis of a spectrally-shaped set of decoded spectral coefficients for a portion of the audio content encoded in the frequency-domain mode;

wherein the multi-mode audio signal decoder is implemented using a hardware apparatus, or using a computer, or using a combination of a hardware apparatus and a computer.

2. The multi-mode audio signal decoder apparatus according to claim 1, wherein the multi-mode audio signal decoder further comprises an overlapper configured to overlap-and-add a time-domain representation of a portion of the audio content encoded in the linear-prediction mode with a portion of the audio content encoded in the frequency-domain mode.

3. The multi-mode audio signal decoder apparatus according to claim 2, wherein the frequency-domain-to-time-domain converter is configured to acquire a time-domain representation of the audio content for a portion of the audio content encoded in the linear-prediction mode using a lapped transform, and to acquire a time-domain representation of the audio content for a portion of the audio content encoded in the frequency-domain mode using a lapped transform, and wherein the overlapper is configured to overlap time-domain representations of subsequent portions of the audio content encoded in different of the modes.

4. The multi-mode audio signal decoder apparatus according to claim 3, wherein the frequency-domain-to-time-domain converter is configured to apply lapped transforms of the same transform type for acquiring time-domain representations of the audio content for portions of the audio content encoded in different of the modes; and wherein the overlapper is configured to overlap-and-add the time-domain representations of subsequent portions of the audio content encoded in different of the modes such that a time-domain aliasing caused by the lapped transform is reduced or eliminated.

5. The multi-mode audio signal decoder apparatus according to claim 4, wherein the overlapper is configured to overlap-and-add a windowed time-domain representation of a first portion of the audio content encoded in a first of the modes as provided by an associated lapped transform, or an amplitude-scaled but spectrally undistorted version thereof, and a windowed time-domain representation of a second subsequent portion of the audio content encoded in a second of the modes, as provided by an associated lapped transform, or an amplitude-scaled but spectrally undistorted version thereof.

6. The multi-mode audio signal decoder apparatus according to claim 1, wherein the frequency-domain-to-time-domain converter is configured to provide time-domain representations of portions of the audio content encoded in different of the modes such that the provided time-domain representations are in a same domain in that they are linearly combinable without applying a signal shaping filtering operation, except for a windowing transition operation, to one or both of the provided time-domain representations.

7. The multi-mode audio signal decoder apparatus according to claim 1, wherein the frequency-domain-to-time-domain converter is configured to perform an inverse modified discrete cosine transform, to acquire, as a result of the inverse modified discrete cosine transform, a time-domain representation of the audio content in an audio signal domain both for a portion of the audio content encoded in the linear-prediction mode and for a portion of the audio content encoded in the frequency-domain mode.

8. The multi-mode audio signal decoder apparatus according to claim 1, comprising:

a linear-prediction-coding filter coefficient determinator configured to acquire decoded linear-prediction-coding filter coefficients on the basis of an encoded representation of the linear-prediction-coding filter coefficients for a portion of the audio content encoded in the linear-prediction mode;

a filter coefficient transformer configured to transform the decoded linear-prediction-coding coefficients into a spectral representation, in order to acquire linear-prediction-mode gain values associated with different frequencies;

a scale factor determinator configured to acquire decoded scale factor values on the basis of an encoded representation of the scale factor values for a portion of the audio content encoded in a frequency-domain mode;

wherein the spectrum processor comprises a spectrum modifier configured to combine a set of decoded spectral coefficients associated to a portion of the audio content encoded in the linear-prediction mode, or a pre-processed version thereof, with the linear-prediction-mode gain values, in order to acquire a gain-processed version of the decoded spectral coefficients, in which contributions of the decoded spectral coefficients, or of the pre-processed version thereof, are weighted in dependence on the linear-prediction-mode gain values, and also configured to combine a set of decoded spectral coefficients associated to a portion of the audio content encoded in the frequency-domain mode, or a pre-processed version thereof, with the scale factor values, in order to acquire a scale-factor-processed version of the decoded spectral coefficients in which contributions of the decoded spectral coefficients, or of the pre-processed version thereof, are weighted in dependence on the scale factor values.

9. The multi-mode audio signal decoder apparatus according to claim 8, wherein the filter coefficient transformer is configured to transform the decoded linear-prediction-coding filter coefficients, which represent a time-domain impulse response of a linear-prediction-coding filter, into a spectral representation using an odd discrete Fourier transform; and wherein the filter coefficient transformer is configured to derive the linear-prediction-mode gain values from the spectral representation of the decoded linear-prediction-coding filter coefficients, such that the gain values are a function of magnitudes of coefficients of the spectral representation.

10. The multi-mode audio signal decoder apparatus according to claim 8, wherein the filter coefficient transformer and the combiner are configured such that a contribution of a given decoded spectral coefficient, or of a pre-processed version thereof, to a gain-processed version of the given spectral coefficient is determined by a magnitude of a linear-prediction-mode gain value associated with the given decoded spectral coefficient.

11. The multi-mode audio signal decoder apparatus according to claim 1, wherein the spectrum processor is configured such that a weighting of a contribution of a given decoded spectral coefficient, or of a pre-processed version thereof, to a gain-processed version of the given spectral coefficient increases with increasing magnitude of a linear-prediction-mode gain value associated with the given decoded spectral coefficient, or a such that a weighting of a contribution of a given decoded spectral coefficient, or of a pre-processed version thereof, to a gain-processed version of the given spectral coefficient decreases with increasing magnitude of an associated spectral coefficient of a spectral representation of the decoded linear-prediction-coding filter coefficients.

12. The multi-mode audio signal decoder apparatus according to claim 1, wherein the spectral value determinator is configured to apply an inverse quantization to decoded quantized spectral coefficients, in order to acquire decoded and inversely quantized spectral coefficients; and wherein the spectrum processor is configured to perform a quantization noise shaping by adjusting an effective quantization step for a given decoded spectral coefficient in dependence on a magnitude of a linear-prediction-mode gain value associated with the given decoded spectral coefficient.

13. The multi-mode audio signal decoder apparatus according to claim 1, wherein the audio signal decoder is configured to use an intermediate linear-prediction mode start frame in order to transition from a frequency-domain mode frame to a combined linear-prediction mode/algebraic-code-excited linear-prediction mode frame, wherein the audio signal decoder is configured to acquire a set of decoded spectral coefficients for the linear-prediction mode start frame, to apply a spectral shaping to the set of decoded spectral coefficients for the linear-prediction mode start frame, or to a pre-processed version thereof, in dependence on a set of linear-prediction-domain parameters associated therewith, to acquire a time-domain representation of the linear-prediction mode start frame on the basis of a spectrally shaped set of decoded spectral coefficients, and to apply a start window comprising a comparatively long left-sided transition slope and a comparatively short right-sided transition slope to the time-domain representation of the linear-prediction mode start frame.

14. The multi-mode audio signal decoder apparatus according to claim 13, wherein the audio signal decoder is configured to overlap a right-sided portion of a time-domain representation of a frequency-domain mode frame preceding the linear prediction mode start frame with a left-sided portion of a time-domain representation of the linear-prediction mode start frame, to acquire a reduction or cancellation of a time-domain aliasing.

15. The multi-mode audio signal decoder apparatus according to claim 13, wherein the audio signal decoder is configured to use linear-prediction domain parameters associated with the linear-prediction mode start frame in order to initialize an algebraic-code-excited linear prediction mode decoder for decoding at least a portion of the combined linear-prediction mode/algebraic-code-excited linear prediction mode frame following the linear-prediction mode start frame.

16. A multi-mode audio signal encoder apparatus for providing an encoded representation of an audio content on the basis of an input representation of the audio content, the audio signal encoder comprising:

a time-domain-to-frequency-domain converter configured to process the input representation of the audio content, to acquire a frequency-domain representation of the audio content, wherein the frequency-domain representation comprises a sequence of sets of spectral coefficients;

a spectrum processor configured to apply a spectral shaping to a set of spectral coefficients, or a pre-processed version thereof, in dependence on a set of linear-prediction domain parameters for a portion of the audio content to be encoded in the linear-prediction mode, to acquire a spectrally-shaped set of spectral coefficients, and to apply a spectral shaping to a set of spectral coefficients, or a pre-processed version thereof, in dependence on a set of scale factor parameters for a portion of the audio content to be encoded in the frequency-domain mode, to acquire a spectrally-shaped set of spectral coefficients; and a quantizing encoder configured to provide an encoded version of a spectrally-shaped set of spectral coefficients for the portion of the audio content to be encoded in the linear-prediction mode, and to provide an encoded version of a spectrally-shaped set of spectral coefficients for the portion of the audio content to be encoded in the frequency-domain mode;

wherein the multi-mode audio signal encoder is implemented using a hardware apparatus, or using a computer, or using a combination of a hardware apparatus and a computer.

17. The multi-mode audio signal encoder apparatus according to claim 16, wherein the time-domain-to-frequency-domain converter is configured to convert a time-domain representation of an audio content in an audio signal domain into a frequency-domain representation of the audio content both for a portion of the audio content to be encoded in the linear-prediction mode and for a portion of the audio content to be encoded in the frequency-domain mode.

18. The multi-mode audio signal encoder apparatus according to claim 16, wherein the time-domain-to-frequency-domain converter is configured to apply lapped transforms of the same transform type for acquiring frequency-domain representations for portions of the audio content to be encoded in different modes.

19. The multi-mode audio signal encoder apparatus according to claim 16, wherein the spectral processor is configured to selectively apply the spectral shaping to the set of spectral coefficients, or a pre-processed version thereof, in dependence on a set of linear-prediction domain parameters acquired using a correlation-based analysis of a portion of the audio content to be encoded in the linear-prediction mode, or in dependence on a set of scale factor parameters acquired using a psychoacoustic model analysis of a portion of the audio content to be encoded in the frequency-domain mode.

20. The multi-mode audio signal encoder apparatus according to claim 19, wherein the audio signal encoder comprises a mode selector configured to analyze the audio content in order to decide whether to encode a portion of the audio content in the linear-prediction mode or in the frequency-domain mode.

21. The multi-mode audio signal encoder apparatus according to claim 16, wherein the multi-channel audio signal encoder is configured to encode an audio frame, which is between a frequency-domain mode frame and a combined transform-coded-excitation linear-prediction mode/algebraic-code-excited linear prediction mode frame as a linear-prediction mode start frame, wherein the multi-mode audio signal encoder is configured to apply a start window comprising a comparatively long left-sided transition slope and a comparatively short right-sided transition slope to the time-domain representation of the linear-prediction mode start frame, to acquire a windowed time-domain representation, to acquire a frequency-domain representation of the windowed time-domain representation of the linear prediction mode start frame, to acquire a set of linear-prediction domain parameters for the linear-prediction mode start frame, to apply a spectral shaping to the frequency-domain representation of the windowed time-domain representation of the linear prediction mode start frame, or a pre-processed version thereof, in dependence on the set of linear-prediction domain parameters, and to encode the set of linear-prediction domain parameters and the spectrally shaped frequency domain representation of the windowed time-domain representation of the linear-prediction mode start frame.

22. The multi-mode audio signal encoder apparatus according to claim 21, wherein the multi-mode audio signal encoder is configured to use the linear-prediction domain parameters associated with the linear-prediction mode start frame in order initialize an algebraic-code-excited linear prediction mode encoder for encoding at least a portion of the combined transform-coded-excitation linear prediction mode/algebraic-code-excited linear prediction mode frame following the linear-prediction mode start frame.

23. The multi-mode audio signal encoder apparatus according to claim 16, the audio signal encoder comprising:

a linear-prediction-coding filter coefficient determinator configured to analyze a portion of the audio content to be encoded in a linear-prediction mode, or a pre-processed version thereof, to determine linear-prediction-coding filter coefficients associated with the portion of the audio content to be encoded in the linear-prediction mode;

a filter-coefficient transformer configured to transform the linear-prediction coding filter coefficients into a spectral representation, in order to acquire linear-prediction-mode gain values associated with different frequencies;

a scale factor determinator configured to analyze a portion of the audio content to be encoded in the frequency domain mode, or a pre-processed version thereof, to determine scale factors associated with the portion of the audio content to be encoded in the frequency domain mode;

a combiner arrangement configured to combine a frequency-domain representation of a portion of the audio content to be encoded in the linear-prediction mode, or a pre-processed version thereof, with the linear-prediction mode gain values, to acquire gain-processed spectral components, wherein contributions of the spectral components of the frequency-domain representation of the audio content are weighted in dependence on the linear-prediction mode gain values, and to combine a frequency-domain representation of a portion of the audio content to be encoded in the frequency domain mode, or a pre-processed version thereof, with the scale factors, to acquire gain-processed spectral components, wherein contributions of the spectral components of the frequency-domain representation of the audio content are weighted in dependence on the scale factors, wherein the gain-processed spectral components form spectrally shaped sets of spectral coefficients.

24. A method for providing a decoded representation of an audio content on the basis of an encoded representation of the audio content, the method comprising:

acquiring sets of decoded spectral coefficients for a plurality of portions of the audio content;

applying a spectral shaping to a set of decoded spectral coefficients, or a pre-processed version thereof, in dependence on a set of linear-prediction-domain parameters for a portion of the audio content encoded in a linear-prediction mode, and applying a spectral shaping to a set of decoded spectral coefficients, or a pre-processed version thereof, in dependence on a set of scale factor parameters for a portion of the audio content encoded in a frequency-domain mode; and acquiring a time-domain representation of the audio content on the basis of a spectrally-shaped set of decoded spectral coefficients for a portion of the audio content encoded in the linear-prediction mode, and acquiring a time-domain representation of the audio content on the basis of a spectrally-shaped set of decoded spectral coefficients for a portion of the audio content encoded in the frequency-domain mode, wherein acquiring sets of decoded spectral coefficients, applying a spectral shaping and acquiring a time-domain representation of the audio content are performed using a hardware apparatus, or using a computer, or using a combination of a hardware apparatus and a computer.

25. A method for providing an encoded representation of an audio content on the basis of an input representation of the audio content, the method comprising:

processing the input representation of the audio content, to acquire a frequency-domain representation of the audio content, wherein the frequency-domain representation comprises a sequence of sets of spectral coefficients;

applying a spectral shaping to a set of spectral coefficients, or a pre-processed version thereof, in dependence on a set of linear-prediction domain parameters for a portion of the audio content to be encoded in the linear-prediction mode, to acquire a spectrally-shaped set of spectral coefficients;

applying a spectral shaping to a set of spectral coefficients, or a pre-processed version thereof, in dependence on a set of scale factor parameters for a portion of the audio content to be encoded in the frequency-domain mode, to acquire a spectrally-shaped set of spectral coefficients;

providing an encoded representation of a spectrally-shaped set of spectral coefficients for the portion of the audio content to be encoded in the linear-prediction mode using a quantizing encoding; and providing an encoded version of a spectrally-shaped set of spectral coefficients for the portion of the audio content to be encoded in the frequency domain mode using a quantizing encoding;

wherein processing the input representation of the audio content, applying a spectral shaping to a set of spectral coefficients, or a pre-processed version thereof, and providing an encoded representation of a spectrally-shaped set of spectral coefficients, are performed using a hardware apparatus, or using a computer, or using a combination of a hardware apparatus and a computer.

26. A non-transitory computer readable medium comprising a computer program for performing the method for providing a decoded representation of an audio content on the basis of an encoded representation of the audio content, the method comprising:

acquiring sets of decoded spectral coefficients for a plurality of portions of the audio content;

applying a spectral shaping to a set of decoded spectral coefficients, or a pre-processed version thereof, in dependence on a set of linear-prediction-domain parameters for a portion of the audio content encoded in a linear-prediction mode, and applying a spectral shaping to a set of decoded spectral coefficients, or a pre-processed version thereof, in dependence on a set of scale factor parameters for a portion of the audio content encoded in a frequency-domain mode; and acquiring a time-domain representation of the audio content on the basis of a spectrally-shaped set of decoded spectral coefficients for a portion of the audio content encoded in the linear-prediction mode, and acquiring a time-domain representation of the audio content on the basis of a spectrally-shaped set of decoded spectral coefficients for a portion of the audio content encoded in the frequency-domain mode, when the computer program runs on a computer.

27. A non-transitory computer readable medium comprising a computer program for performing the method for providing an encoded representation of an audio content on the basis of an input representation of the audio content, the method comprising:

processing the input representation of the audio content, to acquire a frequency-domain representation of the audio content, wherein the frequency-domain representation comprises a sequence of sets of spectral coefficients;

applying a spectral shaping to a set of spectral coefficients, or a pre-processed version thereof, in dependence on a set of linear-prediction domain parameters for a portion of the audio content to be encoded in the linear-prediction mode, to acquire a spectrally-shaped set of spectral coefficients;

applying a spectral shaping to a set of spectral coefficients, or a pre-processed version thereof, in dependence on a set of scale factor parameters for a portion of the audio content to be encoded in the frequency-domain mode, to acquire a spectrally-shaped set of spectral coefficients;

providing an encoded representation of a spectrally-shaped set of spectral coefficients for the portion of the audio content to be encoded in the linear-prediction mode using a quantizing encoding; and providing an encoded version of a spectrally-shaped set of spectral coefficients for the portion of the audio content to be encoded in the frequency domain mode using a quantizing encoding, when the computer program runs on a computer.

* * * * *

UNITED STATES PATENT AND TRADEMARK OFFICE

CERTIFICATE OF CORRECTION

PATENT NO. : 8,744,863 B2
APPLICATION NO. : 13/441469
DATED : June 3, 2014
INVENTOR(S) : Max Neuendorf et al.

It is certified that error appears in the above-identified patent and that said Letters Patent is hereby corrected as shown below:

Title Page

(75) Inventors:

Jeremie Lecomte, Forth (DE)

should be:

Jeremie Lecomte, Fuerth (DE)

(73) Assignee:

Fraunhofer-Gesellschaft zur Foerderung der Angewandten Forschung E.V.

should be:

Fraunhofer-Gesellschaft zur Foerderung der angewandten Forschung e.V.

Signed and Sealed this
Twenty-third Day of June, 2015

Michelle K. Lee

Michelle K. Lee
*Director of the United States Patent and Trademark Office*